US008277112B2

(12) United States Patent
Bhopte et al.

(10) Patent No.: US 8,277,112 B2
(45) Date of Patent: Oct. 2, 2012

(54) DEVICES AND FLUID FLOW METHODS FOR IMPROVING MIXING

(75) Inventors: Siddharth Bhopte, Johnson City, NY (US); Bruce Murray, Binghamton, NY (US); Bahgat Sammakia, Binghamton, NY (US)

(73) Assignee: The Research Foundation of State University of New York, Binghamton, NY (US)

( * ) Notice: Subject to any disclaimer, the term of this patent is extended or adjusted under 35 U.S.C. 154(b) by 551 days.

(21) Appl. No.: 12/472,655

(22) Filed: May 27, 2009

(65) Prior Publication Data

US 2009/0323463 A1 Dec. 31, 2009

Related U.S. Application Data

(60) Provisional application No. 61/056,355, filed on May 27, 2008.

(51) Int. Cl.
*B01F 5/00* (2006.01)

(52) U.S. Cl. ..... 366/181.5; 366/336; 366/337

(58) Field of Classification Search ..... 366/181.5, 366/336, 337, DIG. 1–DIG. 3
See application file for complete search history.

(56) References Cited

U.S. PATENT DOCUMENTS

| | | | | |
|---|---|---|---|---|
| 5,885,470 | A | 3/1999 | Parce et al. | |
| 6,068,752 | A * | 5/2000 | Dubrow et al. | 204/604 |
| 6,153,073 | A * | 11/2000 | Dubrow et al. | 204/453 |
| 6,171,865 | B1 | 1/2001 | Weigl et al. | |
| 6,176,962 | B1 | 1/2001 | Soane et al. | |
| 6,221,677 | B1 | 4/2001 | Wu et al. | |
| 6,468,761 | B2 * | 10/2002 | Yang et al. | 435/23 |
| 6,907,895 | B2 | 6/2005 | Johnson et al. | |
| 7,179,423 | B2 | 2/2007 | Bohm et al. | |
| 7,314,567 | B2 | 1/2008 | Wagler et al. | |
| 7,374,332 | B2 | 5/2008 | Higashino et al. | |

OTHER PUBLICATIONS

Bhopte et al., IMECE2007-43387, Proceedings of IMECE 2007, Nov. 11-15, 2007.
Dasgupta et al., Analytical Chemistry (2002) 74(7): 208 A-213 A.
Glasgow et al., Lab Chip (2003) 3: 114-120.
Glasgow et al., Analytical Chemistry, 76:4825-4832 (2004).
Glasgow et al., IMECE2003-41586, Proceedings of IMECE 2003, Nov. 15-21, 2003.
Goullet et al., Mechanics Research Communication (2006) 33:739-746.
Goullet et al., Dynamics of Microfluidic Mixing Using Time Pulsing Supplement vol. 2005, pp. 327-336.
Bhopte et al., Application of Split Flow Design Technique to Simple Microchannel Geometries for Enhanced Mixing, BioMed 2008-38096, Jun. 18-20, 2008, pp. 1-2.
Bhopte et al., Numerical Study of a Novel Passive Micromixer Design, Mar. 5, 2010, p. 1-10.
Bhopte et al., Geometric Modifications to Simple Microchannel Design For Enhanced Mixing, Mar. 14, 2008, pp. 1-8.

* cited by examiner

*Primary Examiner* — David Sorkin
(74) *Attorney, Agent, or Firm* — Medlen & Carroll, LLP

(57) ABSTRACT

The invention provides devices and methods for increasing the degree of mixing of fluids, including under conditions of laminar flow and turbulent flow. In one embodiment, mixing of fluids using the invention's devices and methods is increased by splitting the flow of at least one of the fluids into two or more inlet channels. This is optionally followed by further splitting and merging (e.g., using one or more split and merge (SAM) mixer) the fluids.

10 Claims, 38 Drawing Sheets
(26 of 38 Drawing Sheet(s) Filed in Color)

DEVICES AND FLUID FLOW METHODS FOR IMPROVING MIXING

This application claims priority to U.S. Provisional Application Ser. No. 61/056,355, filed May 27, 2008, herein incorporated by reference in its entirety for all purposes.

FIELD OF THE INVENTION

The invention provides devices and methods for increasing the mixing of fluids, including under conditions of laminar flow and turbulent flow. In one embodiment, mixing of fluids using the invention's devices and methods is increased by splitting the flow of at least one of the fluids into two or more inlet channels. This is optionally followed by further splitting and merging the fluids, such as by using one or more split and merge (SAM) mixer.

BACKGROUND OF THE INVENTION

The ability to control mixing of reagents is important for many biological and chemical analysis applications. However mixing, particularly in microfluidic and microelectromechanical systems (MEMS) devices is a challenge because the flows are laminar. Recent numerical and experimental research studies have investigated the effect of microchannel geometries and time pulsing on mixing enhancement.

Some parameters that impact mixing in microchannels have been previously investigated (Glasgow et al., Analytical Chemistry, 76:4825-4832 (2004); Glasgow et al IMECE2003-41586, Proceedings of IMECE 2003, Nov. 15-21, 2003; Goullet et al., Mechanics Research Communication (2006) 33:739-746; Goullet et al., Dynamics of Microfluidic Mixing Using Time Pulsing, Supplement Volume 2005, pp. 327-336; Glasgow et al., Lab Chip (2003) 3: 114-120; and Johnson et al., "Microfluidic passive Mixing Structures," National Institute of Standards and Technology).

However, there remains a need for devices and methods for improving mixing of fluids, particularly in conditions of laminar flow, such as those encountered in microfluidic devices.

SUMMARY OF THE INVENTION

The invention provides devices and methods for increasing the mixing of fluids, including under conditions of laminar flow and turbulent flow. In one embodiment, mixing of fluids using the invention's devices and methods is increased by splitting the flow of at least one of the fluids into two or more inlet channels. This is optionally followed by further splitting and merging the fluids, such as by using one or more split and merge (SAM) mixer. In one embodiment, the invention's devices may contain a fluid in any one or more of the devices' channels, such as in the inlet channel, outlet channel, mixing channel, splitting channel, etc.

Thus, in one embodiment comprising a two-way split of one fluid, the invention provides a device comprising a channel in fluid communication with a) a first inlet channel for a first fluid, b) a second inlet channel for a second fluid, and c) a third inlet channel for the second fluid, wherein the channel comprises a longitudinal axis, and wherein the second inlet channel and the third inlet channel are not on the same side of the channel longitudinal axis. While not intending to limit the location of the second and third inlet channels, in one embodiment, the second inlet channel and the third inlet channel are on opposite sides of the channel longitudinal axis. In a particular embodiment, the second inlet channel and the third inlet channel are opposite each other. In an alternative embodiment, the second inlet channel and the third inlet channel are not opposite each other.

Where it may be desirable to provide a two-way split of each of the first fluid and second fluid, the device further comprises d) a fourth inlet channel for the first fluid, wherein the fourth inlet channel is in fluid communication with the channel. In a particular embodiment, the first inlet channel and the fourth inlet channel are not opposite each other, and the second inlet channel and the third inlet channel are not opposite each other.

Where it may be desirable to provide a four-way split for the inlet channel of the second fluid (regardless of whether the inlet channel of a first fluid is split), the device further comprises in fluid communication with the channel d) a fourth inlet channel for the second fluid, and e) a fifth inlet channel for the second fluid, wherein the fourth inlet channel and the fifth inlet channel are not on the same side of the channel longitudinal axis.

Without intending to limit the location of the splitting inlet channels, in one embodiment, (a) the second inlet channel and the third inlet channel are on opposite sides of the channel longitudinal axis, and (b) the fourth inlet channel and the fifth inlet channel are on opposite sides of the channel longitudinal axis. In a particular embodiment, the second inlet channel and the third inlet channel are not opposite each other, and the fourth inlet channel and the fifth inlet channel are not opposite each other.

The splitting inlet channels for fluid A and/or fluid B may be at any angle with respect to the channel longitudinal axis. Thus in one embodiment, at least one of the second inlet channel and the third inlet channel is perpendicular to the channel longitudinal axis. In an alternative embodiment, at least one of the second inlet channel and the third inlet channel is not perpendicular to the channel longitudinal axis. In yet another embodiment, the second inlet channel and the third inlet channel are parallel to each other. In a further alternative embodiment, the second inlet channel and the third inlet channel are not parallel to each other.

While not necessary, it may be desirable to include one or more wells into the invention's devices. In one embodiment, the device further comprises in fluid communication with the channel, one or more of d) a first well in fluid communication with the first inlet channel, e) a second well in fluid communication with the second inlet channel, and f) a third well in fluid communication with the third inlet channel.

The invention additionally provides a method for mixing a first fluid and a second fluid in a channel, comprising a) flowing the first fluid into a first inlet channel that is in fluid communication with the channel, b) flowing the second fluid into a second inlet channel and into a third inlet channel, wherein 1) the second inlet channel and the third inlet channel are in fluid communication with the channel, and 2) flow from the second inlet channel and flow from the third inlet channel intersect different sides of the longitudinal axis of the first fluid in the channel. In a particular embodiment, the degree of mixing (DOM) of the first fluid and the second fluid is greater than in the absence of the second inlet channel.

Where it may be desirable to provide a two-way split for each of the first fluid and second fluid, the method further comprises c) flowing the first fluid into a fourth inlet channel that is in fluid communication with the channel. In some embodiments, the method further comprises pulsing flow in at least one of the first inlet channel, the second inlet channel, the third inlet channel, and the fourth inlet channel. In other embodiments, the method further comprises flowing fluid from at least one of the first inlet channel, the second inlet channel, the third inlet channel, and the fourth inlet channel into a well that is in fluid communication with the channel.

Also provided herein is a method for increasing degree of mixing of a first fluid and a second fluid in a channel by two-way splitting the flow of one fluid, comprising a) flowing the first fluid into a first inlet channel that is in fluid communication with the channel, b) splitting the flow of the second fluid into a second inlet channel and into a third inlet channel, wherein 1) the second inlet channel and the third inlet channel are in fluid communication with the channel, 2) flow from the second inlet channel and flow from the third inlet channel intersect different sides of the longitudinal axis of the first fluid in the channel, and 3) degree of mixing (DOM) of the first fluid and the second fluid in the channel is higher than in the absence of the splitting the flow of the second fluid. Where it is desirable to provide a two-way split of each of two fluids, the method further comprises c) splitting the flow of the first fluid between the first inlet channel and a fourth inlet channel, wherein a) the fourth inlet channel is in fluid communication with the channel, b) flow from the first inlet channel and flow from the fourth inlet channel intersect different sides of the longitudinal axis of the second fluid in the channel, and c) degree of mixing (DOM) of the first fluid and the second fluid in the channel is higher than in the absence of the splitting the flow of the first fluid.

Where it is desirable to split the flow of each of two fluids, the invention provides a device comprising a first mixer of laminar microfluidic streams, wherein the first mixer comprises a) a first mixing channel having a longitudinal axis and an outlet, b) a first inlet channel, for a first fluid, in transverse fluid communication with the first mixing channel at a first confluence along the longitudinal axis, c) a second inlet channel, for the first fluid, in transverse fluid communication with the first mixing channel at a second confluence along the longitudinal axis, d) a third inlet channel, for a second fluid, in transverse fluid communication with the first mixing channel at a third confluence along the longitudinal axis, and e) a fourth inlet channel, for the second fluid, in transverse fluid communication with the first mixing channel at a fourth confluence along the longitudinal axis, wherein i) the first confluence, the second confluence, the third confluence, and the fourth confluence are not opposite each other, and ii) the first confluence and the second confluence alternate with the third confluence and with the fourth confluence.

In a first preferred embodiment, the device further comprises a second mixer of laminar microfluidic streams, wherein the second mixer comprises 0 a merge channel having a first inlet and a second inlet, g) a second mixing channel having an inlet and an outlet, wherein the second mixing channel inlet is in transverse fluid communication with the merge channel at a mixing channel confluence, h) a first splitting channel having an inlet and an outlet, wherein the first splitting channel inlet is in transverse fluid communication with the first mixing channel outlet, and wherein the first splitting channel outlet is in transverse fluid communication with the merge channel first inlet at a fifth confluence, and i) a second splitting channel having an inlet and an outlet, wherein the second splitting channel inlet is in transverse fluid communication with the first mixing channel outlet, wherein the second splitting channel outlet is in transverse fluid communication with the merge channel second inlet at a sixth confluence, and wherein the fifth confluence and the sixth confluence are not opposite each other, and are not on the same side of the mixing channel confluence. While not intending to limit the shape of the first splitting channel, the second splitting channel, the mixing channel and/or the merge channel, in one embodiment, each of the first splitting channel and the second splitting channel comprises 2 turns. In another embodiment, the second mixing channel comprises 3 turns. In a further embodiment, the merge channel comprises (i) a groove between the first inlet of the merge channel and the inlet of the second mixing channel, and (ii) a groove between the second inlet of the merge channel and the inlet of the second mixing channel.

In a second preferred embodiment, the device further comprises a second mixer of laminar microfluidic streams, wherein the second mixer comprises f) a merge channel having an inlet and outlet, g) a first splitting channel having an inlet and an outlet, wherein the first splitting channel inlet is in transverse fluid communication with the first mixing channel outlet, and wherein the first splitting channel outlet is in transverse fluid communication with the merge channel inlet at a fifth confluence, and h) a second splitting channel having an inlet and an outlet, wherein the second splitting channel inlet is in transverse fluid communication with the first mixing channel outlet, and wherein the second splitting channel outlet is in transverse fluid communication with the merge channel at a sixth confluence, and wherein the fifth confluence and the sixth confluence are not opposite each other. Without limiting the shape of the first splitting channel and/or second splitting channel, in one embodiment, each of the first splitting channel and the second splitting channel comprises 2 turns.

The invention further provides methods for increasing the degree of mixing of a first fluid and a second fluid, comprising a) providing a device comprising a first mixer of laminar microfluidic streams, wherein the first mixer comprises a) a first mixing channel having a longitudinal axis and an outlet, b) a first inlet channel, for a first fluid, in transverse fluid communication with the first mixing channel at a first confluence along the longitudinal axis, c) a second inlet channel, for the first fluid, in transverse fluid communication with the first mixing channel at a second confluence along the longitudinal axis, d) a third inlet channel, for a second fluid, in transverse fluid communication with the first mixing channel at a third confluence along the longitudinal axis, and e) a fourth inlet channel, for the second fluid, in transverse fluid communication with the first mixing channel at a fourth confluence along the longitudinal axis, wherein i) the first confluence, the second confluence, the third confluence, and the fourth confluence are not opposite each other, and ii) the first confluence and the second confluence alternate with the third confluence and with the fourth confluence, b) splitting the flow of a first fluid into the first inlet channel and the second inlet channel, c) splitting the flow of a second fluid into the third inlet channel and the fourth inlet channel, wherein flow from the third inlet channel and flow from the fourth inlet channel intersect different sides of flow of the first fluid in the first mixing channel, and d) producing a first mixed fluid at the mixing channel outlet, wherein degree of mixing (DOM) of the first fluid and the second fluid in the first mixed fluid is higher than in the absence of the splitting the flow of the first fluid and of the splitting the flow of the second fluid. It is not intended that the degree of mixing in the invention's method be limited to a particular range, or value. However, in one embodiment, the degree of mixing in the first mixed fluid is at least 200% higher than in the absence of the splitting the flow of the first fluid and of the splitting the flow of the second fluid. Also, it is not intended that the pressure drop in the invention's device be limited to a particular range or value. However, in one embodiment, the pressure drop between 1) any one of the inlet of the first inlet channel, the inlet of the second inlet channel, the inlet of the third inlet channel, and the inlet of the fourth inlet channel, and 2) the first mixing channel outlet is substantially the same as, or higher than, the pressure drop in the absence of the splitting the flow of the first fluid and of the splitting the flow of the second fluid.

The invention additionally provides a method for increasing degree of mixing of a first fluid and a second fluid in a channel, comprising a) providing a device comprising a first mixer of laminar microfluidic streams, wherein the first mixer comprises a) a first mixing channel having a longitudinal axis and an outlet, b) a first inlet channel, for a first fluid, in transverse fluid communication with the first mixing channel at a first confluence along the longitudinal axis, c) a second inlet channel, for the first fluid, in transverse fluid communication with the first mixing channel at a second confluence along the longitudinal axis, d) a third inlet channel, for a second fluid, in transverse fluid communication with the first mixing channel at a third confluence along the longitudinal axis, and e) a fourth inlet channel, for the second fluid, in transverse fluid communication with the first mixing channel at a fourth confluence along the longitudinal axis, wherein i) the first confluence, the second confluence, the third confluence, and the fourth confluence are not opposite each other, and ii) the first confluence and the second confluence alternate with the third confluence and with the fourth confluence, f) a merge channel having a first inlet and a second inlet, g) a second mixing channel having an inlet and an outlet, wherein the second mixing channel inlet is in transverse fluid communication with the merge channel at a mixing channel confluence, h) a first splitting channel having an inlet and an outlet, wherein the first splitting channel inlet is in transverse fluid communication with the first mixing channel outlet, and wherein the first splitting channel outlet is in transverse fluid communication with the merge channel first inlet at a fifth confluence, and i) a second splitting channel having an inlet and an outlet, wherein the second splitting channel inlet is in transverse fluid communication with the first mixing channel outlet, wherein the second splitting channel outlet is in transverse fluid communication with the merge channel second inlet at a sixth confluence, and wherein the fifth confluence and the sixth confluence are not opposite each other, and are not on the same side of the mixing channel confluence, b) splitting the flow of a first fluid into the first inlet channel and the second inlet channel, c) splitting the flow of a second fluid into the third inlet channel and the fourth inlet channel, wherein flow from the third inlet channel and flow from the fourth inlet channel intersect different sides of flow of the first fluid in the first mixing channel, thereby producing a first mixed fluid at the mixing channel outlet, d) splitting the flow of the first mixed fluid into the first splitting channel and the second splitting channel, e) merging the flow of fluid from the first splitting channel outlet and fluid from the second splitting channel outlet into the merge channel, to produce a second mixed fluid, and f) flowing the second mixed fluid into the second mixing channel to produce a third mixed fluid at the second mixing channel outlet, wherein degree of mixing (DOM) of the first fluid and the second fluid in the third mixed fluid is higher than in the absence of the splitting the flow of the first fluid in step b) and of the splitting the flow of the second fluid in step c). Without intending to limit the degree of mixing to any particular value or range, in one embodiment, the degree of mixing (DOM) of the first fluid and the second fluid in the third mixed fluid is at least 200% higher than in the absence of the splitting the flow of the first fluid and of the splitting the flow of the second fluid. Also without intending to limit the pressure drop to any particular value or range, the pressure drop between 1) any one of the inlet of the first inlet channel, the inlet of the second inlet channel, the inlet of the third inlet channel, and the inlet of the fourth inlet channel, and 2) the second mixing channel outlet is higher than the pressure drop in the absence of the splitting the flow of the first fluid and of the splitting the flow of the second fluid. In a more preferred embodiment, the pressure drop is less than 300% higher than the pressure drop in the absence of the splitting the flow of the first fluid and of the splitting the flow of the second fluid. Without limiting the shape of the first splitting channel, the second splitting channel, the second mixing channel and/or the merge channel, in one embodiment, each of the first splitting channel and the second splitting channel comprises 2 right angle turns. In another embodiment, the second mixing channel comprises 3 turns. In yet another embodiment, the merge channel comprises (i) a groove between the first inlet of the merge channel and the inlet of the second mixing channel, and (ii) a groove between the second inlet of the merge channel and the inlet of the second mixing channel.

Also provided by the invention is a method for increasing degree of mixing of a first fluid and a second fluid in a channel, comprising a) providing a device comprising a first mixer of laminar microfluidic streams, wherein the first mixer comprises a) a first mixing channel having a longitudinal axis and an outlet, b) a first inlet channel, for a first fluid, in transverse fluid communication with the first mixing channel at a first confluence along the longitudinal axis, c) a second inlet channel, for the first fluid, in transverse fluid communication with the first mixing channel at a second confluence along the longitudinal axis, d) a third inlet channel, for a second fluid, in transverse fluid communication with the first mixing channel at a third confluence along the longitudinal axis, and e) a fourth inlet channel, for the second fluid, in transverse fluid communication with the first mixing channel at a fourth confluence along the longitudinal axis, wherein i) the first confluence, the second confluence, the third confluence, and the fourth confluence are not opposite each other, and ii) the first confluence and the second confluence alternate with the third confluence and with the fourth confluence, f) a merge channel having an inlet and outlet, g) a first splitting channel having an inlet and an outlet, wherein the first splitting channel inlet is in transverse fluid communication with the first mixing channel outlet, and wherein the first splitting channel outlet is in transverse fluid communication with the merge channel inlet at a fifth confluence, and h) a second splitting channel having an inlet and an outlet, wherein the second splitting channel inlet is in transverse fluid communication with the first mixing channel outlet, and wherein the second splitting channel outlet is in transverse fluid communication with the merge channel at a sixth confluence, and wherein the fifth confluence and the sixth confluence are not opposite each other, b) splitting the flow of a first fluid into the first inlet channel and the second inlet channel, c) splitting the flow of a second fluid into the third inlet channel and the fourth inlet channel, wherein flow from the third inlet channel and flow from the fourth inlet channel intersect different sides of flow of the first fluid in the first mixing channel, thereby producing a first mixed fluid at the mixing channel outlet, d) splitting the flow of the first mixed fluid into the first splitting channel and the second splitting channel, and e) merging the flow of fluid from the first splitting channel outlet and fluid from the second splitting channel outlet into the merge channel to produce a second mixed fluid, wherein degree of mixing (DOM) of the first fluid and the second fluid in the second mixed fluid is higher than in the absence of the splitting the flow of the first fluid in step b) and of the splitting the flow of the second fluid in step c). Without intending to limit the degree of mixing to any particular value or range, in one embodiment, the degree of mixing (DOM) of the first fluid and the second fluid in the third mixed fluid is at least 200% higher than in the absence of the splitting the flow of the first fluid and of the splitting the flow of the second fluid. Also, without intending to limit the pressure drop to any particular value or range, in one embodiment, the pressure drop between 1) any one of the inlet of the first inlet channel, the inlet of the second inlet channel, the inlet of the third inlet channel, and the inlet of the fourth inlet channel, and 2) the merge channel outlet is higher than the pressure drop in the absence of the splitting the flow of the first fluid and of the splitting the flow of the second fluid. In a particular embodiment, the pressure drop is less than 300% higher than the pressure drop in the absence of the splitting the flow of the first fluid and of the splitting the flow of the second fluid. Without intending to limit the shape of the first splitting channel and/or second splitting channel, in one embodiment, each of the first splitting channel and the second splitting channel comprises 2 turns.

Also provided herein is a system comprising any of the devices described herein and a means for controlling fluid flow, such as one or more valve and pump.

BRIEF DESCRIPTION OF THE DRAWINGS

The patent or application file contains at least one drawing executed in color. Copies of this patent or patent application publication with color drawings will be provided by the Office upon request and payment of the necessary fee.

The schematics in the following Figures are not necessarily to scale.

(b) Two-way split flow microchannel having 3 inlet channels and 1 outlet.

Figure 10A:
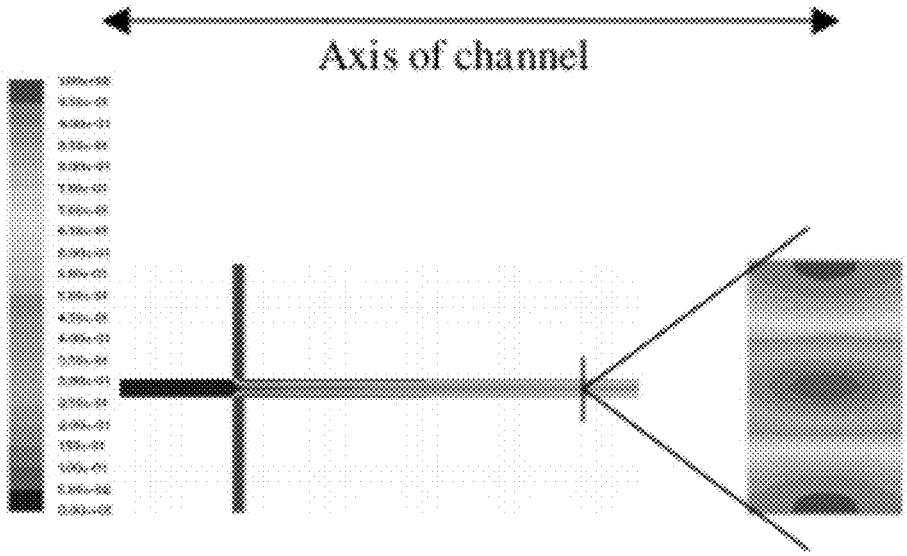
Figure 10B:
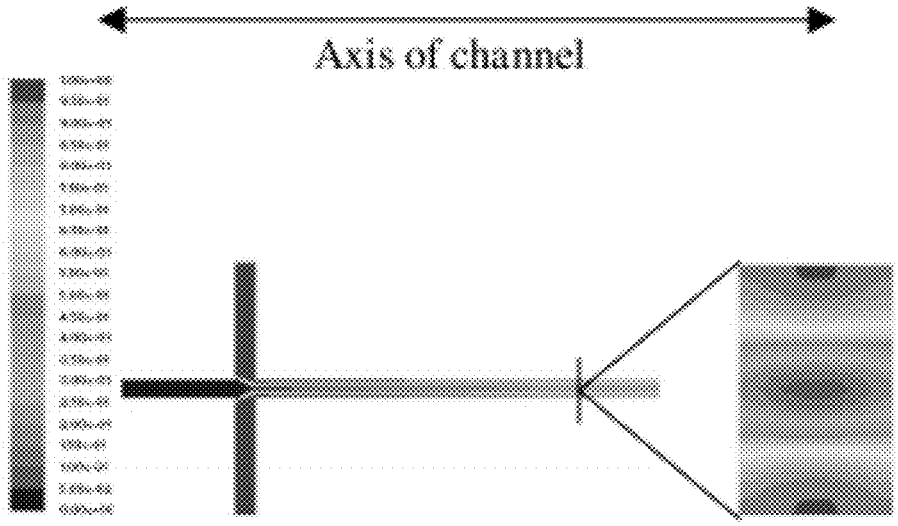

FIG. 10: (a) Mass fraction contours of fluid "B" along the center plane of the two-way split flow microchannel with "split dimension." Also showing magnified view of the cross-section 500 μm behind the outlet where degree of mixing is computed. (b) Mass fraction contours of fluid "B" along the center plane of the two-way split flow microchannel with "split velocity." Also showing magnified view of the cross-section 500 μm behind the outlet where degree of mixing is computed. Fluid "A" is shown in blue and Fluid "B" is shown in red. Green color indicates a uniformly mixed region of fluids A and B.

Figure 11:
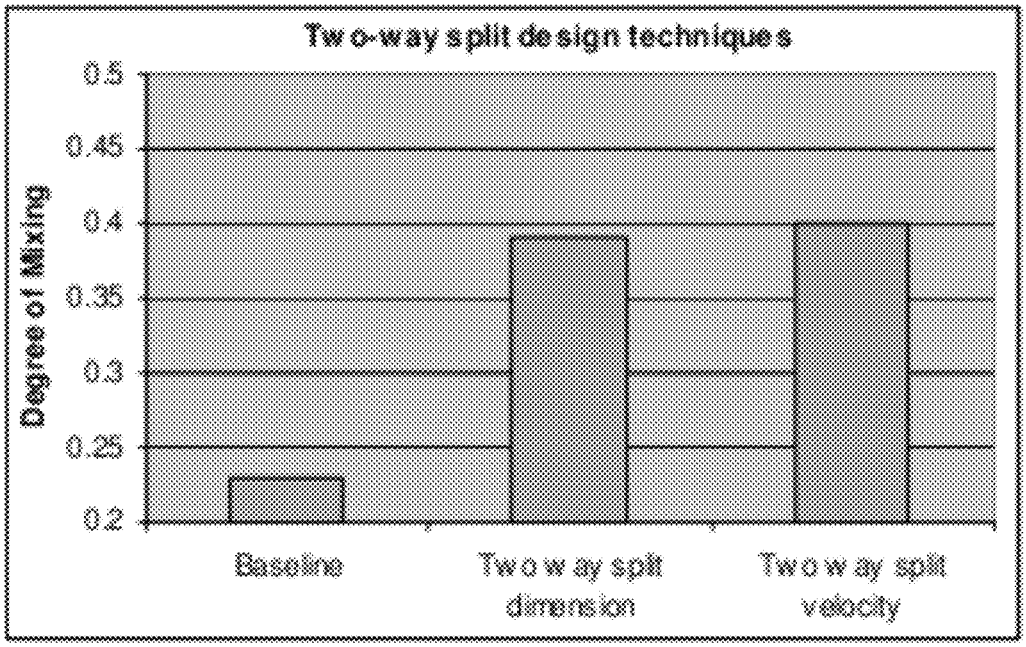

FIG. 11: Comparison of two-way split designs with the baseline case.

Figure 12A:
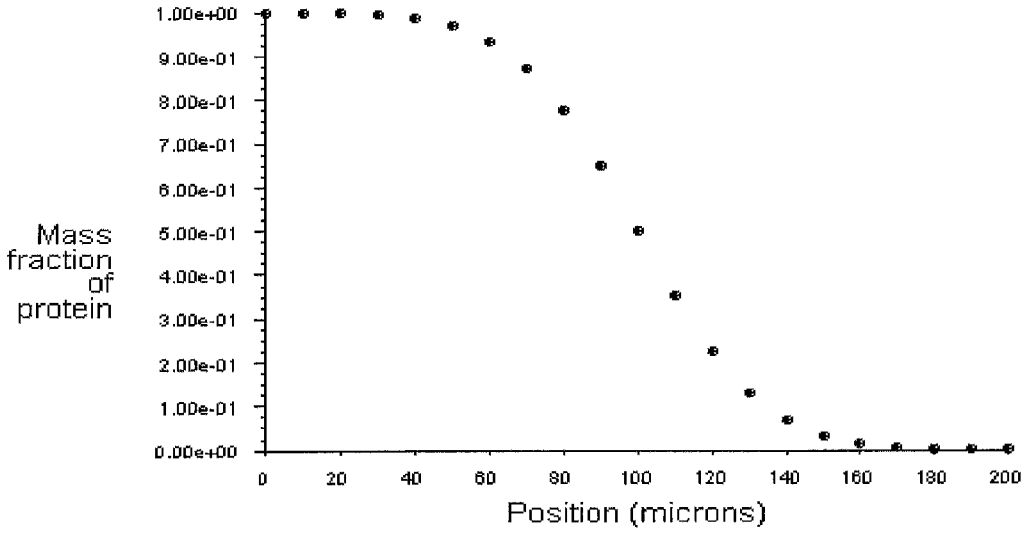
Figure 12B:
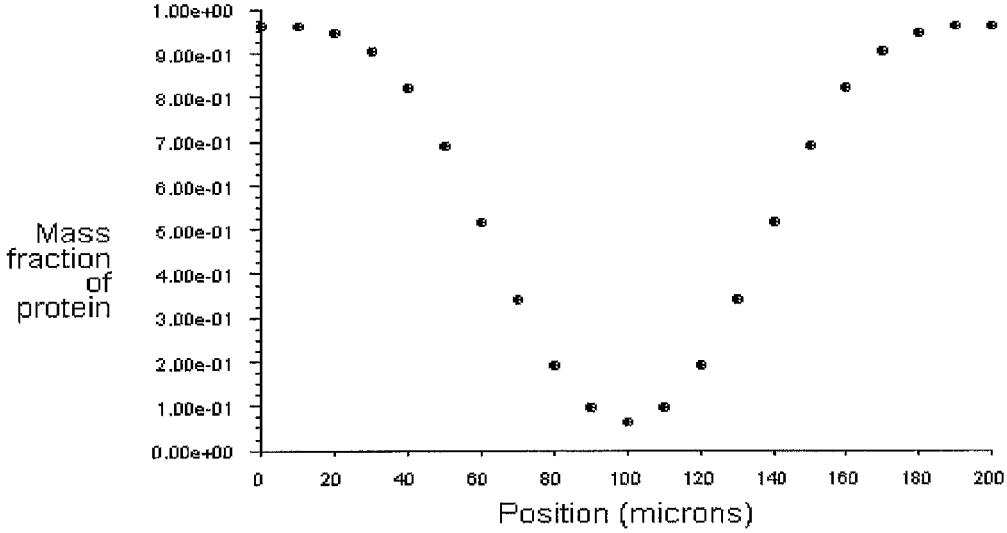

FIG. 12: (a) Mass fraction plot for the baseline case along the channel width (0-200 μm) at the center of the channel (60 μm), plotted at a cross-section 500 μm behind the outlet (center of cross-section. (b) Mass fraction plot for the two-way split flow design (split dimension) along the channel width (0-200 μm) at the center of the channel (60 μm), plotted at 500 μm behind the outlet (center of cross-section shown in FIG. 10*a*).

Figure 13A:
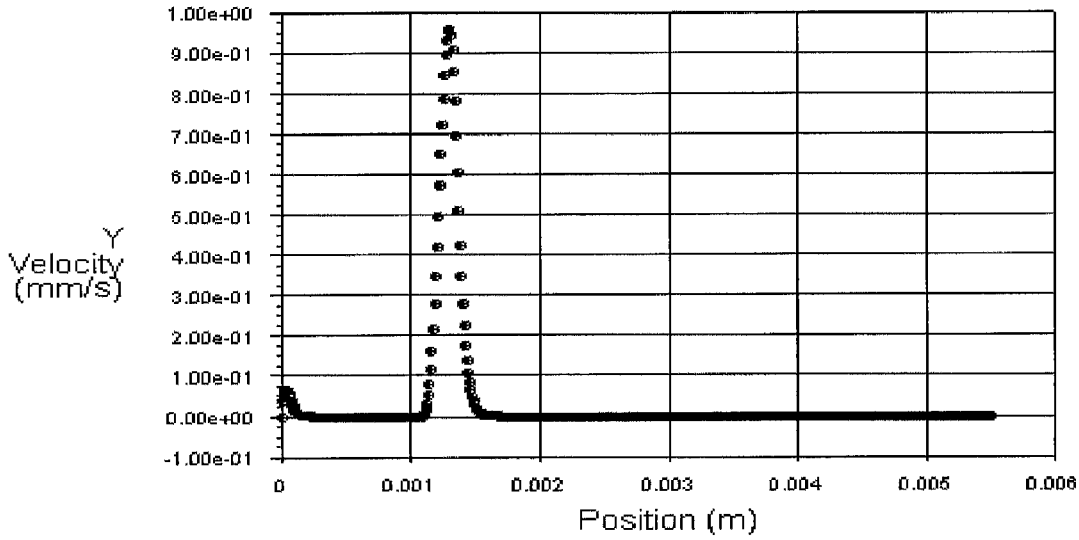
Figure 13B:
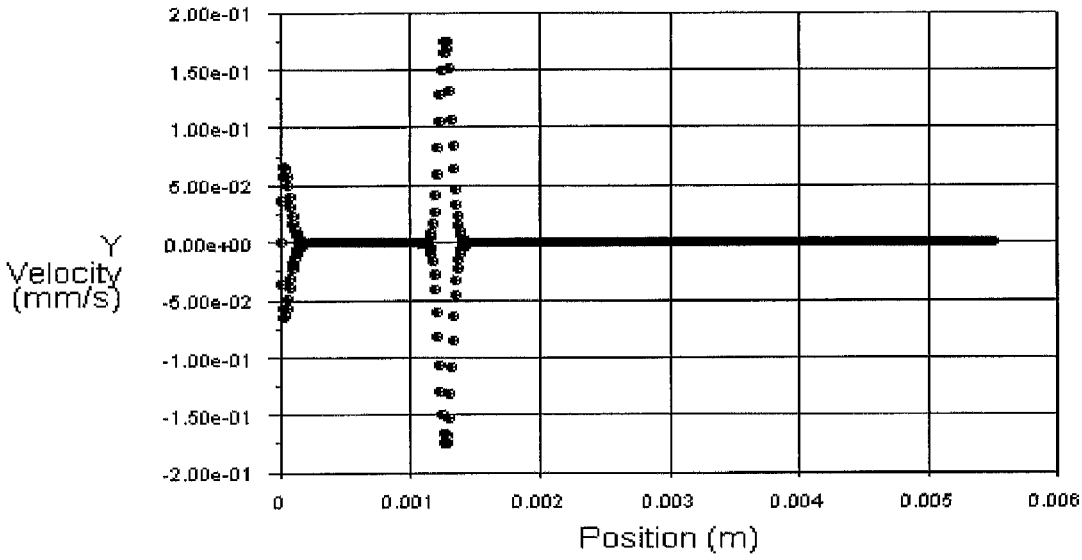

FIG. 13: Plot for transverse velocity near (a) the center line of a "T" microchannel, and (b) the center line (10 μm above & below the center line) for the two-way split flow design with split dimension.

Figure 14:
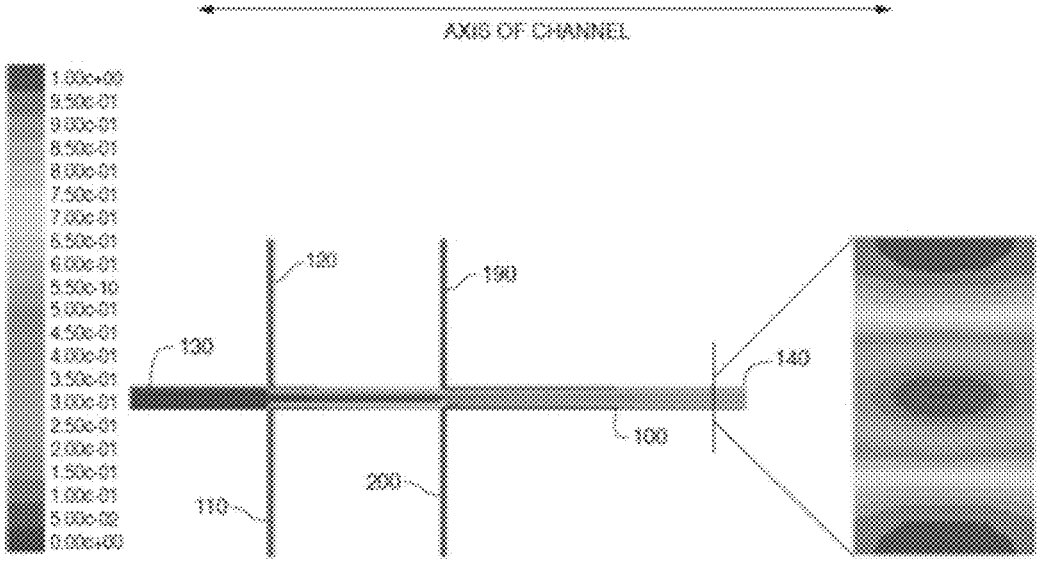

FIG. 14: Mass fraction contours of fluid "B" along the center plane of the four-way split flow microchannel. Also showing magnified view of the cross-section where degree of mixing is computed. Fluid "A" is shown in blue and Fluid "B" is shown in red. Green color indicates a uniformly mixed region of fluids A and B.

Figure 15:
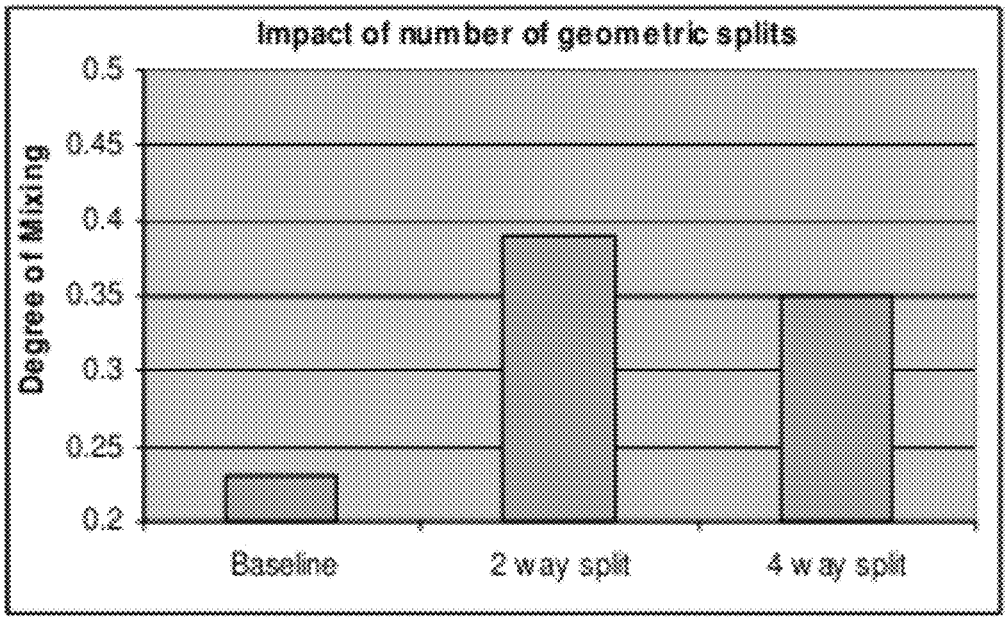

FIG. 15: Comparison of two-way split and four-way split flow designs with the baseline case.

Figure 16:
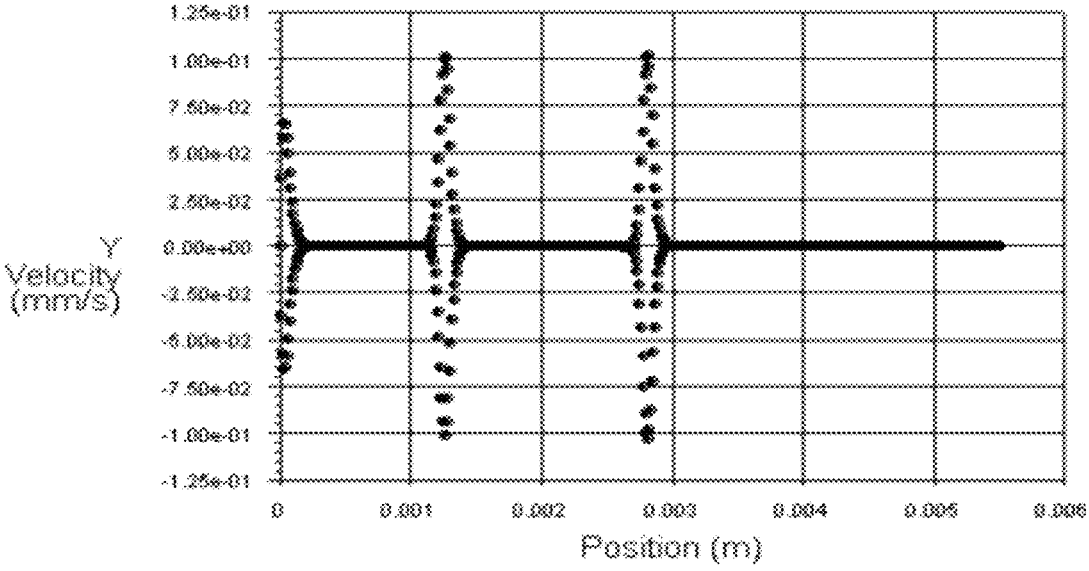

FIG. 16: Plot for transverse velocity near the center line (10 μm above & below the center line) for the four-way split flow design with split dimension.

Figure 17A:
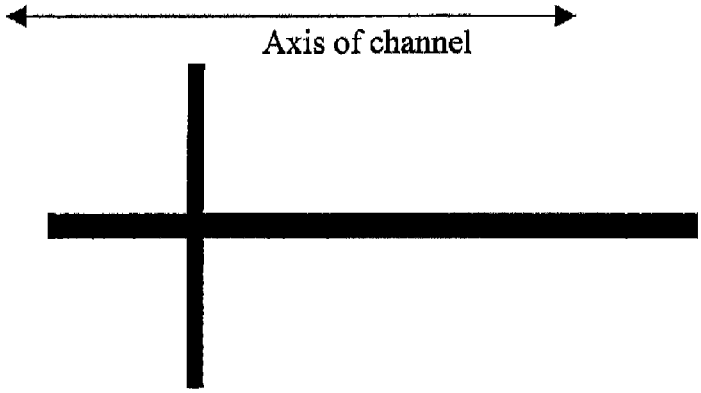
Figure 17B:
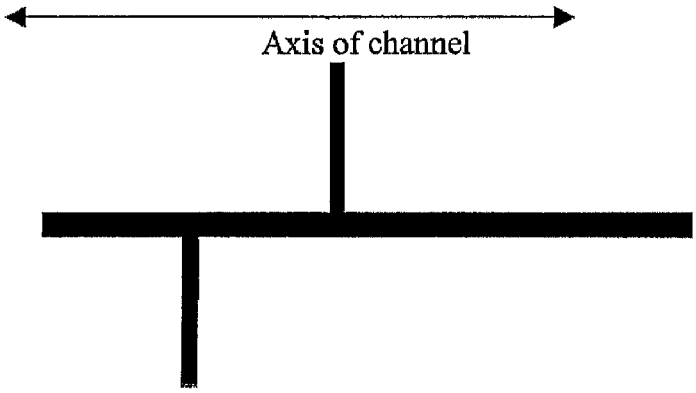
Figure 17C:
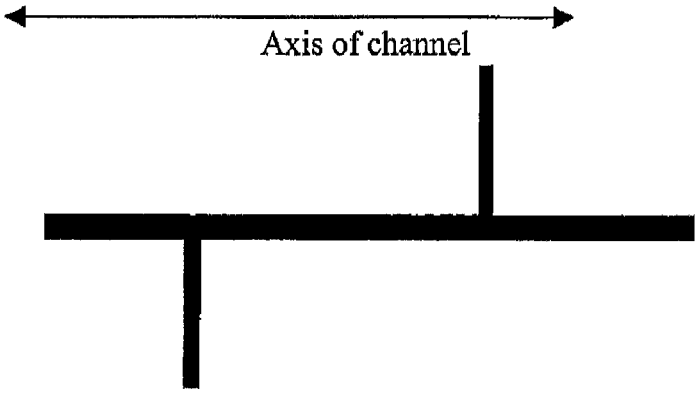

FIG. 17: (a) Two-way split flow design with opposing splitting inlet channels. (b) Two-way split flow design with 1250 μm distance between the splitting inlet channels. (c) Two-way split flow design with 2500 μm distance between the splitting inlet channels.

Figure 18:
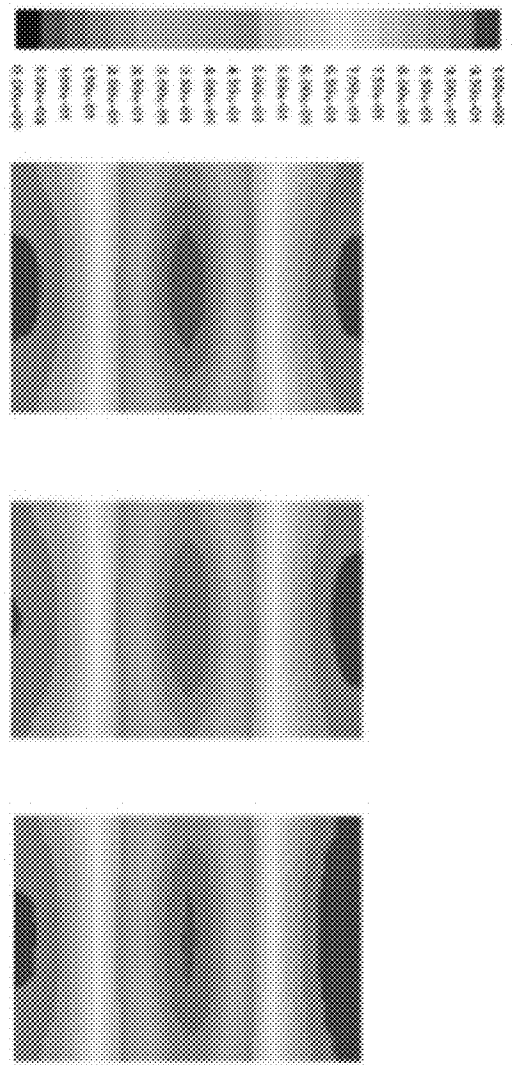

FIG. 18: Mass fraction contours at a plane near outlet for (a) opposing inlet channels, (b) 1250 μm between splitting inlet channels, and (c) 2500 μm between splitting inlet channels. Fluid "A" is shown in blue and Fluid "B" is shown in red. Green color indicates a uniformly mixed region of fluids A and B.

Figure 19:
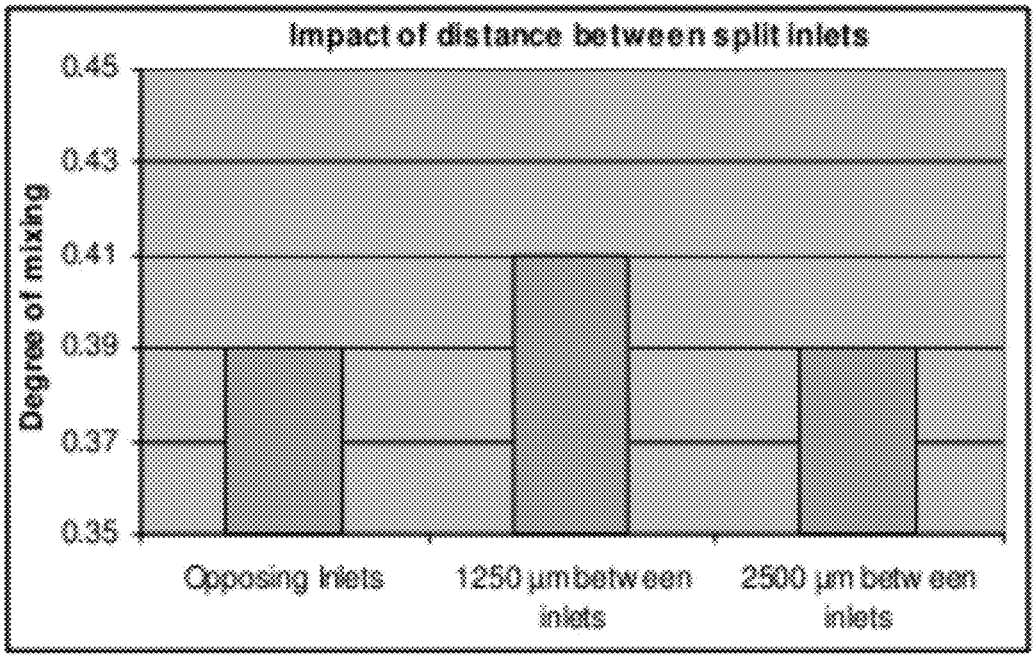

FIG. 19: Comparison between the three designs to study the impact of distance between splitting inlet channels on degree of mixing.

Figure 20A:
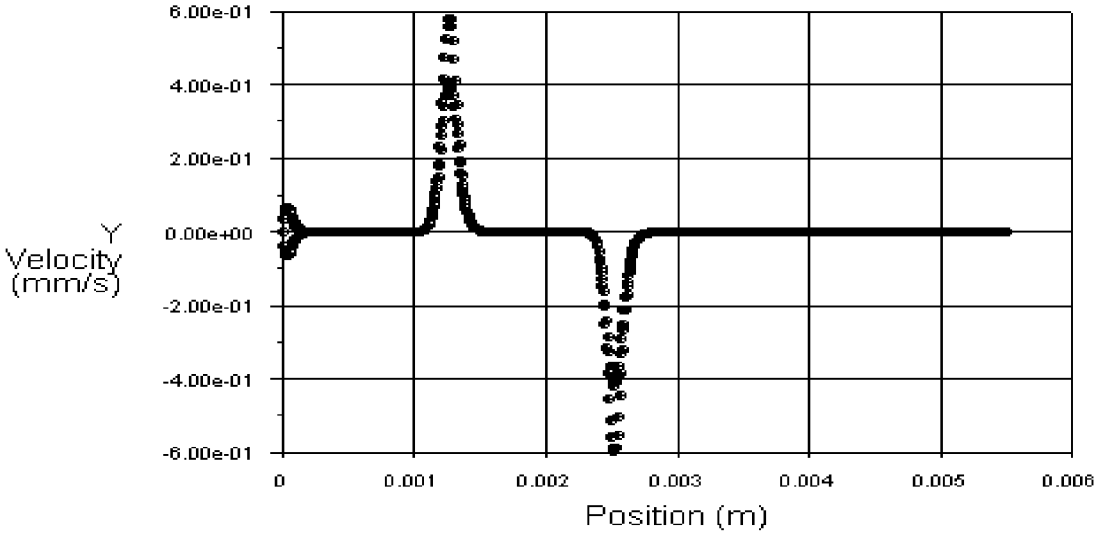
Figure 20B:
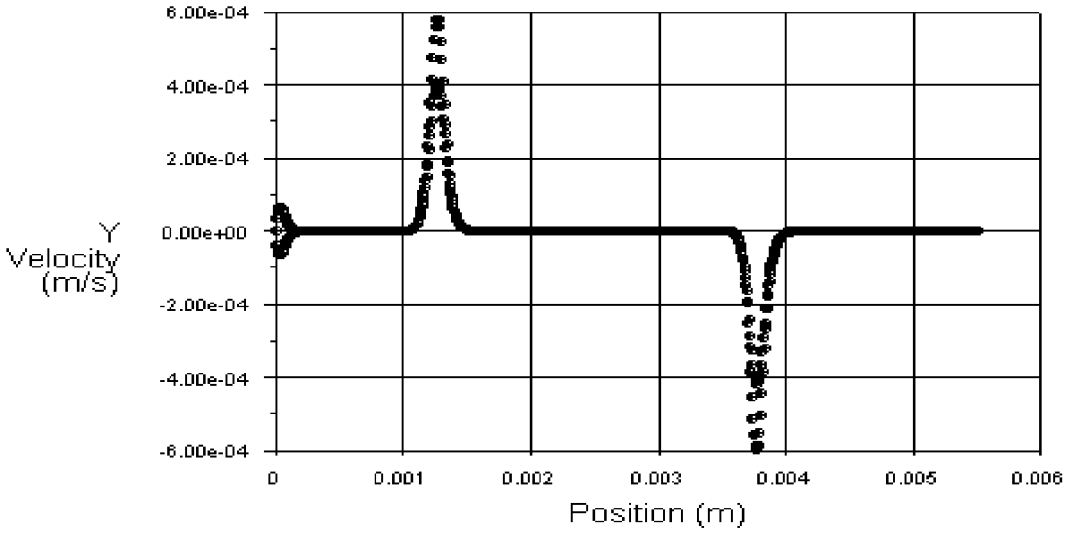

FIG. 20(*a*) Plot for transverse velocity near the center line (10 μm above & below the center line) for the two-way split flow design with 1250 μm between the splitting inlet channels. (b) Plot for transverse velocity near the center line (10 μm above & below the center line) for the two-way split flow design with 1250 μm between the splitting inlet channels.

Figure 21:
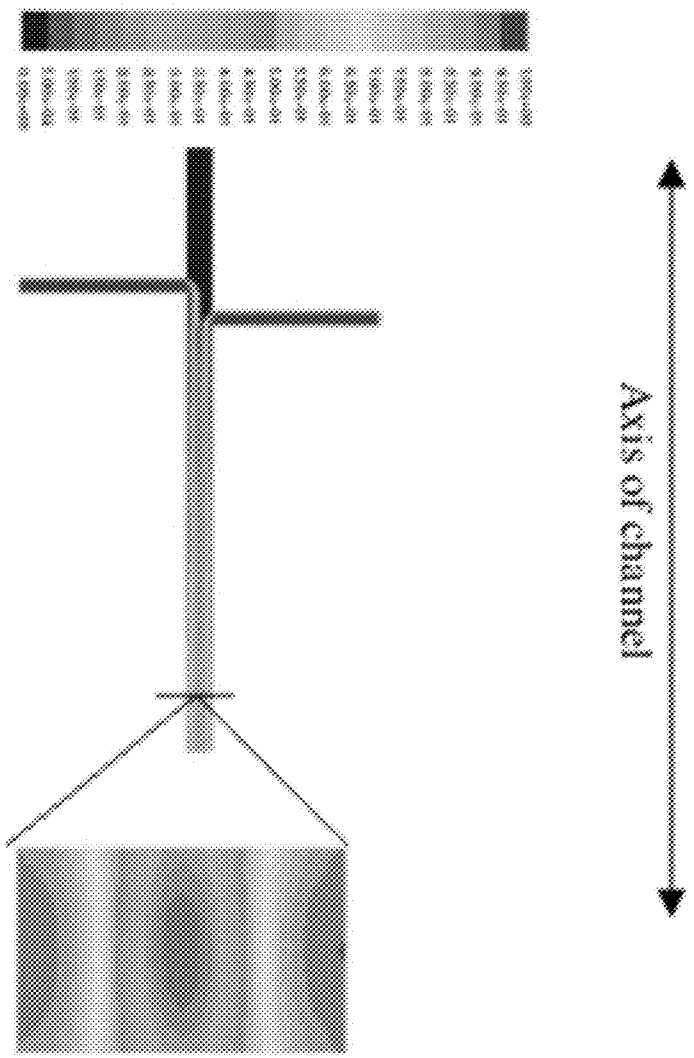

FIG. 21: Mass fraction contours of fluid "B" along the center plane of the two-way split flow design with 300 μm distance between splitting inlet channels. Also showing magnified view of the cross-section where degree of mixing is computed. Fluid "A" is shown in blue and Fluid "B" is shown in red. Green color indicates a uniformly mixed region of fluids A and B.

Figure 22:
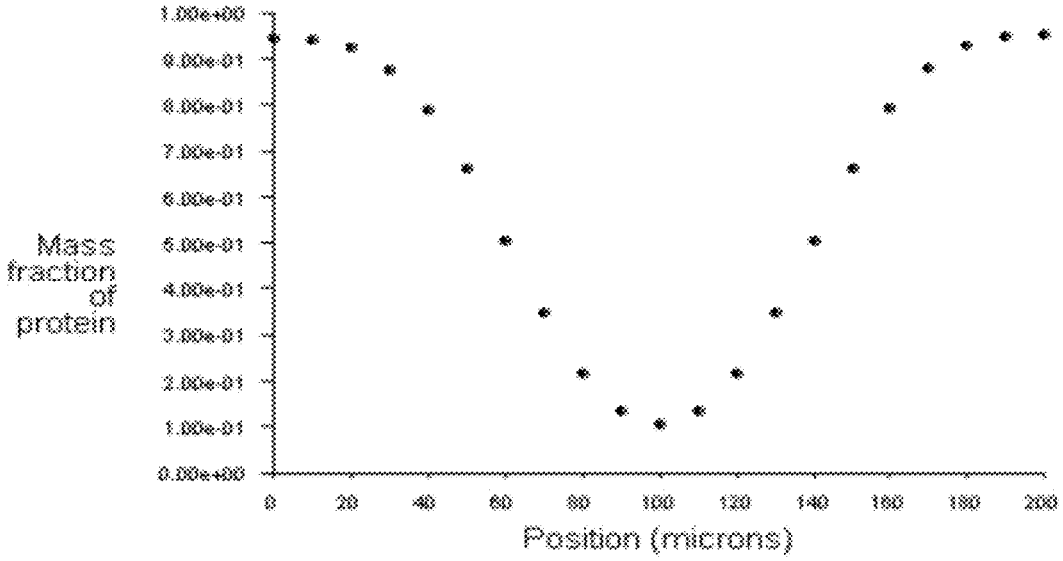

FIG. 22: Mass fraction plot for the two-way split flow with 300 μm distance between splitting inlet channels design, along the channel width (0-200 μm) at the center of the channel (60 μm), plotted at 500 μm behind the outlet (center of cross-section shown in FIG. 21).

Figure 23:
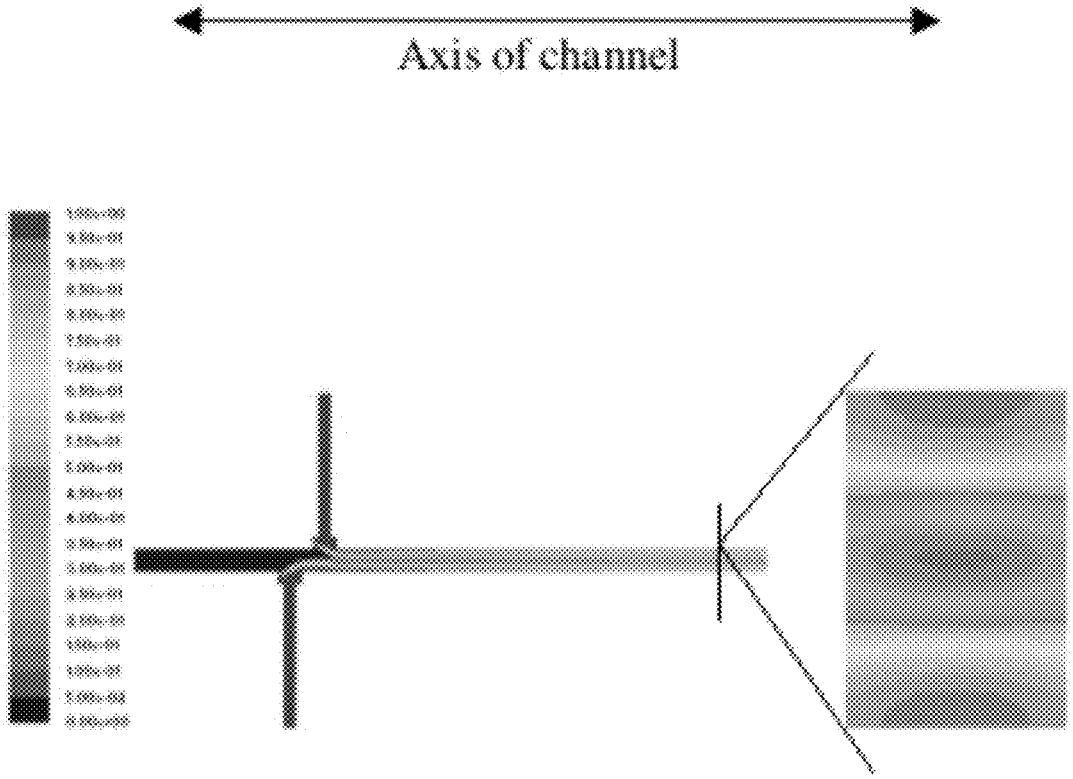

FIG. 23: Mass fraction contours of fluid "B" along the center plane of the two-way split flow design with 300 μm distance between splitting inlet channels and 100 μm deep well shaped cavities at the splitting inlet channels. Also showing magnified view of the cross-section where degree of mixing is computed. Fluid "A" is shown in blue and Fluid "B" is shown in red. Green color indicates a uniformly mixed region of fluids A and B.

Figure 24:
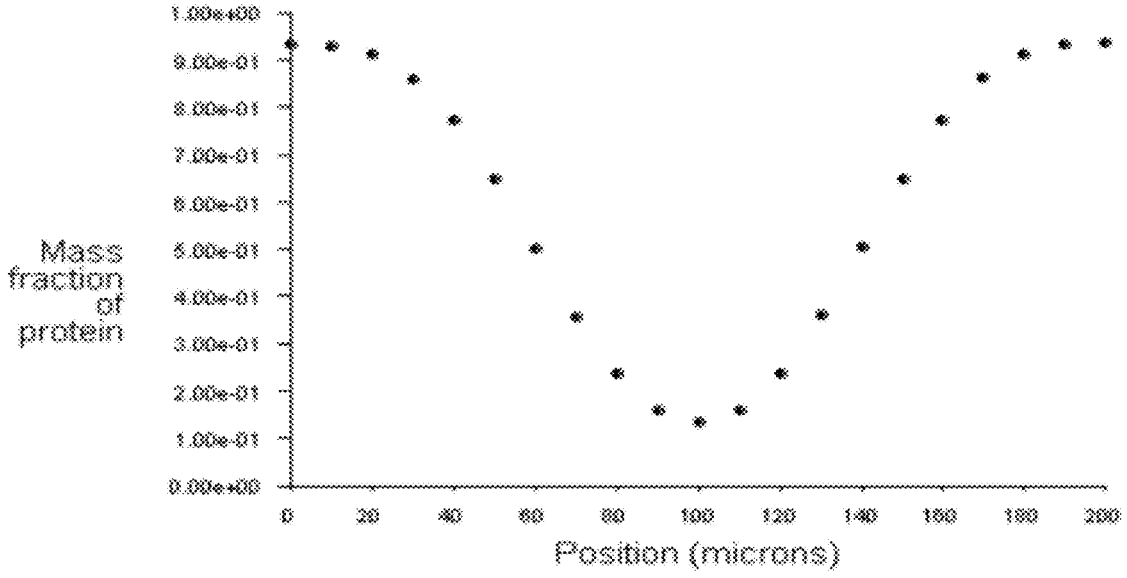

FIG. 24: Mass fraction plot for the two-way split flow with 300 μm distance between splitting inlet channels design, along the channel width (0-200 μm) at the center of the channel (60 μm), plotted at 500 μm behind the outlet (center of cross-section shown in FIG. 23).

Figure 25:
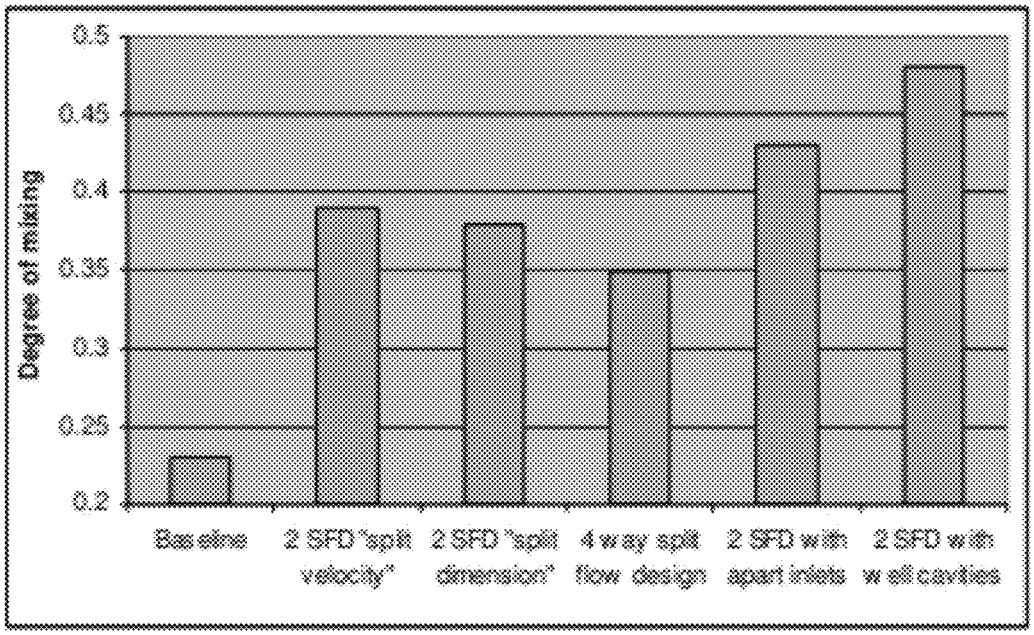

FIG. 25: Comparison in degree of mixing for various designs considered herein.

Figure 26:
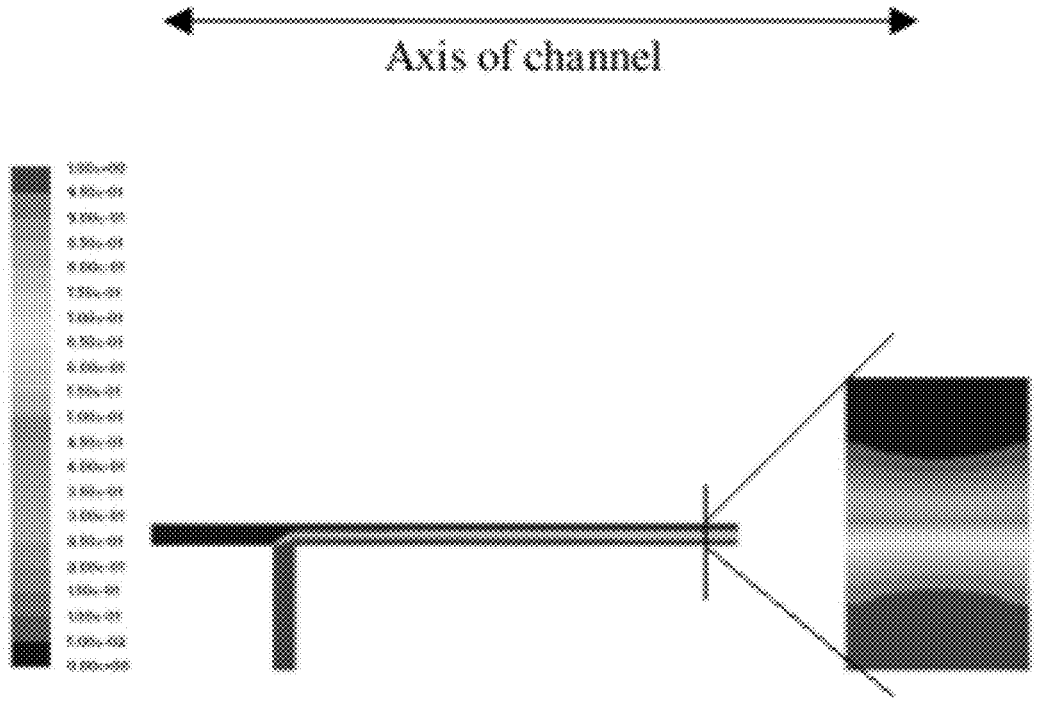

FIG. 26: Mass fraction contours in a "⊤" shaped microchannel. Fluid "A" is shown in blue and Fluid "B" is shown in red. Green color indicates a uniformly mixed region of fluids A and B.

Figure 27:
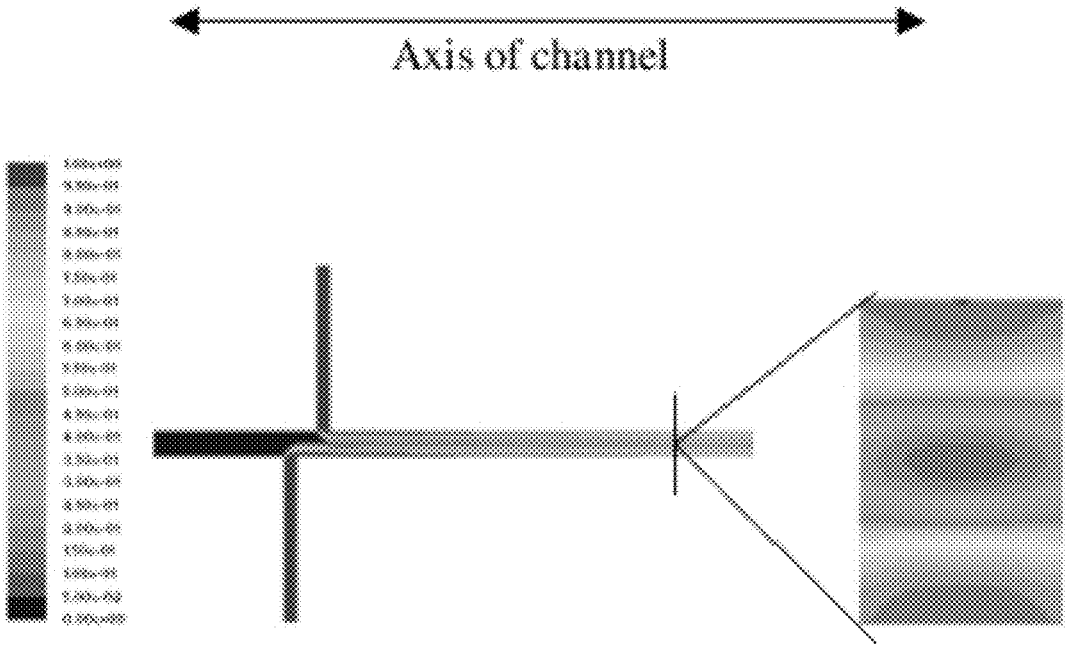

FIG. 27: Two-way split flow design applied to "⊤" shaped microchannel. Fluid "A" is shown in blue and Fluid "B" is shown in red. Green color indicates a uniformly mixed region of fluids A and B.

FIG. 28: Mass fraction contours for (a) ⊢ microchannel, and (b) two-way split flow design applied to ⊢ microchannel. Fluid "A" is shown in blue and Fluid "B" is shown in red. Green color indicates a uniformly mixed region of fluids A and B. In one embodiment, the degree of mixing was 0.18 (i.e., 18%) with a pressure drop of 32 Pascal (FIG. 28(*a*), Design A) and was 0.61 (i.e., 61%) with a pressure drop of 33 Pascal (FIG. 28(*b*), Design B).

Figures 29A, 29B:
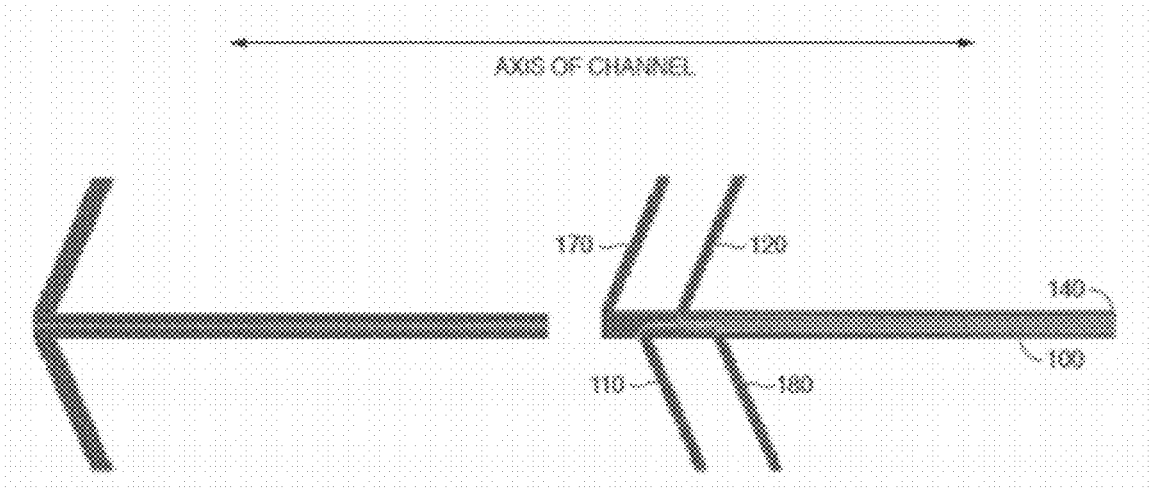

FIG. 29: Mass fraction contours for (a) ← microchannel, and (b) two-way split flow design applied to ← microchannel. Fluid "A" is shown in blue and Fluid "B" is shown in red. Green color indicates a uniformly mixed region of fluids A and B.

Figures 30A, 30B:
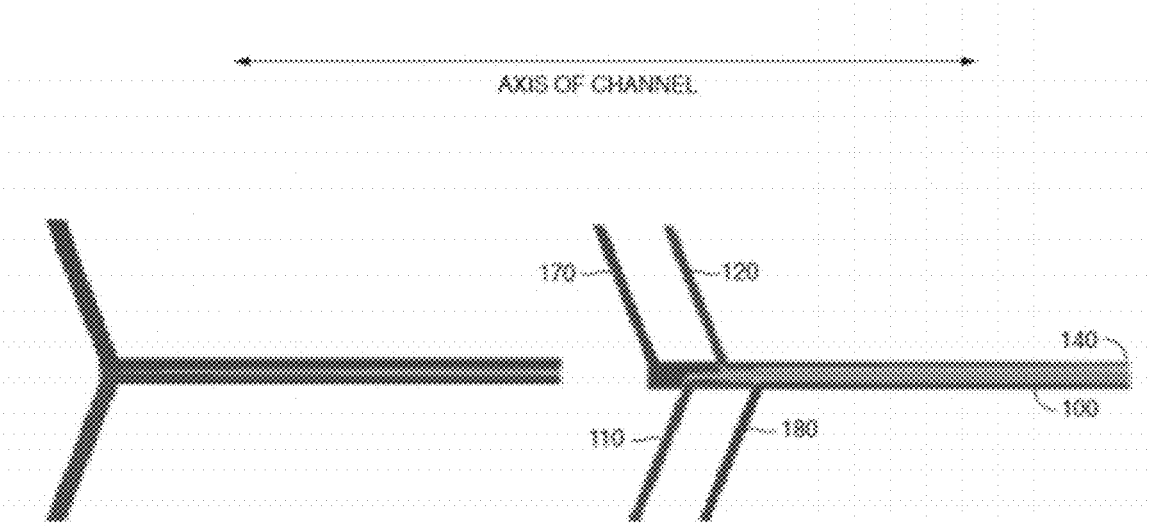

FIG. 30: Mass fraction contours for (a) Y microchannel, and (b) two-way split flow design applied to Y microchannel. Fluid "A" is shown in blue and Fluid "B" is shown in red. Green color indicates a uniformly mixed region of fluids A and B.

Figure 31:
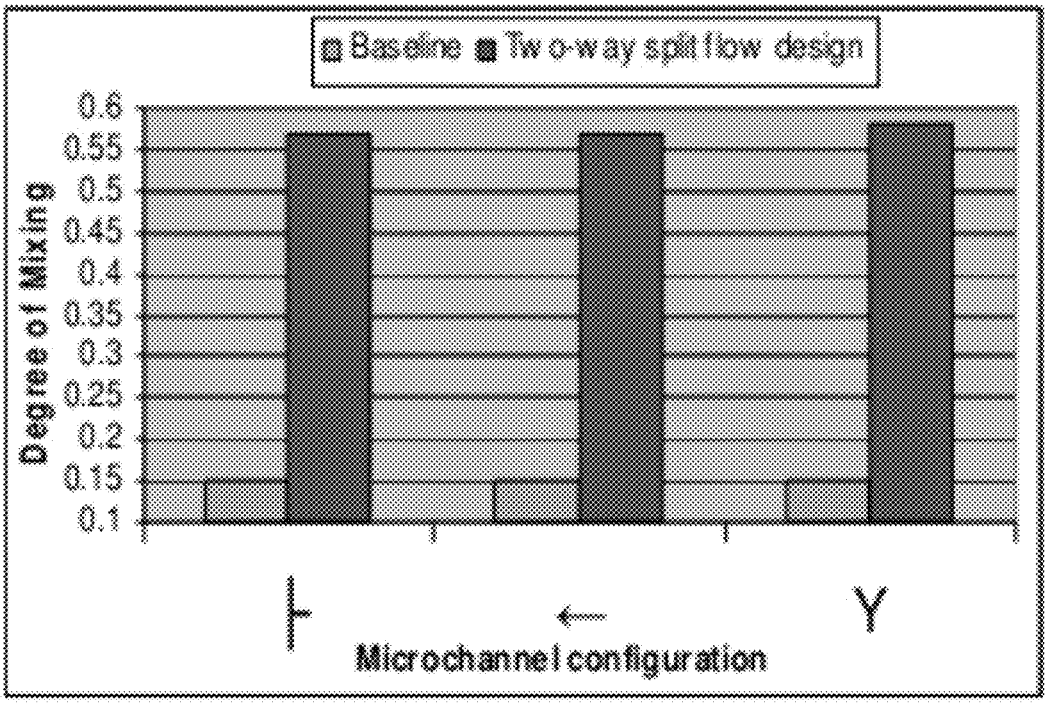

FIG. 31: Comparison of "⊢", "←" and "Y" designs with their corresponding split flow design modifications.

Figure 32:
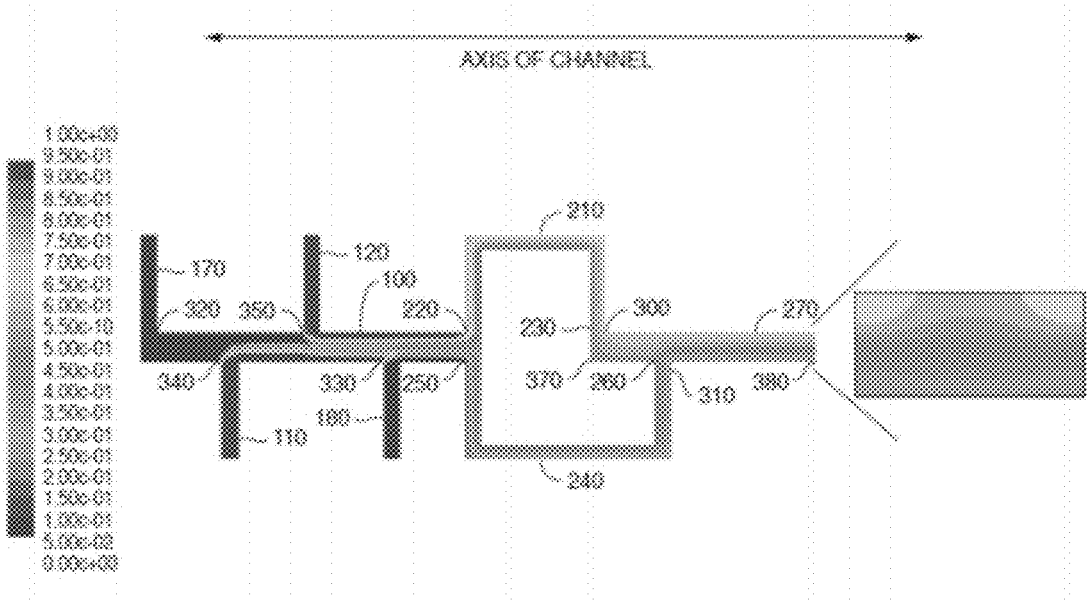

FIG. 32: Design C, mass fraction contours along the center plane and outlet of a SAM mixer. The degree of mixing was 0.78 (i.e., 78%) mixed with a pressure drop of 39.5 Pascal.

Figure 33:
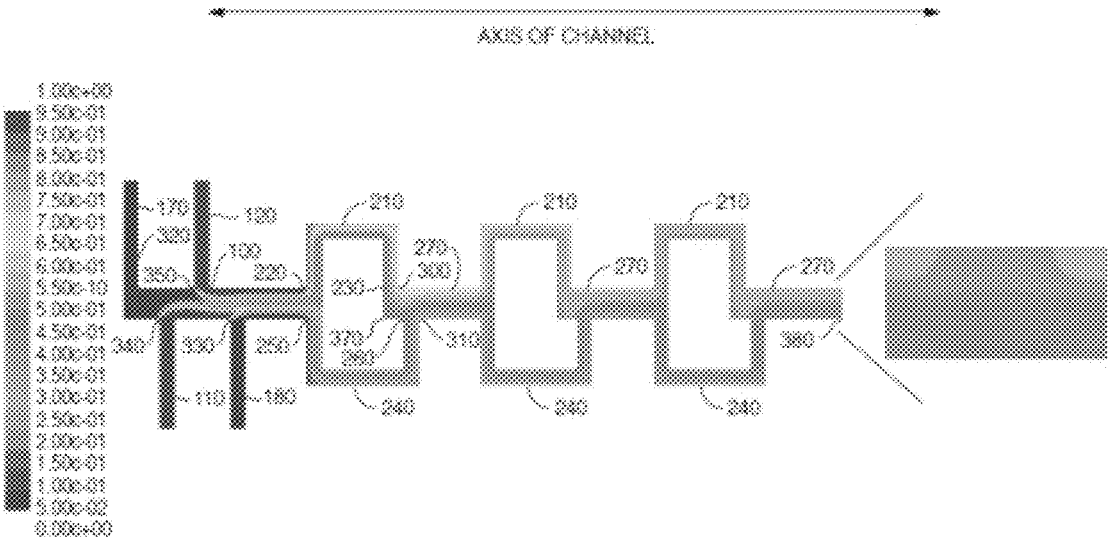

FIG. 33: Design D, mass fraction contours along the center plane and outlet of a multistage SAM mixer. The degree of mixing was 0.86 (i.e., 86%) mixed with a pressure drop of 47.7 Pascal.

Figure 34:
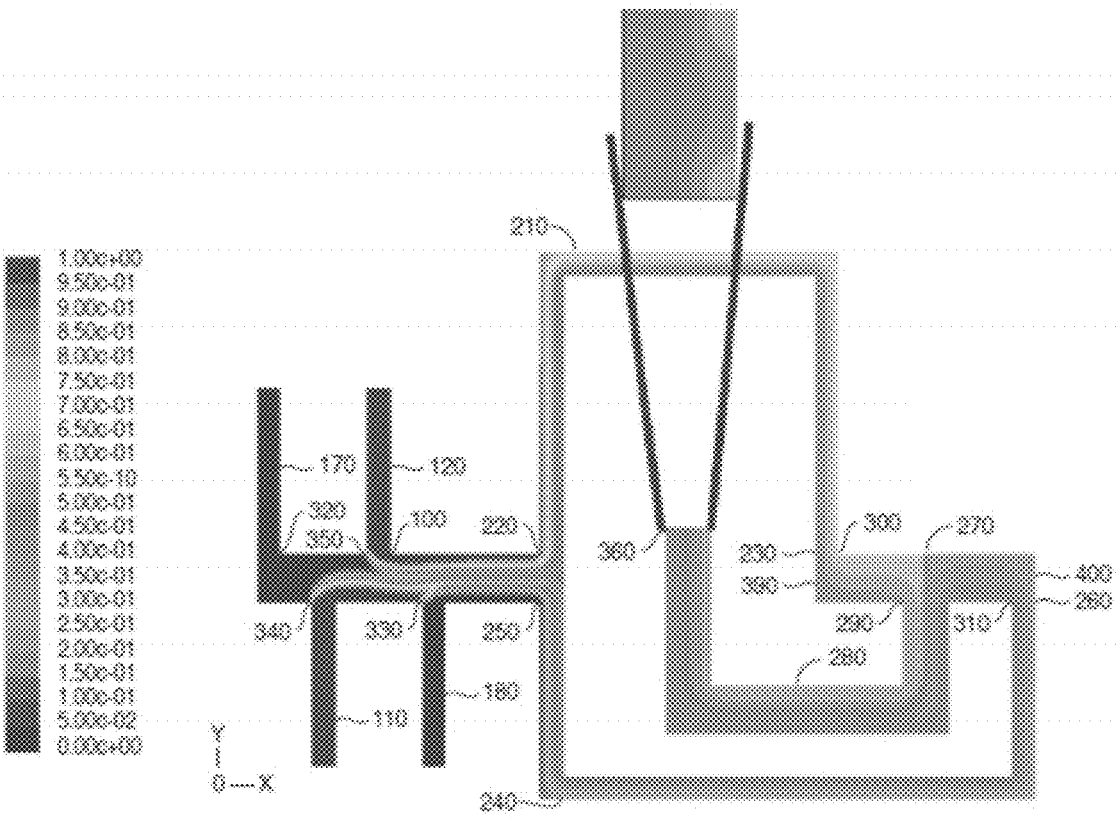

FIG. 34: Design E, mass fraction contours at the center plane and outlet of a SAM mixer with opposing streams. The degree of mixing was 0.89 (i.e., 89%) mixed with a pressure drop of 44.4 Pascal.

Figure 35:
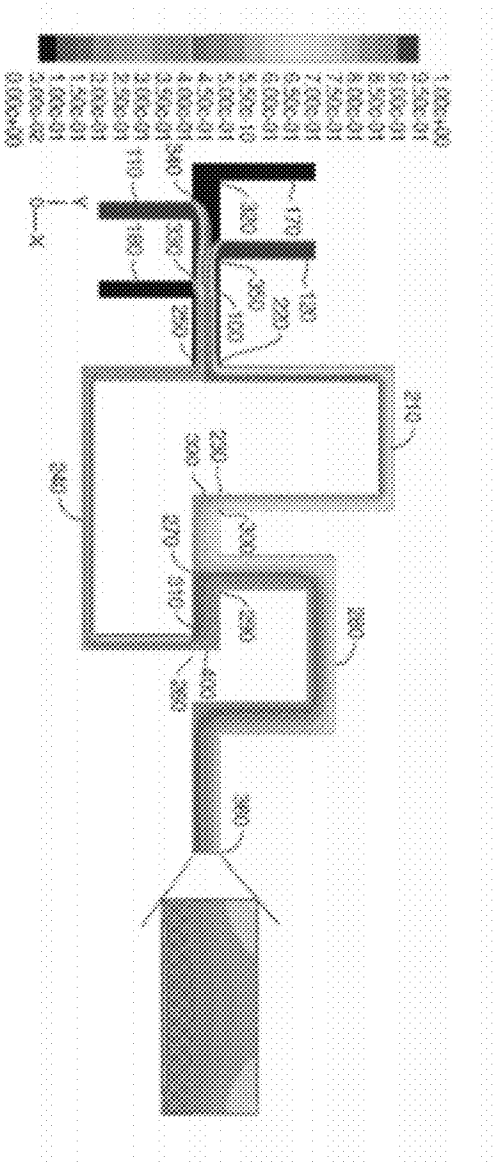

FIG. 35: Design F mass fraction contours at the center plane and outlet of a SAM mixer with opposing streams. The degree of mixing was 0.89 (i.e., 89%) mixed with a pressure drop of 43.6 Pascal.

Figure 36:
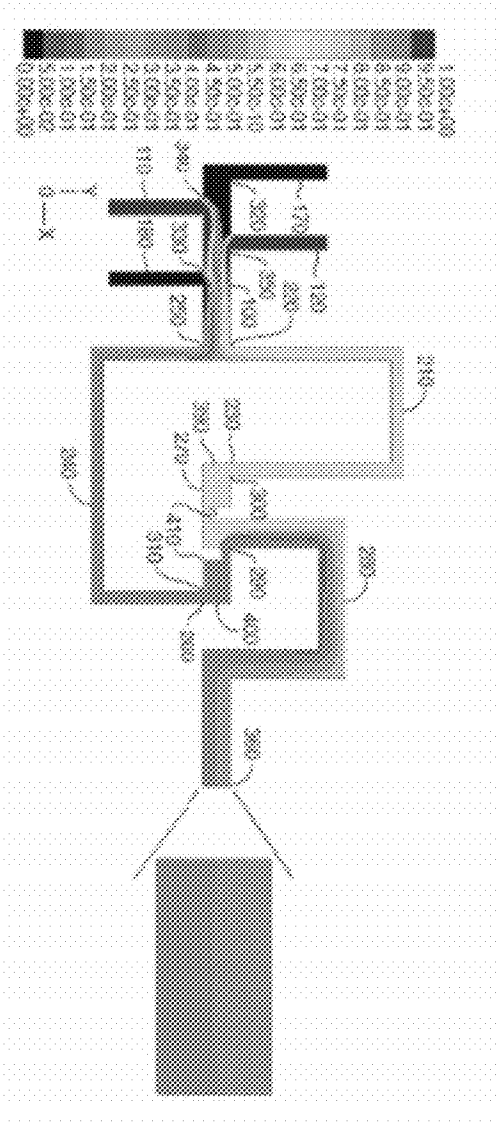

FIG. 36: Design G mass fraction contours at the center plane and outlet of a SAM mixer with opposing streams (with Grooves). The degree of mixing was 0.92 (i.e., 92%) mixed with a pressure drop of 47 Pascal.

DEFINITIONS

To facilitate understanding of the invention, a number of terms are defined below.

The term "channel" refers to a cavity, opening or conduit that is capable of containing a fluid. Channels include microchannels and macrochannels. A "microchannel" refers to a channel having at least one cross sectional dimension (such as width, depth, height, diameter, etc.) that is less than or equal to 10 millimeter (mm). For example, the width and/or depth of a microchannel may be from 10 μm to 5 mm, including from 50 μm to 5 mm, further including from 100 μm to 5 mm, and additionally including from 200 μm to 5 mm. The length of the microchannel may be any desirable length so long as it is capable of containing and/or delivering the fluid in the manner intended. Thus, in one embodiment, the length of the microchannel may be from 50 μm to 10 mm, including from 100 μm to 5 mm, further including from 1000 μm to 5 mm, and additionally including from 2000 μm to 5 mm. A "macrochannel" refers to a channel having at least one cross sectional dimension (such as width, depth, height, diameter, etc.) that is greater than 10 mm, including from 10 mm to 10 cm, from 10 mm to 5 cm, and from 10 mm to 1 cm. A channel may be an inlet channel, outlet channel, mixing channel, and/or splitting channel. An "inlet channel" is a channel by which a fluid flow enters into another structure. An "outlet channel" is a channel by which a fluid flow exits from another structure. A "mixing channel" and "merge channel" are interchangeably used to refer to a channel containing two or more fluids. "Splitting channel" and "split channel" interchangeably refer to a channel for dividing a stream of fluid. A "splitting channel" characteristically has, in some embodiments, the feature of having one or more internal cross-section dimensions (e.g., width, depth, diameter, etc.) that is smaller than the corresponding dimension in an inlet channel to which it is in fluid communication. For example, in one embodiment, each of the first and second splitting channels has a width of 75 μm and depth 300 μm, while the merge channel has a width of 150 μm and depth of 300 μm (Examples 10-14).

An "inlet channel" is a cavity, opening or conduit that is capable of allowing passage of fluid to another cavity (e.g., of a channel) that is in fluid communication therewith.

An "outlet" is a cavity, opening or conduit, which is capable of allowing passage of fluid from another cavity (e.g., channel) that is in fluid communication therewith.

A "well" is a cavity, opening or conduit having at least one cross sectional dimension (such as width, depth, height, diameter, etc.) that is different (i.e., larger or smaller) from the dimension of another structure (e.g., channel, inlet channel, outlet channel, etc.) to which the well is in direct fluid communication. For example, wells disclosed herein having 200 μm width and 100 μm depth were in direct fluid communication with inlet channels having 200 μm width and 60 μm depth, or a 100 μm width and 120 μm depth. While the present invention, in one embodiment, contemplates a well, other types of indentations are contemplated. It is not intended that the present invention be limited by the nature of the indentations. The term "indentation" refers to a space, cavity, dent, crater, well, depression, hollow, recess or impression that is formed in the surface of a structure. In a preferred embodiment, indentations do not extend through the entire thickness of a surface.

The terms "axis" and "axial dimension" when in reference to a 3-dimensional structure (e.g., channel, inlet channel, outlet channel, well, etc.) that has a width dimension, height dimension and length dimension, refers to a line parallel to one of the dimensions of the structure. In one embodiment, the axis of a channel refers to the dimension along which fluid flows through the channel, as exemplified by, but not limited to, the longitudinal dimension of the channel.

The term "flow" refers to the motion of a fluid. Where a fluid flows through a channel, it generally flows along the longitudinal axis of the channel. Flow of a first fluid in a first channel (e.g., a mixing channel) may be intersected at different sides by flow of a second fluid from a second channel (e.g., a first splitting channel) and by flow of a third fluid from a third channel (e.g., a second splitting channel). The phrase "different sides" when made in reference to such an intersection means that (a) the plane formed by flow in the first and second channels is not co-extensive with the plane formed by flow in the first and third channels, and (b) the direction of flow in the second and third channels is different (including opposite direction).

The term "opposite sides" when in reference to a first and second structures (e.g., two inlet channels) in relation to a third structure (e.g., channel) means that the first, second, and third structures are in a single plane, and that the longitudinal dimension of the first structure is co-extensive with the longitudinal dimension of the second structure to form one line that intersects with the longitudinal axis of the third structure. This is exemplified by the two splitting inlet channels in FIGS. 3*a*, 6*a*, 7*a*, 9*b*, 10*a*, 10*b*, 14 and 17*a-c*, 21, 27, 28*b*, 29*b* and 30*b*, in relation to the channel.

The term "opposite each other" when in reference to two structures (e.g., inlet channels) means that the longitudinal dimension of the first structure is co-extensive with the longitudinal dimension of the second structure to form one line. This is exemplified by the two splitting inlet channels in FIGS. 9*b*, 10*a*, 10*b*, 14 and 17*a*, in which the longitudinal dimension of the first splitting inlet channel is co-extensive with the longitudinal dimension of the second splitting inlet channel to form one co-extensive line intersecting with the channel longitudinal axis.

The term "not opposite each other" when in reference to two structures (e.g., inlet channels) means that the longitudinal dimension (i.e., longitudinal axis) of the first structure is not co-extensive with the longitudinal dimension of the second structure, thus forming two separate lines. For example, where two inlet channels intersect with a mixing channel, the two inlet channels are not opposite each other if their longitudinal axes are not coextensive. This includes a configuration where the both the inlet channels are next to each other on the same side of the mixing channel (e.g., inlet channel A1 170 and inlet channel B2 120 of FIG. 28(*b*). This also includes a configuration where the two inlet channels are not on the same side of the mixing channel (e.g., inlet channel A1 170 and inlet channel A2 180 of FIG. 28(*b*). Additional examples are the two splitting inlet channels in FIGS. 3*a*, 6*a*, 7*a*, 17*b*, 17*c*, 21, 27, 28*b*, 29*b* and 30*b*, in which the longitudinal dimensions of the two splitting inlet channels form two lines that are not co-extensive, and thus intersect at different locations along the channel longitudinal axis.

In some embodiments, the present invention contemplates devices (as described herein) as compositions of matter (without fluid). In other embodiments, the present invention contemplates methods and systems wherein the devices (as described herein) contain fluid.

The term "fluid" includes liquid and gas at any temperature or pressure. Fluids may be aqueous, non-aqueous, organic, inorganic, contain reactants, have high mixing rates or low mixing rates (e.g., U.S. Pat. No. 7,374,332), and may also contain material that is synthetic (e.g., drugs) or obtained from biological or environmental sources. "Biological sources" of fluids include body fluids such as urine, blood, plasma, cerebrospinal fluid (CSF), semen, sputum, and saliva, as well as fluids containing cells, cell extracts, nucleic acids (e.g., DNA and RNA) and the like. "Environmental sources" of fluids include fluids containing material from the environment such as surface matter, soil, water, and industrial materials. In one embodiment, at least two fluids are mixed using the invention's devices and methods. The fluids to be mixed may be the same or different, preferably different in at least one respect.

The term "in fluid communication" when in reference to structures means that the structures are connected so that a fluid flowing in one structure flows directly or indirectly to the other structure.

The term "pressure drop" refers to a reduction in pressure. In some embodiments, pressure drop is measured from the inlet to the outlet of the design.

"Degree of mixing" (DOM) of a first fluid with a second fluid refer to the quantity of mixing of the two fluids, and may be determined using methods known in the art (e.g., Glasgow et al., Proceedings of IMECE (2003)) and methods disclosed herein in equation (4). Mixing of two or more fluids includes, but is not limited to, producing a homogenous fluid (U.S. Pat. No. 7,314,567).

"Constant flow" means introducing a fluid at an essentially unchanged flow rate, as exemplified in Example 3. "Pulsed flow" means introducing a fluid at a variable flow rate, and may be accomplished using known methods (Glasgow et al (2004); Goullet et al. (2006); and U.S. Pat. No. 7,179,423) as well as methods disclosed herein (Example 4). In one embodiment, the pulse is sinusoidal. For example, in one embodiment (Example 4), superimposing a sinusoidal pulse over a constant flow increased the degree of mixing in a two-way split flow by approximately 20%.

"Laminar flow" of two fluids means that the two fluids flow in parallel layers, with a side-by-side narrow-interface, or broad-interface, stream flow without mixing of the two fluids. Recirculation and turbulence are negligible. In general, laminar flow is achieved in a device comprising microchannels of a size such that the Reynolds number for flow within the microchannel is below about 1000, The Reynolds number is the ratio of inertial forces to viscous forces.

"Turbulent flow" is flow characterized by chaotic and/or stochastic property changes. This includes low momentum diffusion, high momentum convection, and rapid variation of pressure and velocity in space and time.

"Splitting" the flow of a fluid through an inlet channel that is in fluid communication with an outlet having an outflow rate (Q) means dividing the inflow of the fluid among two or more inlet channels, referred to herein as "split inlet channels" and/or "splitting inlet channels" and/or "split channels"

and/or "splitting channels," such that the outflow rate (Q) remains substantially unchanged. Splitting the inflow includes dimension splitting, and flow splitting. "Dimension splitting" means altering one or more interior dimensions of the two or more inlet channels. "Volume splitting" means altering the flow rate of the fluid through one or more of the "split inlet channels." Inflow may be divided equally or unequally by dimension splitting and/or volume splitting.

The term "pump" refers to a device that transfers and/or compresses fluids.

The term "valve" refers to a device that regulates (including increases and/or decreases) flow of a fluid through a passage.

The term "altering" of a measurement or phenomenon (such as volume, dimension, flow rate, degree of mixing, etc.) refers to an increase and/or decrease of the measurement or phenomenon.

The term "increase," "elevate," "higher," "greater," "larger," and grammatical equivalents when in reference to a measurement or phenomenon (such as volume, dimension, flow rate, degree of mixing, pressure drop, etc.) in a first sample relative to a second sample, means that the quantity of the measurement or phenomenon in the first sample is higher than in the second sample by any amount that is statistically significant using any art-accepted statistical method of analysis. In one embodiment, the quantity of the measurement or phenomenon in the first sample is at least 10% greater than, at least 25% greater than, at least 50% greater than, at least 75% greater than, and/or at least 90% greater than the quantity of the same measurement or phenomenon in a second sample. For example, in some embodiments, the invention contemplates that the degree of mixing of two or more fluids may be increased, in comparison to in the absence of one or more of the invention's embodiments, by at least 10%. This includes for example, an increase, in comparison to in the absence of one or more of the invention's embodiments, in degree of mixing from 10% to 2,000%, including any percentage within that range, such as from 100% to 1,000%, from 200% to 750%, and/or from 300% to 600%. To illustrate, data herein demonstrate that exemplary embodiments of the invention provide an increase, compared to a ⊢ microchannel as shown in FIG. 28(*a*), in degree of mixing of 338% (Example 9, FIGS. 28-31), of 433% (Example 10, FIG. 32), of 477% (Example 11, FIG. 33), of 494% (Examples 12 & 13, FIGS. 34-35), and of 538% (Example 14, FIG. 36) (summarized in Table 1).

The terms "reduce," "decrease," "lower," "smaller," and grammatical equivalents when in reference to a measurement or phenomenon (such as volume, dimension, flow rate, degree of mixing, pressure drop, etc.) in a first sample relative to a second sample, mean that the quantity of measurement or phenomenon in the first sample is lower than in the second sample by any amount that is statistically significant using any art-accepted statistical method of analysis. In one embodiment, the quantity of measurement or phenomenon in the first sample is at least 10% lower than, at least 25% lower than, at least 50% lower than, at least 75% lower than, and/or at least 90% lower than the quantity of the same measurement or phenomenon in a second sample.

The term "substantially the same" when in reference to a measurement or phenomenon (such as volume, dimension, flow rate, degree of mixing, pressure drop, etc.) in a first sample relative to a second sample, means that the difference in quantity of measurement or phenomenon in the first sample compared to the second sample is not statistically significant. In one embodiment, the difference in quantity of measurement or phenomenon between the first and second samples is less than 10%.

The term "confluence" when in reference to two or more channels refers to the location at which the channels are in physical contact. The term "confluence" when in reference to two or more fluid flows refers to the combined fluid and/or combined fluid stream that is formed by conjunction of the two or more fluid streams.

The term "alternate" when in reference to a first confluence (e.g., of splitting channel A1) and the second confluence (e.g., of splitting channel A2) alternate with the third confluence (e.g., of splitting channel B1) and with the fourth confluence (e.g., of splitting channel B2), means that the confluence points of the of the splitting channels with the longitudinal axis of a mixing channel may be in the order of $A_1B_1B_2A_2$ (exemplified by FIGS. 28*b*, 29*b*, 30*b*) and/or $A_1B_1A_2B_2$ along the channel's longitudinal axis.

The term "transverse" when in reference to an orientation of a first object (e.g., an inlet channel) to with respect to a second object (e.g., a mixing channel) in which it is in contact means that the longitudinal axis of the first object is not coextensive with the longitudinal axis of the second object. This includes orientations in which the angle at the intersection between the longitudinal axis of the first object and the longitudinal axis of the second object is less than 180°, such as 45°, 90°, and 135°. Similarly, a first object that is "in transverse fluid communication" with a second object means that the longitudinal axis of fluid flow in the first object is not coextensive with the longitudinal axis of fluid flow in the second object. This includes orientations in which the angle at the intersection between the longitudinal axis of fluid flow in the first object and the longitudinal axis of fluid flow in the second object is less than 180°, such as 45°, 90°, and 135°.

The term "turn" with respect to a channel refers to a channel in which at lease a portion of the longitudinal axis has shape other than a straight line, such as a curve, a bend between two straight line portions of the channel, etc.

The term "groove" when in reference to a channel refers to a structure that is disposed across the width of the channel, thus reducing one or more internal dimension of the channel. Grooves are exemplified by those in Johnson et al. U.S. Pat. No. 6,907,895, and Johnson et al. U.S. Patent Application No. 20050207274).

"Mass fraction" of a component (e.g., fluid) in a mixture refers to the percent by weight of the component in the mixture. A "mass fraction contour" refers to a curve along which the mass fraction is a constant.

DESCRIPTION OF THE INVENTION

The invention provides devices and methods for increasing the mixing of fluids, including under conditions of laminar flow and turbulent flow. In one embodiment, mixing of fluids using the invention's devices and methods is increased by splitting the flow of at least one of the fluids into two or more inlet channels. This is optionally followed by further splitting and merging the fluids, such as by using one or more split and merge (SAM) mixer. The invention's split flow and mixer designs that produces higher mixing efficiencies. These split flow and mixer designs achieve the desired mixing efficiencies based on the following principles of introducing flow from multiple inlets in transverse direction and merging them in one lateral stream, as well as re-splitting the merged flow in transverse direction and re-merging them back in similar fashion in one lateral stream. Exemplary designs B-G of the invention are described in Table 1.

TABLE 1

Figures 28A, 28B:
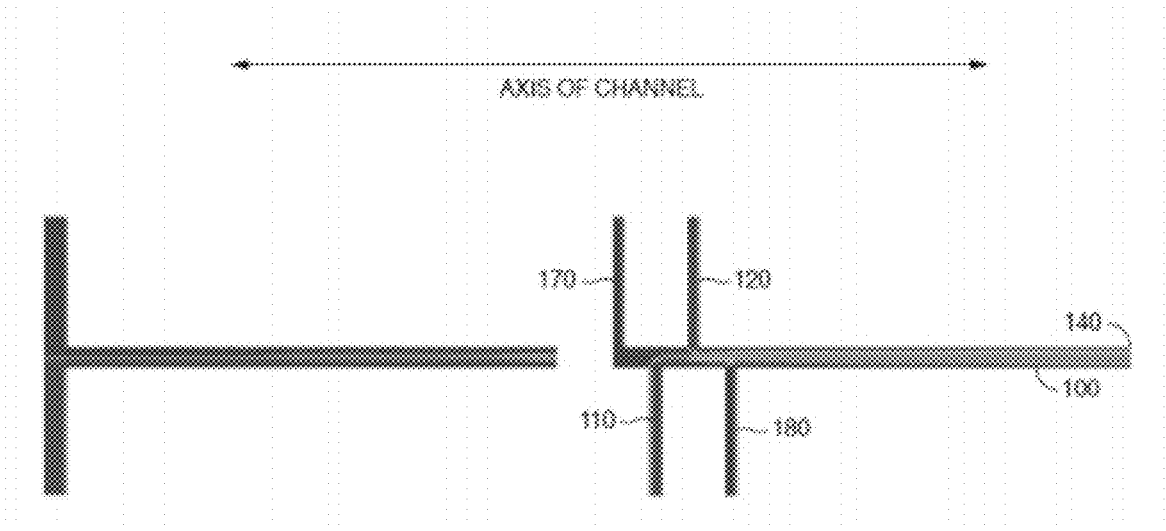

| Exemplary designs of the invention | | | | | | | |
|---|---|---|---|---|---|---|---|
| | Exemplary | | | Degree of Mixing | | Pressure Drop[b] | |
| Design | Component Of The Design | Example No. | Figure No. | Level[a] | Relative to Design A | Pascal | Relative to Design A |
| A | ⊢Microchannel baseline | Ex. 9 | FIG. 28(a) | 0.18 | 100% | 32 | 100% |
| B | Two-way split of each of A & B inlets | Ex. 9 | FIG. 28(b) | 0.61 | 338% | 33 | 103% |
| C | Two-way split of each of A & B inlets combined with Baseline SAM mixer | Ex. 10 | FIG. 32 | 0.78 | 433% | 39.5 | 123% |
| D | Two-way split of each of A & B inlets combined with multistage SAM mixer | Ex. 11 | FIG. 33 | 0.86 | 477% | 47.7 | 149% |
| E | Two-way split of each of A & B inlets combined with Design A of SAM mixer with opposing streams | Ex. 12 | FIG. 34 | 0.89 | 494% | 44.4 | 138% |
| F | Two-way split of each of A & B inlets combined with Design B of SAM mixer with opposing streams | Ex. 13 | FIG. 35 | 0.89 | 494% | 43.6 | 136% |
| G | Two-way split of each of A & B inlets combined with Design B of SAM mixer with opposing streams and with grooves | Ex. 14 | FIG. 36 | 0.92 | 511% | 47 | 147% |

[a]Degree of mixing is calculated using equation (4), and is from 0 (no mixing) to 1 (complete mixing).
[b]Pressure drop is measured from the inlet to the outlet of the design.

The examples herein provide the results of mixing two aqueous reagents using the invention's exemplary devices in comparison with a baseline "⊤" shaped microchannel by means of computational fluid dynamics (CFD). The baseline microchannel geometry had three branches: two inlet channels and one outlet (Example 1). In accordance with the invention, a geometric modification to the baseline was made by splitting the flow of one fluid into two inlet channels, each having half the flow rate of the fluid before splitting, such that the net flow rate at the outlet remained the same as the baseline microchannel. The invention's two splitting inlet channels impinged the microchannel lateral flow from opposite directions. Significant increase in mixing using the two-way split flow modification was observed (Example 2). In addition, further considerable increased mixing was observed over the two-way split flow model by adding well-shaped cavities at the splitting inlet channels using both constant flow (Example 3) and pulsed flow in a time dependent manner (Example 4).

Data disclosed herein further investigated splitting the flow of one fluid that is to be mixed with another fluid. Splitting was achieved by either cutting the velocity of the inlet channel into half or by cutting one of the dimensions of the cross-section into half (FIG. 10). An additional inlet channel introducing the other half of the flow rate was created in the opposite direction in order for the split streams to impinge the lateral flow from two opposite directions. Both the two-way split flow designs with split-velocity and split-dimension techniques were shown to enhance the mixing significantly (Example 5). Another design using the four-way split flow technique was also investigated. However, the four-way split flow design did not perform as well as the two-way split flow design (Example 6). A parametric study was performed to investigate the impact of the distance between the splitting inlet channels on mixing. Computational studies revealed that the opposing splitting inlet channels negate some of the impact of transverse velocity (Example 7). Reducing the distance between the splitting inlet channels maximized the impact of transverse velocity and allowed the fluids to diffuse for the remaining part of the channel flow. Also, creating well shaped cavities at the splitting inlet channels further enhanced mixing in a two-way split flow design (Example 8).

Further data disclosed herein investigated applying the invention's split flow design to three device configurations: "⊢", "←" and "Y" shaped microchannels. Application of the invention's split flow design showed a surprising increase of about 300% (see Table 1, Design B) in fluid mixing when each of two fluids was split into two inlet channels (i.e., a total of 4 inlet channels and one outlet 140) compared to in the absence of splitting of both fluids (i.e., a total of 2 inlet channels and one outlet 140) in each of the three configurations (Example 9, FIGS. 28-31).

The invention is further described under (A) Devices, (B) Methods and (C) Applications.

A. Devices

In one embodiment, the invention provides devices that contain one or more of the two-way split design, four-way split design, Design B, Design C, Design D, Design E, Design F and Design G. The invention's devices are used for mixing at least two fluid streams, fluid A and fluid B, as further described below.

1. Two-Way Split Design and Four-Way Split Design

The invention provides a device in which flow of at least one of the fluids to be mixed is split into two or more streams. Thus, in once embodiment, the invention provides a device that comprises a channel 100 having a longitudinal axis and is in fluid communication with (a) a first inlet channel 130 for a first fluid, (b) a second inlet channel for a second fluid (splitting inlet channel B1 110), and (c) a third inlet channel for the second fluid (splitting inlet channel B2 120), wherein the second inlet channel and the third inlet channel are not on the same side of the channel 100 longitudinal axis. This configuration is exemplified by, but not limited to, the configurations in FIGS. 2*a*, 3*a*, 6*a*, 7*a*, 10*a*, 14, 17*a-c*, 21, 23, 27, 28*b*, 29*b*, 30*b*.

The invention's devices and methods are useful as an effective and reliable mixing technique that overcomes the diffusion challenges found in low velocity and/or laminar-flow fluid environments. The invention's methods also provide flexibility, in that they may be incorporated into current microelectromechanical systems (MEMS) and microfluidic devices. The invention's devices and methods may be used for improving mixing of a sample and analyte (such as an ion, molecule, polymer, virus, nucleic acid, nucleic acid sequence, amino acid, amino acid sequence, antigen, microorganism, cell, etc.), to determine the concentration of an analyte in a sample stream (e.g., U.S. Pat. No. 6,171,865), measure binding reactions such as between antibodies and antigens, between proteins and protein markers (e.g., U.S. Pat. Nos. 6,171,865 and 6,221,677), and the like. The invention's devices and methods are particularly useful in conditions of low volume flow, low velocity flow and/or laminar fluid flow, such as those in microfluidic and MEMS devices.

While the invention's devices are exemplified by two fluid streams, any number of streams of 2 or more may be mixed using the invention's devices and methods, and may include, for example, sample, calibration, reference and control streams.

In one embodiment, the splitting inlet channels (such as splitting inlet channel B1 110 and splitting inlet channel B2 120) are in the same plane with respect to the flow stream of fluid A along the channel 100 longitudinal axis. The splitting inlet channels may however be connected to the channel at any location along the channel longitudinal axis and in any plane, and need not be in the same plane. For example, in one embodiment, splitting inlet channel B1 110 is in the same plane that is formed with the channel longitudinal axis as splitting inlet channel B2 120. In another embodiment, splitting inlet channel B1 110 is in a different plane that is formed with the channel 100 longitudinal axis from inlet channel B2 120. In a particular embodiment, the splitting inlet channels (splitting inlet channel B1 110 and splitting inlet channel B2 120) are in the same plane that is formed with the channel longitudinal axis, and are also on opposite sides of the channel longitudinal axis.

In the configuration in which the splitting inlet channels are in the same plane that is formed with the channel 100 longitudinal axis as well as being also on opposite sides of the channel longitudinal axis, the splitting inlet channels may be opposite each other, or not opposite each other.

The distance between the points where the splitting inlet channels are in direct contact with the channel 100 may be any distance that is sufficient to increase the degree of mixing of fluids in the channel compared to the degree of mixing where the splitting inlet channels are directly opposite each other and/or compared to the degree of mixing in the absence of splitting of the inlet channels. In some embodiments, it may also be preferred to adjust this distance such that it does not undesirably increase the total length of the channel. In one embodiment that is exemplified by inlet channels having a circular cross section, the distance between the points where the splitting inlet channels are in direct contact with the channel is from 1 to 10 diameters, including from 1 to 5 diameters, and further including from 1 to 3 diameters of one or more of the splitting inlet channels. In particular embodiments disclosed in the below examples, the distance between the points where the splitting inlet channels are in direct contact with the channel is 2 diameters.

Data herein demonstrates that splitting the flow of a fluid (e.g., fluid B) into four inlet channels (splitting inlet channel B1 110, splitting inlet channel B2 120, splitting inlet channel B3 200, and splitting inlet channel B4 190) (i.e., four-way split design) where each of two inlet channels is opposite another inlet channel (splitting inlet channel B1 110 is opposite splitting inlet channel B2 120, and splitting inlet channel B3 200 is opposite splitting inlet channel B4 190) with respect to the channel 100 longitudinal axis, increases the degree of mixing of this fluid with a second fluid (fluid A). However, this increase in mixing is less than that observed when the fluid is split into two inlet channels (i.e., two-way split design in having inlet channels B1 and B2) (Example 6, FIG. 14). Nonetheless, where a four-way split may be desirable, in one embodiment, (a) splitting inlet channel B1 110 and splitting inlet channel B2 120 may be directly opposite each other or offset from each other along the channel longitudinal axis, and (b) splitting inlet channel B3 200 and splitting inlet channel B4 190 may be directly opposite each other or offset from each other along the channel longitudinal axis.

2. Design B

In a more preferred embodiment for mixing two fluids, fluid A and fluid B, the inlet channels for not just one fluid, but both fluids, are split as provided by Design B (Table 1, FIGS. 28*b*, 29*b*, 30*b*, 32-36). Thus, in one embodiment, this splitting in Design B results in for example, splitting inlet channel A1 170, splitting inlet channel A2 180, splitting inlet channel B1 110, and splitting inlet channel B2 120. The splitting inlet channels for each fluid need not be in the same plane, so long as there is at least one inlet channel of a particular fluid (such as fluid A) that is on a different side of the channel 100 longitudinal axis compared to the inlet channel of another fluid (such as fluid B). In one embodiment, the splitting inlet channels of one fluid (such as splitting inlet channel A1 170 and splitting inlet channel A2 180) are on opposite sides of the channel 100 longitudinal axis and are in the same or different planes with respect to the channel longitudinal axis, and the splitting inlet channels of the second fluid (such as splitting inlet channel B1 110 and splitting inlet channel B2 120) are on opposite sides of the channel longitudinal axis and are in the same or different planes with respect to the channel longitudinal axis. The planes formed by splitting inlet channel A1 170 with the channel 100 longitudinal axis, by splitting inlet channel A2 180 with the channel longitudinal axis, by splitting inlet channel B1 110 with the channel longitudinal axis, and by splitting inlet channel B2 120 with the channel longitudinal axis may be the same or at any angle greater than zero to each other. In a particular embodiment splitting inlet channel A1 170 and splitting inlet channel A2 180 are opposite each other, and splitting inlet channel B1 110 and splitting inlet channel B2 120 are opposite each other. In a more preferred embodiment, splitting inlet channel A1 170 and splitting inlet channel A2 180 are not opposite each other, and splitting inlet channel B1 110 and splitting inlet channel B2

120 are not opposite each other. This configuration is exemplified by FIGS. 28*b*, 29*b*, 30*b*, which resulted in a surprising increase of about 300% in fluid mixing compared to in the absence of splitting of both fluids in each of three base configurations "⊢", "←" and "Y" (Example 9) (compare Designs A and B in Table 1).

In a further embodiment, the invention provides Design B (Table 1, FIGS. 28*b*, 29*b*, 30*b*, 32-36), which comprises a first mixer of laminar microfluidic streams, wherein the first mixer comprises a) a first mixing channel 100 having a longitudinal axis and an outlet 140, b) a first inlet channel (splitting channel A1) 170, for a first fluid, in transverse fluid communication with the first mixing channel at a first confluence 320 along the longitudinal axis, c) a second inlet channel (splitting channel A2) 180, for the first fluid, in transverse fluid communication with the first mixing channel at a second confluence 330 along the longitudinal axis, d) a third inlet channel (splitting channel B1) 110, for a second fluid, in transverse fluid communication with the first mixing channel at a third confluence 340 along the longitudinal axis, and e) a fourth inlet channel (splitting channel B2) 120, for the second fluid, in transverse fluid communication with the first mixing channel at a fourth confluence 350 along the longitudinal axis, wherein i) the first confluence (of splitting channel A1) 320, the second confluence (of splitting channel A2) 330, the third confluence (of splitting channel B1) 340 and the fourth confluence (of splitting channel B2) 350 are not opposite each other, and ii) the first confluence (of splitting channel A1) 320 and the second confluence (of splitting channel A2) 330 alternate with the third confluence (of splitting channel B1) 340 and with the fourth confluence (of splitting channel B2) 350.

One advantage of Design B is that it improves the degree of mixing of fluids without a substantial increase in pressure drop. For example, Design B showed a degree of mixing of 0.61 (i.e., 61%) with a pressure drop of 33 Pascal. This represents a 338% increase in fluid mixing when compared to a ⊢ microchannel, in which the degree of mixing was 0.18 (i.e., 18%) mixed with a pressure drop of 32 Pascal (Table 1).

Where fluids A and B are mixed in a channel 100, the splitting inlet channels for fluids A and/or B may be arranged in any order along the channel longitudinal axis so long as the flow of fluid from at least two inlet channels (e.g. splitting inlet channel B1 110 and splitting inlet channel B2 120) intersects the lateral flow of the second fluid (e.g. fluid A) from different directions in relation to the direction of flow along the channel longitudinal axis of the other fluid. Thus, in one embodiment for mixing two fluids, fluid A and fluid B, the splitting inlet channels may be arranged in the order of A1-B1-B2-A2 (exemplified by FIGS. 28*b*, 29*b*, 30*b*) or A1-B1-A2-B2 along the channel longitudinal axis.

The invention's devices may comprise splitting inlet channels in which one or more of the splitting inlet channels are "perpendicular" (i.e., at an angle of 90°) or "not perpendicular" (i.e., at an angle less than or greater than 90°) to the channel 100 longitudinal axis. In one embodiment, at least one of the splitting inlet channels is perpendicular to the channel longitudinal axis (exemplified by FIGS. 1*b*, 1*c*, 2*a*, 3*a*, 6*a*, 7*a*, 17*b*, 17*c*, 21, 23, 27, 28*b*). In another embodiment, one or more of the splitting inlet channels is not perpendicular to the channel longitudinal axis (exemplified by FIGS. 29*b*, 30*b*). The splitting inlet channels (such as splitting inlet channel B1 110 and splitting inlet channel B2 120) may be parallel to each other, or not parallel to each other.

Figure 1A:
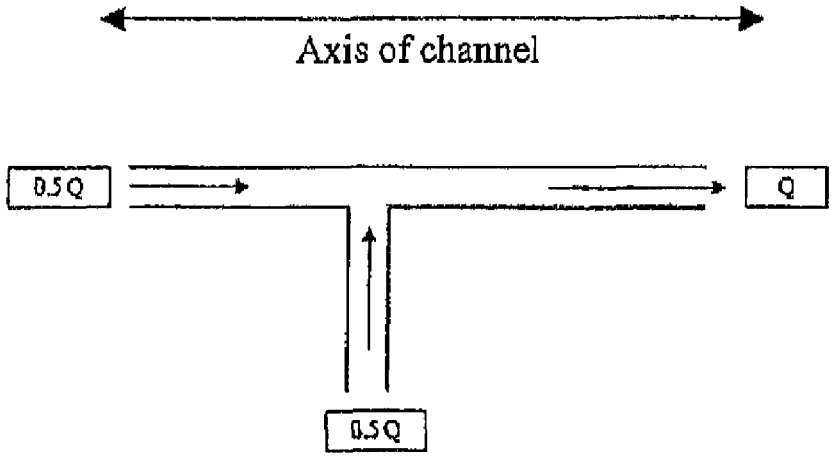
FIG. 1: (a) Baseline case with no splitting inlet channels having 2 inlet channels and 1 outlet. All the branches are 200 μm wide and 120 μm deep. (b) Two-way split flow microchannel having 3 inlet channels and 1 outlet. Fluid "A" inlet channel and outlet channel are 200 μm wide and 120 μm deep. Fluid "B" splitting inlet channel branches are 100 μm wide and 120 μm deep. (c) Two-way split flow microchannel with well shaped cavities having 3 inlet channels and 1 outlet. Fluid "A" inlet channel and outlet channel are 200 μm wide and 120 μm deep. Fluid "B" splitting inlet channel branches are 100 μm wide and 120 μm deep. Wells at the splitting inlet channels are 60 μm deep.
Figure 1B:
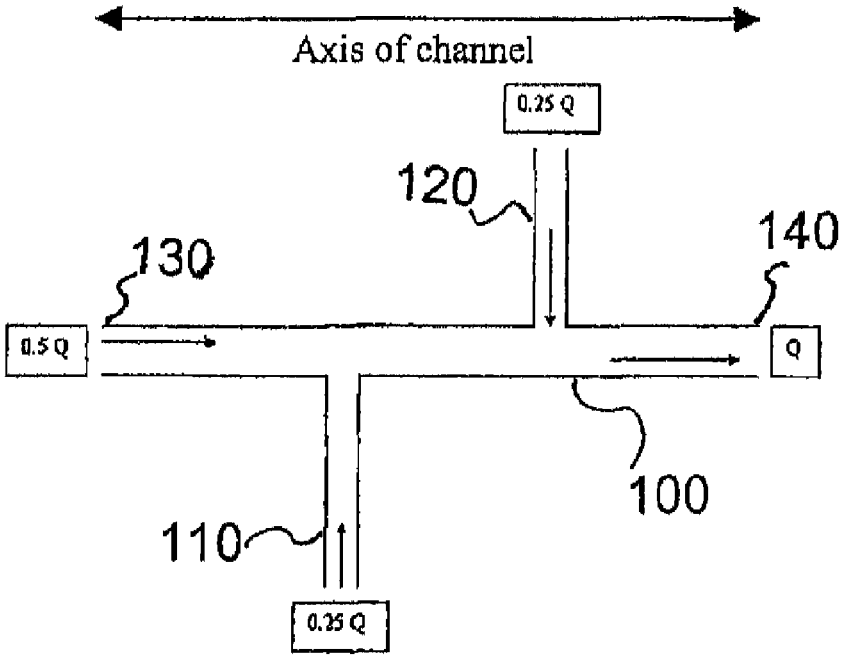
Figure 1C:
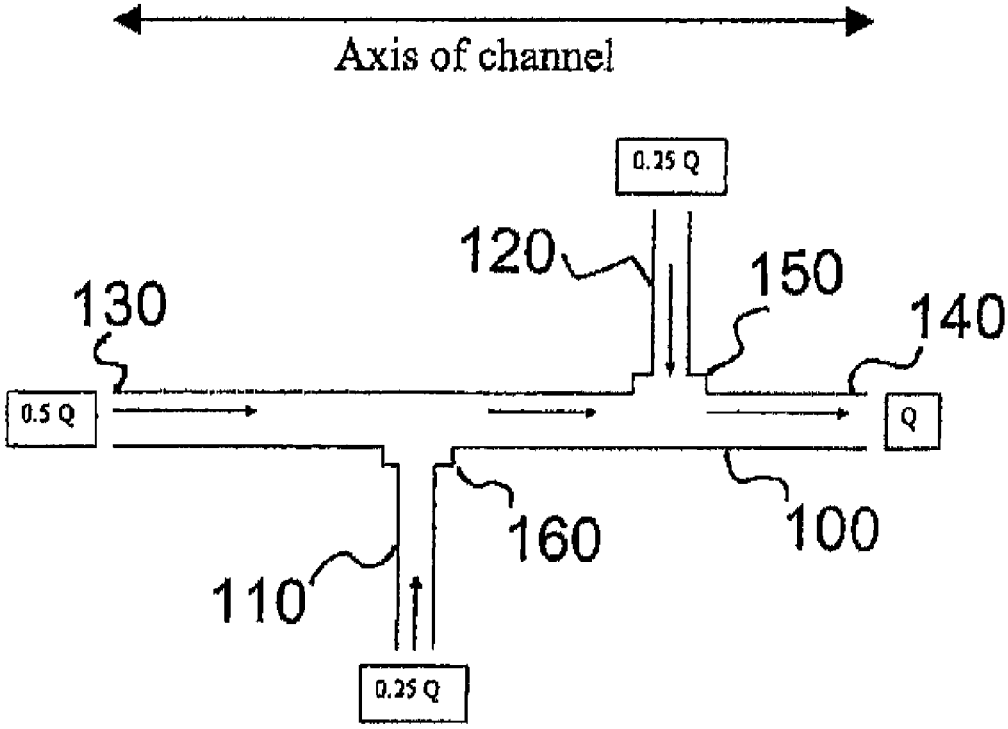
Figure 7A:
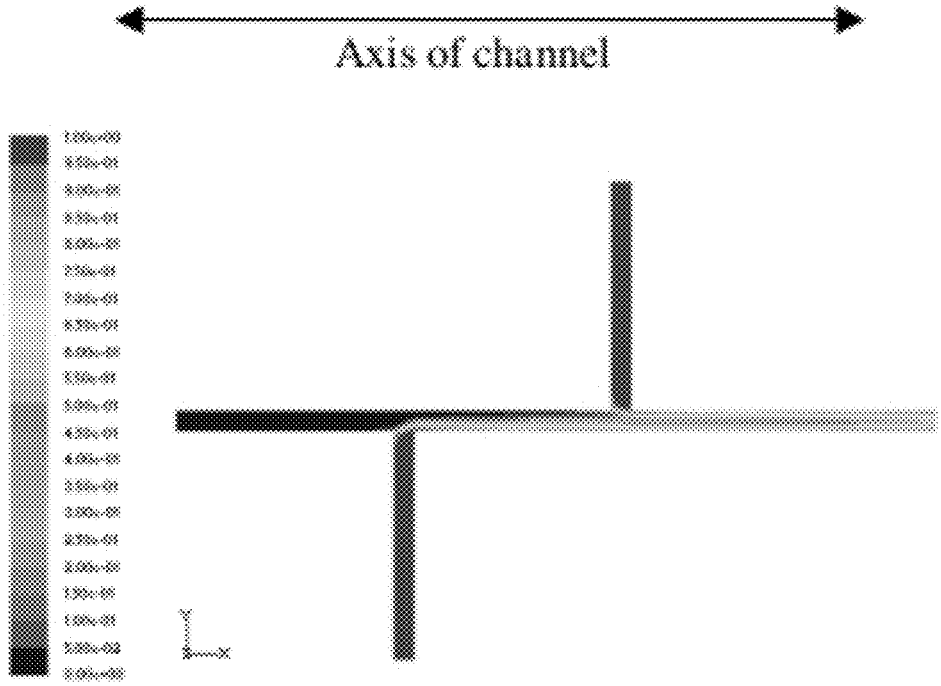
FIG. 7: Mass fraction contours of fluid "B" when the flow is pulsed (a) along the center plane two-way split flow design with wells shaped cavities, and (b) at the outlet of the two-way split flow design with well shaped cavities. Fluid "A" is shown in blue and Fluid "B" is shown in red. Green color indicates a uniformly mixed region of fluids A and B.
Figure 7B:
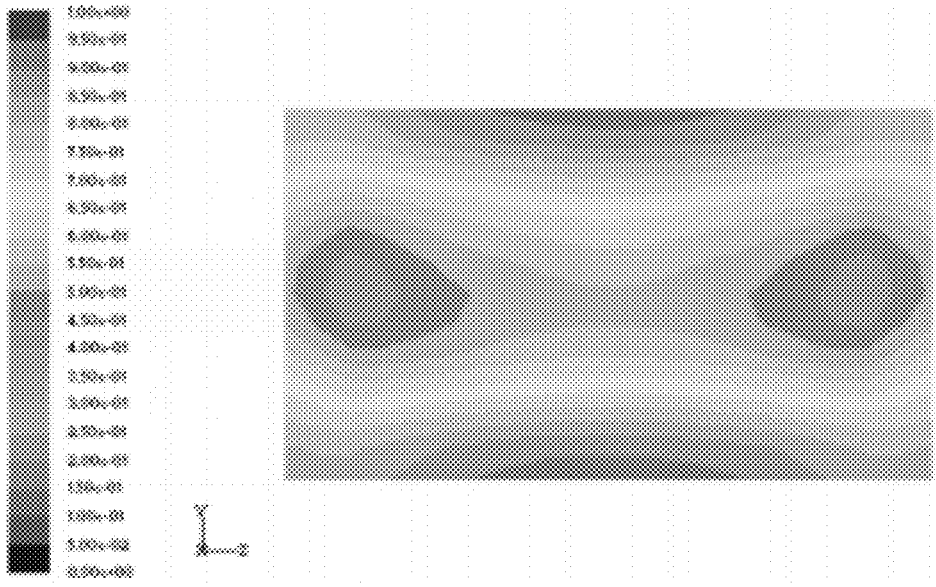

The invention's devices may further comprise one or more wells 150 and 160 in fluid communication with the channel 100 and with one or more of the splitting inlet channels (exemplified by FIGS. 1, 7, 23, and discussed in Examples 2, 4, 8).

The cross section of any one of the channel, inlet channels (including splitting inlet channels), outlets, and wells may be any desirable shape, such as rectilinear (including rectangular, square, triangular, etc.), and curved (including circular, oblong, etc.), and may contain diverging walls and/or converging walls.

The interior dimensions (such as width, depth, height, diameter, etc.) of any one of the channel, inlet channels (including splitting inlet channels), outlets, and wells are preferably large enough to allow passage of particles carried by the fluid streams, such as from 2 to 3 times, from 2 to 5 times, and from 2 to 10 times the diameter of the particles in the streams. The dimensions of the inlet channels for different fluids (e.g., fluid A and fluid B) may be the same or different. The dimensions of splitting inlet channels for the same fluid (e.g., splitting inlet channel B1 110 and splitting inlet channel B2 120) may be the same or different.

In one embodiment, the width and/or depth of the channels, inlet channels, wells and outlets of the devices are from 10 μm to 5 mm, including from 50 μm to 5 mm, further including from 100 μm to 5 mm, and additionally including from 200 μm to 5 mm. The length of the channels, inlet channels, wells and outlets of the devices may be any desirable length so long as it is capable of containing and/or delivering the fluid in the manner intended. Thus, in one embodiment, the length of channels, inlet channels, wells and outlets of the devices may be from 50 μm to 10 mm, including from 100 μm to 5 mm, further including from 1000 μm to 5 mm, and additionally including from 2000 μm to 5 mm. In some embodiments used in the Examples herein, channels had 200 μm width, 120 μm depth, and 3500 μm length, the splitting inlet channels had 200 μm width and 60 μm depth, or a 100 μm width and 120 μm depth, the wells had 200 μm width and 100 μm depth, and the outlets had 200 μm width and 120 μm depth (Examples 1-8).

The devices of this invention may be combined with other devices such as microelectromechanical systems (MEMS), microfluidic devices, analytical sensors, sheath flow assemblies, and storage channels. The invention's devices may be connected in series and/or in parallel to each other and/or to other devices to provide more complex devices. For example, the input for the invention's device may be the output of another microfluidic device. In another embodiment, the output of the invention's device may be the input for another microfluidic device. In yet another embodiment, other microfluidic device components may be incorporated into, or integrated within, the invention's devices. In a further embodiment, an inlet channel of the invention's device may be an outlet of another device, such as the output of a T-sensor or H-filter. In another embodiment, the output of the invention's device may further be in fluid communication with a flow cytometer measuring apparatus.

The devices of this invention may comprise external detecting means for detecting changes in fluid streams within the channel. Detection may employ optical means such as optical spectroscopy (such as absorption and fluorescence) and phosphorescence spectroscopy, immunological means, electrical means (such as electrodes inserted into the device), electrochemical means, radioactive means, and magnetic resonance means. Furthermore, data collection may be manual or automatic and may utilize a computer or other electronic means to collect, graph, process, and analyze the data.

The devices of this invention may be manufactured using any material, including silicon, metal, glass, ceramic, plastic, and polymer materials. Manufacturing may employ any fabrication technique such as common techniques in semiconductor microfabrication that include LIGA, thermoplastic micropattern transfer, resin based microcasting, micromolding in capillaries (MIMIC), wet isotropic and anisotropic etching, laser assisted chemical etching (LACE), and reactive ion etching (RIE). In the case of silicon microfabrication, wafers may accommodate a plurality of the devices of this invention in a plurality of configurations.

Other techniques for the formation of microchannels and other microfluidic features using polymers and laminate layers include laser cutting, laser ablation for the selective removal of material to form microstructures within the polymer substrate, dye cutting, injection molding, and thermoforming. Polymer materials used in the formation of the devices of this invention are known in the art, such as cellulose acetate, polycarbonate, methylmethacrylate and polyester, and are discussed in detail, for example, in Soane et al. (U.S. Pat. No. 6,176,962-B1), Parce et al. (U.S. Pat. No. 5,885,470) and Holl et al. (U.S. patent application Ser. No. 09/688,055).

3. Designs C and D

In a further embodiment, the invention provides Designs C and D (Table 1, FIGS. 32, 33) that, in addition to the components of Design A, further comprise a second mixer of laminar microfluidic streams (herein referred to as "split and merge mixer" or "SAM mixer"). Thus, designs C and D contain, in addition to the components of Design A, f) a merge channel 270 having an inlet 370 and outlet 380, g) a first splitting channel 210 having an inlet 220 and an outlet 230, wherein the first splitting channel inlet 220 is in transverse fluid communication with the first mixing channel 100 (e.g., at its outlet 140), and wherein the first splitting channel outlet 230 is in transverse fluid communication with the merge channel inlet 370 at a fifth confluence 300, and h) a second splitting channel 240 having an inlet 250 and an outlet 260, wherein the second splitting channel inlet 250 is in transverse fluid communication with the first mixing channel 100 (e.g., at its outlet 140), and wherein the second splitting channel outlet 260 is in transverse fluid communication with the merge channel at a sixth confluence 310, and wherein the fifth confluence 300 (of first splitting channel) and the sixth confluence 310 (of second splitting channel) are not opposite each other.

One advantage of the configuration in Designs C and D is that it improves the degree of mixing of fluids without a substantial increase in pressure drop. For example, Designs C and D showed a 433% increase and 477% increase, respectively, in fluid mixing when compared to a ⊢ microchannel (Table 1).

With regard to the splitting channels of the SAM mixer, the first splitting channel 210 and the second splitting channel 240 may be positioned anywhere along the longitudinal axis of the first mixing channel 100, and preferably opposite each other (FIGS. 35-36).

One or more of the first splitting channel 210 and the second splitting channel 240 may be perpendicular or not perpendicular (i.e., at an angle less than or greater than 90°) to one or both of the first mixing channel's 100 longitudinal axis and of the merge channel's 270 longitudinal axis.

Also, the angle between the first splitting channel 210 and the first mixing channel's 100 longitudinal axis may be the same or different from the angle between the second splitting channel 240 and the first mixing channel's 100 longitudinal axis. In one embodiment, both the first and second splitting channels are perpendicular to the first mixing channel's longitudinal axis (exemplified by FIGS. 34-36).

Furthermore, the angle between the first splitting channel 210 and the merge channel's 270 longitudinal axis may be the same or different from the angle between the second splitting channel 240 and the merge channel's 270 longitudinal axis. In one embodiment, both the first and second splitting channels are perpendicular to the merge channel's longitudinal axis (exemplified by FIGS. 34-36).

The first splitting channel 210 and the second splitting channel 240 may be parallel to each other, or not parallel to each other. They may also be either in the same plane (e.g., in a flat chip), or in different planes (e.g., in a three dimensional structure), with respect to the first mixing channel's 100 longitudinal axis.

With respect to the merge channel of the SAM mixer, in a preferred embodiment, one or more of the internal cross-section dimensions (e.g., width, depth, diameter, etc.) of the merge channel 270 is larger than the corresponding dimension in one or both of the first splitting channel 210 and of the second splitting channel 240. For example, in one embodiment, each of the first and second splitting channels has a width of 75 μm and depth 300 μm, while the merge channel has a width of 150 μm and depth of 300 μm (Examples 10-14).

The merge channel 270 may be in the same plane (e.g., in a flat chip), or in a different plane (e.g., in a three dimensional structure) with respect to one or both of the first splitting channel 210 and of the second splitting channel 240.

In one embodiment of Designs C and D, each of the first splitting channel 210 and the second splitting channel 240 comprises 2 turns. (Table 1, FIGS. 32, 33). The shape of the turn in the first splitting channel 210 and the second splitting channel 240 may be the same or different, preferably the same. Each of the first splitting channel 210 and the second splitting channel 240 may have at least one turn, preferably from 1 to 10 turns, more preferably from 1 to 4 turns, and most preferably 2 turns. In a most preferred embodiment, each of the first splitting channel 210 and the second splitting channel 240 has two perpendicular turns (FIGS. 34, 35, 36).

In a preferred embodiment, one or more of the internal cross-section dimensions (e.g., width, depth, diameter, etc.) of the first splitting channel 210 and the second splitting channel 240 is smaller than the corresponding dimension in the first mixing channel 100. For example, in one embodiment, each of the first and second splitting channels has a width of 75 μm and depth 300 μm, while the first mixing channel has a width of 150 μm and depth of 300 μm (Examples 10-14).

The inventions contemplates devices that contain one or more SAM mixers, including from 1 to 10 SAM mixers, from 1 to 4 SAM mixers, etc. This is exemplified by having a total of 3 SAM mixers as shown in Design D of FIG. 33. The SAM mixers may be in direct fluid communication with each other (FIG. 33). Alternatively, the SAM mixers may have other components disposed between them. In one embodiment, where 2 or more SAM mixers are in fluid communication with each other, the combination of SAM mixers is configured such that the merge channel outlet 380 of each SAM mixer is in transverse fluid communication with the splitting channels 210 and 240 of another SAM mixer (FIG. 33).

4. Designs E, F and G

In another embodiment, the invention provides Designs E, F and G (Table 1, FIGS. 34, 35, 36) that, in addition to the components of Design A, further comprise a second mixer of laminar microfluidic streams (i.e., a SAM mixer). Thus, designs E, F and G contain, in addition to the components of Design A, f) a merge channel 270 having an first inlet 390 and a second inlet 400, g) a second mixing channel 280 having an inlet 290 and an outlet 360, wherein the second mixing channel inlet 290 is in transverse fluid communication with the merge channel at a mixing channel confluence, h) a first splitting channel 210 having an inlet 220 and an outlet 230, wherein the first splitting channel inlet 220 is in transverse fluid communication with the first mixing channel 100 (e.g., at its outlet 140), and wherein the first splitting channel outlet 230 is in transverse fluid communication with the merge channel first inlet 390 at a fifth confluence 300, and i) a second splitting channel 240 having an inlet 250 and an outlet 260, wherein the second splitting channel inlet 250 is in transverse fluid communication with the first mixing channel 100 (e.g., at its outlet 140), wherein the second splitting channel outlet 260 is in transverse fluid communication with the merge channel second inlet 400 at a sixth confluence 310, and wherein the fifth confluence 300 (of the first splitting channel) and the sixth confluence 310 (of the second splitting channel) are not opposite each other.

One advantage of the configuration of Designs E, F and G is that that each of these designs improves the degree of mixing of fluids without a substantial increase in pressure drop. For example, each of Designs E and F showed a 494% increase in fluid mixing when compared to a ⊢ microchannel (Table 1). Design G showed a 511% increase in fluid mixing when compared to a ⊢ microchannel (Table 1).

Designs E, F and G may contain one or more turns (e.g., from 1 to 10 turns, from 1 to 4 turns, etc.) in one or more of the first splitting channel 210, the second splitting channel 240, and the second mixing channel 280. For example, in one preferred embodiment, each of the first splitting channel 210 and the second splitting channel 240 comprises 2 turns, as exemplified by Designs E, F and G, FIG. 34, 35, 36, respectively. In another embodiment of any one of Designs E, F and G, the second mixing channel 280 comprises 3 turns, as exemplified by Designs E, F and G, FIG. 34, 35, 36, respectively. The shape of the turns may be the same or different, preferably the same. In a particular embodiment, each of the 2 turns in the first splitting channel 210, each of the 2 turns in the second splitting channel 240, and each of the 3 turns in the second mixing channel 280 are perpendicular turns (FIGS. 34, 35, 36).

Any of the channels in Designs E, F and G may contain or more grooves, including 1 to 10 groove, 1 to 5 grooves, 1 to 3 groove, etc. In a particularly preferred embodiment, the merge channel 270 comprises (i) a groove between the first inlet of the merge channel 390 and the inlet of the second mixing channel 290, and (ii) a groove between the second inlet of the merge channel 400 and the inlet of the second mixing channel 290 (exemplified by Design G, Table 1, FIG. 36).

B. Methods

The invention's devices may be used to mix a first fluid and a second fluid in a channel by splitting the flow of at least one of the fluids prior to mixing. This is optionally followed by further splitting and merging (e.g., using one or more split and merge (SAM) mixer) the fluids.

1. Two-Way Split Design and Four-Way Split Design

Thus, in one embodiment in which the flow of one fluid is split, the method of mixing comprises (a) flowing the first fluid (such as fluid A) into a first inlet channel (inlet channel A1 170) that is in fluid communication with the channel, (b) flowing the second fluid (such as fluid B) into a second inlet channel (splitting inlet channel B1 110) and into a third inlet channel (splitting inlet channel B2 120), wherein 1) the second inlet channel (splitting inlet channel B1 110) and the third inlet channel (splitting inlet channel B2 120) are in fluid communication with the channel, and 2) flow from the second inlet channel (splitting inlet channel B1 110) and flow from the third inlet channel (splitting inlet channel B2 120) intersect different sides of flow of the first fluid (fluid A) in the channel. Data herein demonstrates that this method of splitting the flow of one fluid results in a degree of mixing (DOM) of the two fluids that is greater than in the absence of splitting when the flow rate (Q) at the outlet is unchanged.

2. Design B

In a particular embodiment, the flow of both fluids to be mixed is split. Thus, in one embodiment, the invention provides a method for increasing the degree of mixing of a first fluid (fluid A) and a second fluid (fluid B), comprising a) providing the device of Design B (Table 1, exemplified in FIGS. 28*b*, 29*b*, 30*b*, 32-36), b) splitting the flow of a first fluid (fluid A) into the first inlet channel (splitting channel A1) 170 and the second inlet channel, c) splitting the flow of a second fluid (fluid B) into the third inlet channel (splitting channel B1) 110 and the fourth inlet channel (splitting channel B2) 120, wherein flow from the third inlet channel (splitting channel B1) 110 and flow from the fourth inlet channel (splitting channel B2) 120 intersect different sides of flow of the first fluid (fluid A) in the first mixing channel 100, and d) producing a first mixed fluid at the mixing channel outlet 140, wherein degree of mixing (DOM) of the first fluid and the second fluid in the first mixed fluid is higher than in the absence of the splitting the flow of the first fluid and of the splitting the flow of the second fluid.

It is not intended that the invention's methods be limited to a particular level of increased degree of mixing. Nonetheless, in one embodiment, the degree of mixing in the first mixed fluid is at least 200% higher (including from 200% to 500% higher, from 200 to 400% higher, etc.), than in the absence of the splitting the flow of the first fluid and of the splitting the flow of the second fluid. Data herein show that the four-way split Design B produces a 338% improvement in DOM relative to the ⊢ microchannel baseline Design A (Table 1).

Also, it is not intended that the invention be limited to a particular level of pressure drop. Nonetheless, in one embodiment, the pressure drop between 1) any one of the inlet of the first inlet channel (splitting channel A1) 170, the inlet of the second inlet channel (splitting channel A2) 180, the inlet of the third inlet channel (splitting channel B1) 110, and the inlet of the fourth inlet channel (splitting channel B2) 120, and 2) the first mixing channel outlet 140, is substantially the same as, or higher than, the pressure drop in the absence of the splitting the flow of the first fluid and of the splitting the flow of the second fluid. Data herein show that the pressure drop of the four-way split design B is approximately 103% relative to the ⊢ microchannel baseline Design A (Table 1).

The invention's devices and methods are useful in conditions of laminar flow and/or turbulent flow, and are particularly useful for mixing fluids in small volume where flow is laminar since the degree of mixing under these conditions is low.

Means for controlling fluid flow may be connected to one or more inlet channels and/or one or more outlets. The means for controlling fluid flow includes pressure control, electro-osmotic forces, optical forces, gravitational forces and surface tension forces. Controlling fluid flow may include internal and/or external pumps and valves. Internal pumps may include micromachined mechanical microfluidic pumps, electro-osmotic pumps and other "onchip" pumps known in the art. External pumps such as syringe pumps and other mechanical pumps may also be used. For example, U.S. Pat.

No. 5,726,404 describes pneumatic valves, check valves based on laminated layers, pinch valves, and pressure valves. The device may further include electronics or electronic interfaces for computer control of internal and external pumps and valves for controlling fluid flow.

The volume and/or flow rates of the split streams of the same fluid (such as in splitting inlet channel A1 170 compared to splitting inlet channel A2 180) may be the same or different. The volume and/or flow rates of the split streams of different fluids (such as in splitting inlet channel A1 170 compared to splitting inlet channel B1 110) may be the same or different. The volume and/or flow rates of the different fluids from the split and un-split inlet channels to be mixed (such as fluid A compared to fluid B) may be the same or different. For example, where the channel is used for mixing a blood sample with a fluid comprising a drug, the volumes of the blood sample and fluid that contains the drug may be different.

The methods of the invention may be used with constant flow and/or pulsed flow. Thus, in one embodiment, the method further comprises pulsing flow in at least one of the splitting inlet channels for fluids A and/or fluid B (exemplified by Example 4, FIGS. 5-8).

3. Designs C and D

The Designs C and/or D of Table 1 (Table 1, FIGS. 32, 33) may be used in a method for increasing degree of mixing of a first fluid and a second fluid, comprising a) providing a devise of Design C and/or D, b) splitting the flow of a first fluid (fluid A) into the first inlet channel (splitting channel A1) 170 and the second inlet channel, c) splitting the flow of a second fluid (fluid B) into the third inlet channel (splitting channel B1) 110 and the fourth inlet channel (splitting channel B2) 120, wherein flow from the third inlet channel (splitting channel B1) 110 and flow from the fourth inlet channel (splitting channel B2) 120 intersect different sides of flow of the first fluid (fluid A) in the first mixing channel 100, thereby producing a first mixed fluid at the mixing channel outlet 140, d) splitting the flow of the first mixed fluid into the first splitting channel 210 and the second splitting channel 240, and e) merging the flow of fluid from the first splitting channel outlet 230 and fluid from the second splitting channel outlet 260 into the merge channel 370, to produce a second mixed fluid, wherein degree of mixing (DOM) of the first fluid and the second fluid in the second mixed fluid, is higher than in the absence of the splitting the flow of the first fluid in step b) and of the splitting the flow of the second fluid in step c).

In a particular embodiment, the method further comprises h) flowing the second mixed fluid from the merge channel outlet 380 into at least one additional SAM mixer, such as from 1 to 10 additional SAM mixer, exemplified by having a total of 3 mixers (Table 1 Design D, FIG. 33).

The methods are not intended to be limited to a particular level of degree of mixing. However, in one embodiment, the degree of mixing (DOM) of the first fluid and the second fluid in the third mixed fluid is at least 200% higher (including from 200% to 1000% higher, from 200% to 750% higher, and from 200% to 600% higher) than in the absence of the splitting the flow of the first fluid and of the splitting the flow of the second fluid. Data herein shows that designs C and D produce a 433% and 477% improvement respectively, in DOM relative to the ⊢ microchannel baseline Design A (Table 1).

The methods are also not intended to be limited to a particular pressure drop. However, in one embodiment, the pressure drop between 1) any one of the inlet of the first inlet channel (splitting channel A1) 170, the inlet of the second inlet channel (splitting channel A2) 180, the inlet of the third inlet channel (splitting channel B1) 110, and the inlet of the fourth inlet channel (splitting channel B2) 120, and 2) the merge channel outlet 380 is higher than the pressure drop in the absence of the splitting the flow of the first fluid and of the splitting the flow of the second fluid. In a more preferred embodiment, the pressure drop is less than 300% higher (most preferably from 50% to 250% higher) than the pressure drop in the absence of the splitting the flow of the first fluid and of the splitting the flow of the second fluid. Data herein show that the pressure drop of Designs C and D were 123% and 149% higher, respectively, than the ⊢ microchannel baseline Design A (Table 1).

4. Designs E, F and G

The Designs E, F and/or G (Table 1, FIGS. 34, 35, 36) may be used in a method for increasing degree of mixing of a first fluid and a second fluid, comprising a) providing a device of Design E, F and/or G, b) splitting the flow of a first fluid (fluid A) into the first inlet channel (splitting channel A1) 170 and the second inlet channel, c) splitting the flow of a second fluid (fluid B) into the third inlet channel (splitting channel B1) 110 and the fourth inlet channel (splitting channel B2) 120, wherein flow from the third inlet channel (splitting channel B1) 110 and flow from the fourth inlet channel (splitting channel B2) 120 intersect different sides of flow of the first fluid (fluid A) in the first mixing channel 100, thereby producing a first mixed fluid at the mixing channel outlet 140, d) splitting the flow of the first mixed fluid into the first splitting channel 210 and the second splitting channel 240, e) merging the flow of fluid from the first splitting channel outlet 230 and fluid from the second splitting channel outlet 260 into the merge channel 370, to produce a second mixed fluid, and f) flowing the second mixed fluid into the second mixing channel to produce a third mixed fluid at the second mixing channel outlet 360, wherein degree of mixing (DOM) of the first fluid and the second fluid in the third mixed fluid, is higher than in the absence of the splitting the flow of the first fluid in step b) and of the splitting the flow of the second fluid in step c).

It is not intended that the methods be limited to a particular degree of mixing. Nonetheless, in one embodiment, the degree of mixing (DOM) of the first fluid and the second fluid in the third mixed fluid is at least 200% higher (including from 200% to 1000% higher, from 200% to 750% higher, and from 200% to 600% higher) than in the absence of the splitting the flow of the first fluid and of the splitting the flow of the second fluid. Data herein shows that designs E and F produces a 494% improvement in DOM relative to the ⊢ microchannel baseline Design A (Table 1). In addition, Design G produces a 511% improvement in DOM relative to the ⊢ microchannel baseline Design A (Table 1).

The invention's methods are not intended to be limited to a particular pressure drop. However, in one embodiment, the pressure drop between 1) any one of the inlet of the first inlet channel (splitting channel A1) 170, the inlet of the second inlet channel (splitting channel A2) 180, the inlet of the third inlet channel (splitting channel B1) 110, and the inlet of the fourth inlet channel (splitting channel B2) 120, and 2) the second mixing channel outlet 360 is higher than the pressure drop in the absence of the splitting the flow of the first fluid and of the splitting the flow of the second fluid. In a particular embodiment, the pressure drop is less than 300% higher (most preferably from 125 to 200% higher) than the pressure drop in the absence of the splitting the flow of the first fluid and of the splitting the flow of the second fluid. For example, data herein show that the pressure drop of Designs E, F and G were 138%, 136% and 147%, respectively, relative to the ⊢ microchannel baseline Design A (Table 1).

C. Applications

It is not intended that the present invention be limited to by the nature of the fluids or the nature of the particular application to which it is applied. The invention's devices, systems and methods may be applied in, for example, micropneumatic systems, i.e. microsystems for the handling of off-chip fluids (liquid pumps, gas valves, etc.), and microfluidic structures for the on-chip handling of nanoliter and picoliter volumes, exemplified by, but not limited to, inkjet printheads. In addition, the invention's devices, systems and methods may be used in microfluidics technology such as in molecular biology procedures, procedures for enzymatic analysis (e.g., glucose assays, lactate assays, etc.), DNA analysis (e.g., polymerase chain reaction, high-throughput sequencing, etc.), and proteomics.

The invention's devices, systems and methods may further be applied to microfluidic biochips in clinical pathology applications (e.g., diagnosis of disease), and microfluidics-based devices that are capable of continuous sampling and real-time testing of air/water samples for biochemical toxins and pathogens.

EXPERIMENTAL

The following examples serve to illustrate certain preferred embodiments and aspects of the present invention and are not to be construed as limiting the scope thereof.

Example 1

Baseline Configuration

In order to study the effect of geometry on mixing, a "⊤" shaped microchannel system was considered first to provide a baseline. The "⊤" shaped microchannel with three branches: two inlets (one for each reagent) and one outlet. All the branches were 200 μm wide and 120 μm deep in the calculations presented here.

The baseline case has 1250 μm of channel length between inlet 1 and inlet 2 and 3000 μm of channel length between inlet 2 and the outlet.

In another embodiment, the baseline case has 1250 μm of channel length between inlet 1 and inlet 2 and 4050 μm of channel length between inlet 2 and the outlet. Similar aqueous solution enters through the two inlets with a diffusion constant of $10^{-10}$ $m^2/s$ and kinematic viscosity of $10^{-6}$ $m^2/s$, typical for small proteins in aqueous solutions. Only mixing of two components was treated here, other effects such as chemical reactions were not included. The fluids were assumed to be Newtonian and incompressible, so that the equations of motion were the Navier Stokes and continuity equations (Goullet et al. (2006), pp. 739-746):

$$\frac{\partial \vec{u}}{\partial t} + (\vec{u}\cdot\nabla)\vec{u} = -\frac{1}{\rho}\nabla p + \upsilon\nabla^2\vec{u} \tag{1}$$

$$\nabla\cdot\vec{u} = 0 \tag{2}$$

where $\vec{u}$ is the velocity vector, p is the pressure, ρ is the mass density and ν is the kinematic viscosity.

The evolution of the concentration was computed from the advection diffusion equation:

$$\frac{\partial c}{\partial t} + (\vec{u}\cdot\nabla c) = D\nabla^2 c \tag{3}$$

where D is the diffusion constant and c is the local concentration or mass fraction of a given species.

The computational domain was discretized using a structured mesh having sides 10 μm long. Thus the channels were 20 cells wide and 12 cells deep. The baseline case was analyzed for the constant flow rate with mean velocity of 1 mm/s in each inlet, corresponding to a Reynolds number of 0.3. The mass fraction contours of fluid "B" for the baseline case. Fluid "A" has c=0 and is shown in blue and Fluid "B" is shown in red corresponding to a mass fraction of c=1. Hence mass fractions of 0 and 1 comprise the inlet flow regions. A green color corresponds to a mass fraction of 0.5 indicating a uniformly mixed fluid region.

To calculate degree of mixing (DOM) we used the method discussed by Glasgow et al. (Glasgow et al., Proceedings of IMECE (2003)). Mass fraction of liquid "B" was monitored at the center of each cell in the outlet of the microchannel. Standard deviation of the mass fraction of liquid "B" was calculated about the fixed value μ. The deviation of mass fraction from μ was weighted by the mass flux of the fluid at a given transverse location. With the assumption that the fluid was incompressible and because all the cells were of same size, the instantaneous mass flux was directly proportional to the instantaneous spatially averaged fluid velocity of the cell. Finally, the weighted deviation was normalized to a scale from 0 (no mixing) to 1 (complete mixing) by dividing by μ and subtracting the quotient from 1 as shown in equation 4, where $v_i$ is the velocity in the $i^{th}$ cell, $v_{mean}$ is the mean velocity at the outlet of the channel, $x_i$ is the mass fraction in $i^{th}$ cell, n is the number of cells μ=0.5 which is the targeted case of equal mixing of the two reagents.

$$DOM = 1 - \frac{1}{\mu}\sqrt{\sum_{i=1}^{n}\frac{(x_i-\mu)^2}{n}\frac{v_i}{v_{mean}}} \tag{4}$$

Equation 4 calculates mixing from 0 (no mixing) to 1 (complete mixing). Degree of mixing was calculated in a plane, which was 500 μm behind the outlet. Degree of mixing for the baseline case was calculated equal to 0.23.

Degree of mixing for the baseline case was calculated equal to 0.32.

Example 2

Two-Way Split Flow Model

The mass fraction contours along the center plane of the baseline case. Since the two inlets were at right angle, fluid "B" (red) impinges the fluid "A" stream. This transverse fluid motion at the confluence facilitates mixing up to the center of the channel. The top half of the channel shows unmixed fluid "A" since fluid "B" does not penetrate through the entire depth of the microchannel. If another fluid inlet was created on the opposite side of the channel, fluid "B" will impinge fluid "A" from both the directions and can enhance mixing. However in order to maintain the overall system flow rate by creating another inlet in the opposite direction, the flow rate in the opposing inlets was halved so that the net flow rate at the outlet will remain the same as the baseline case. This was easily achieved by making the fluid "B" inlets 100 μm wide instead of 200 μm. Depth of the split inlet was not altered and was 120 μm. FIG. 1(*a*) shows the baseline case with net flow rate at the outlet equal to "Q". FIG. 1(*b*) shows the two-way split flow model with split inlets (100 μm wide and 120 μm deep). The net flow rate the outlet was still "Q"

The split flow model has been further modified by adding 60 μm deep wells at the split inlets. FIG. 1(*c*) shows a two-way split flow model with well-shaped cavities and the net flow rate of "Q" at the outlet.

Example 3

Constant Flow

Figure 2A:
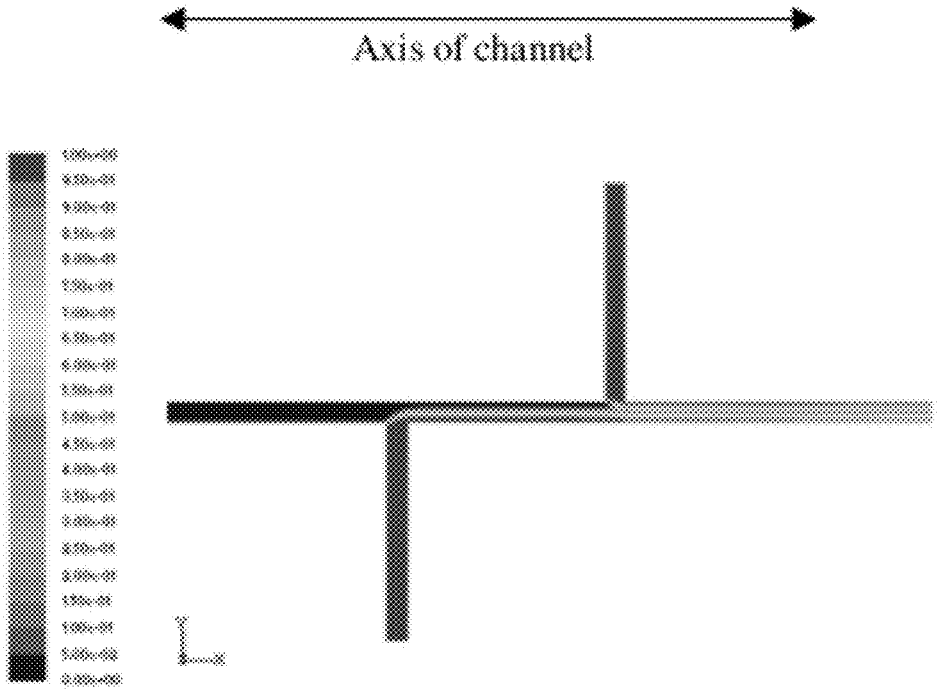
FIGS. 2 (*a*) and (*b*) show mass fraction contours of fluid "B" along the center plane of the two-way split flow microchannel. Fluid "A" is shown in blue and Fluid "B" is shown in red. Green color indicates a uniformly mixed region of fluids A and B.
Figure 2B:
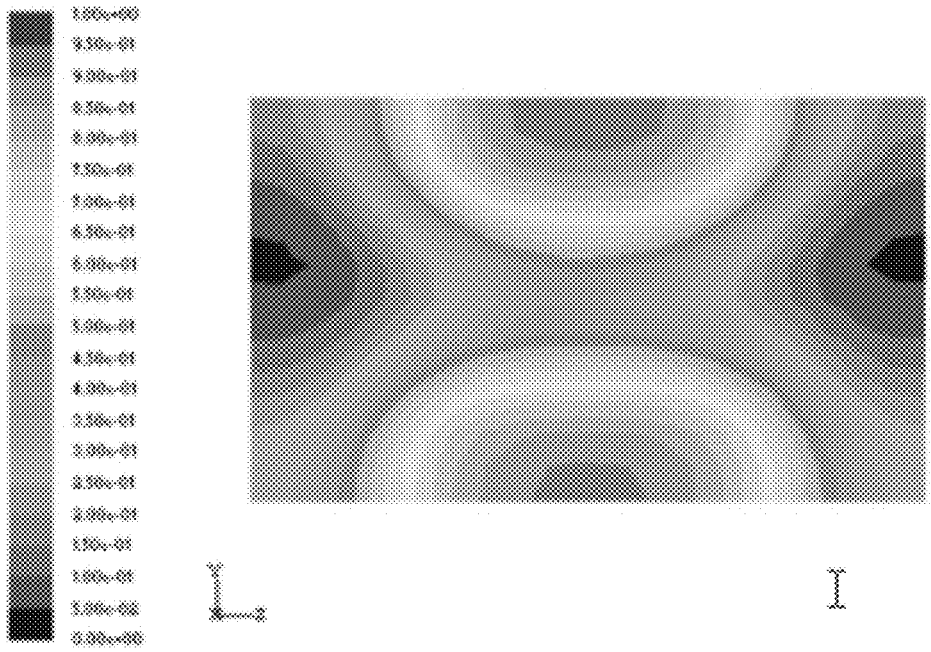
Figure 3A:
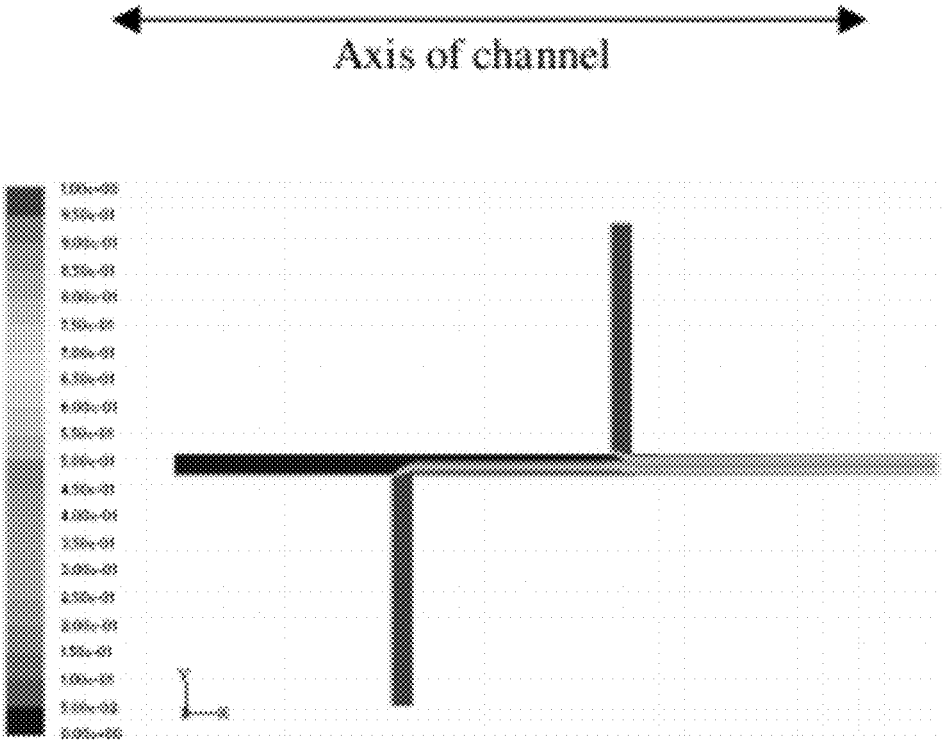
FIG. 3: (*a*) and (*b*) show mass fraction contours of fluid "B" along the center plane of the two-way split flow microchannel with well shaped cavities. Fluid "A" is shown in blue and Fluid "B" is shown in red. Green color indicates a uniformly mixed region of fluids A and B.
Figure 3B:
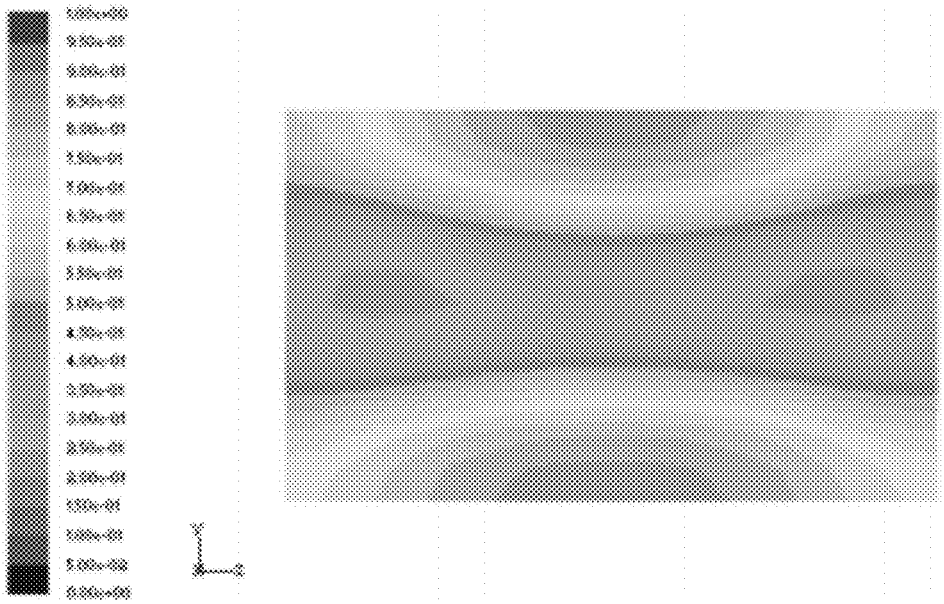

The two models discussed above were analyzed for constant flow rate with a mean velocity of 1 mm/s in all the three inlets. The degree of mixing was computed using equation (4) and the results were compared with the baseline case of a "T" microchannel. FIGS. 2(*a* & b) show the mass fraction contours of the two-way split flow model along the center plane and at the outlet, respectively. FIGS. 3 (*a* & *b*) show the mass fraction contours of the two-way split flow model with well-shaped cavities along the center plane and at the outlet, respectively.

Mass fraction contours for both two-way split flow designs with and without wells clearly show enhanced mixing as compared to the baseline case. Table 2 shows a comparison between all the three cases considered in the present study.

TABLE 2

Table showing comparison between 3 cases considered to present the study.

| Design | Net Flow Rate | Degree Of Mixing |
|---|---|---|
| Baseline case: "T" microchannel | 0.21 ml/hr | 0.32 |
| Two-way split flow model | 0.21 ml/hr | 0.5 |
| Two-way split flow model with well shaped cavities | 0.21 ml/hr | 0.6 |

As mentioned previously, generating flow in the transverse direction across a microchannel significantly enhances mixing. The two-way split flow microchannel, unlike the baseline case, impinges the primary stream in two opposite directions. The impinging fluid penetrates fluid "A" at two locations and enhances mixing. Hence 56% increase in degree of mixing was seen over the baseline case by employing the two-way split flow design.

Figure 4A:
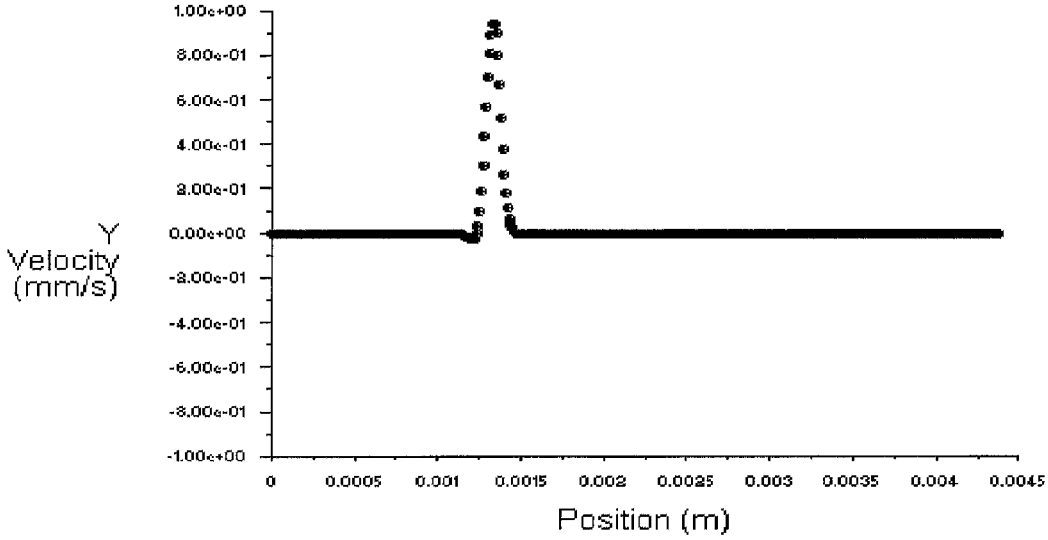
FIG. 4: Center-line "y-velocity" along the length of (a) "T" microchannel, (b) two-way split flow microchannel, and (c) two-way split flow microchannel with well shaped cavities.
Figure 4B:
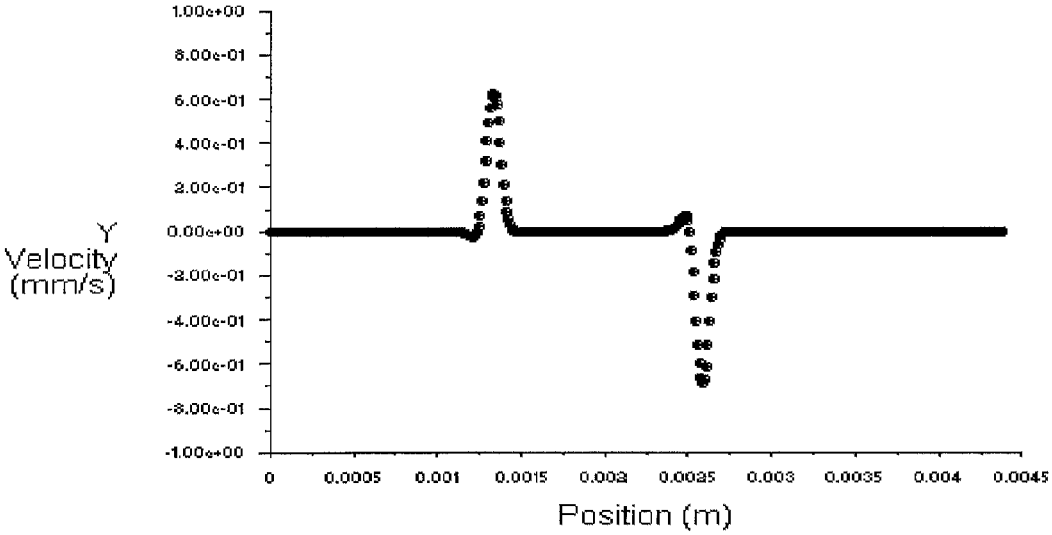
Figure 4C:
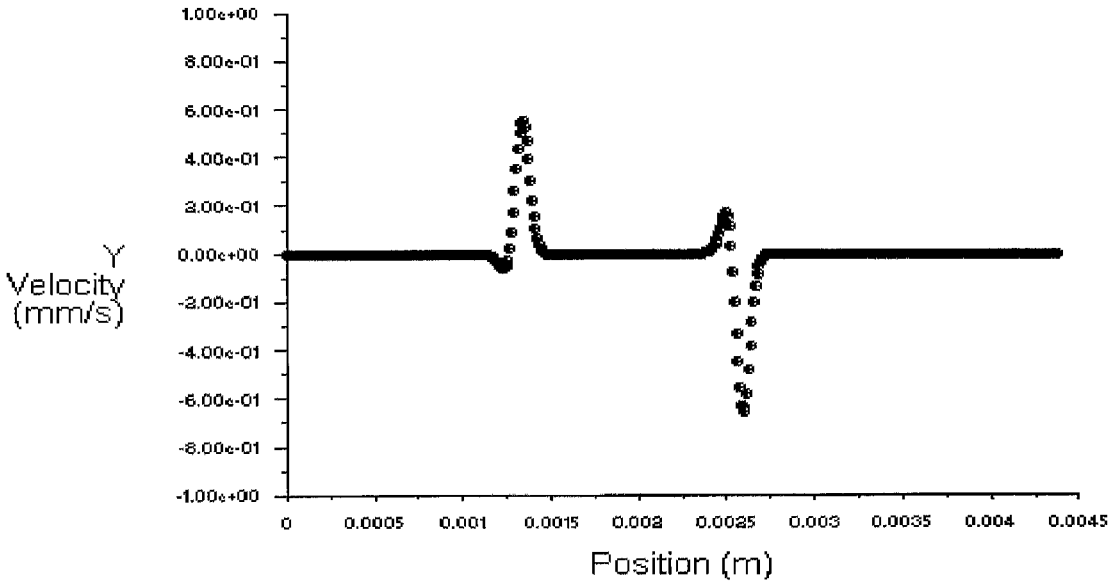

By creating well-shaped cavities, mainstream fluid interacts with the more complex flow structure that exists in the wells. As compared to the two-way split flow design, creating wells further enhances the mixing by 20%. Two-way split flow design with well-shaped cavities shows 87.5% increase in mixing over the baseline case. FIGS. 4(*a, b* & *c*) presents plots of the transverse velocity (y velocity) for all the three cases considered in the present the study.

As seen clearly in the plot, for the baseline case (refer to FIG. 4*a*) fluid B impinges fluid A only at their confluence. For the two-way split flow design fluid B impinges fluid A at two locations. However as seen clearly in FIG. 4(*b*), the magnitude of the y-velocity was reduced as compared to the baseline case. In one embodiment, this was because the net flow rate coming in from the split inlets was less than the net flow rate coming in from the inlets of the baseline case and the lower flow rate corresponds to lower velocity magnitude.

Similarly for the two-way split flow design with well-shaped cavities, 2 small magnitude y-velocities were additionally generated because of fluid sinks in the well before getting pushed back. However at the second well, y-velocity generated due to fluid sinking was higher than the first well. In one embodiment, this was due to higher flow rate available for the second well (fluid B was introduced into the channel at confluence 1 prior to approaching second well confluence). Again higher flow rate corresponds to higher velocity magnitude

Example 4

Pulsed Flow

Figure 5A:
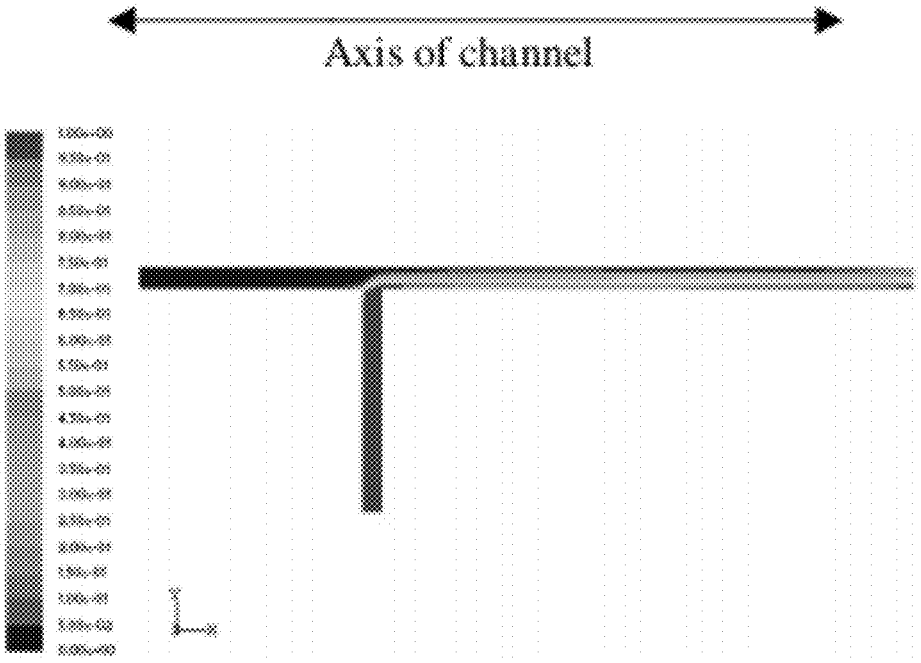
FIG. 5: Mass fraction contours of fluid "B" when the flow is pulsed (a) along the center plane for the "T" microchannel, and (b) at the outlet of the "T" microchannel. Fluid "A" is shown in blue and Fluid "B" is shown in red. Green color indicates a uniformly mixed region of fluids A and B.
Figure 5B:
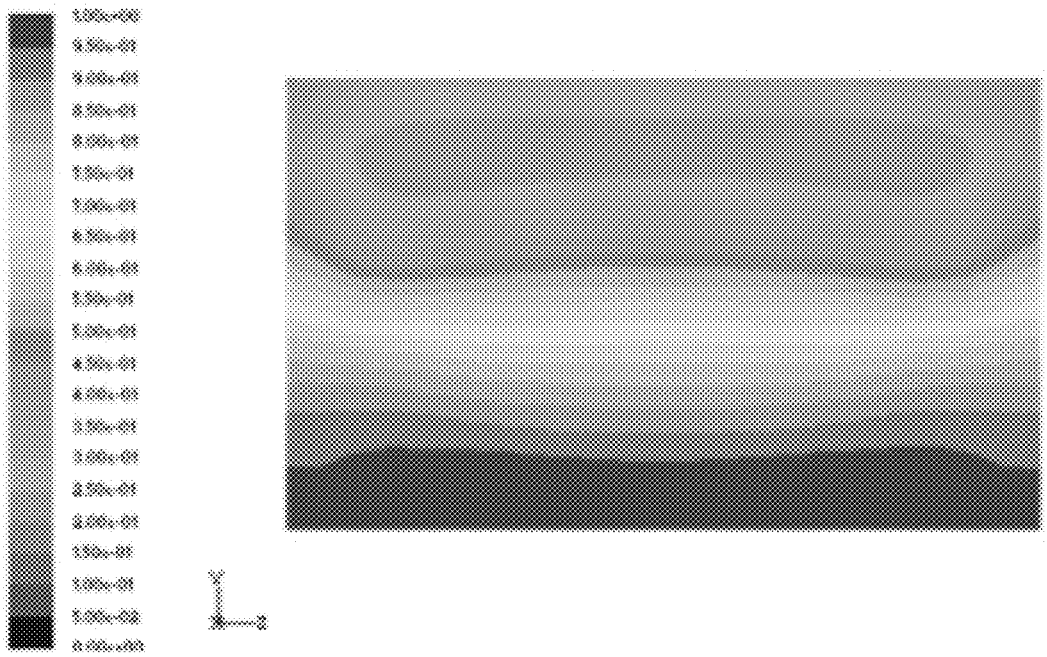
Figure 6A:
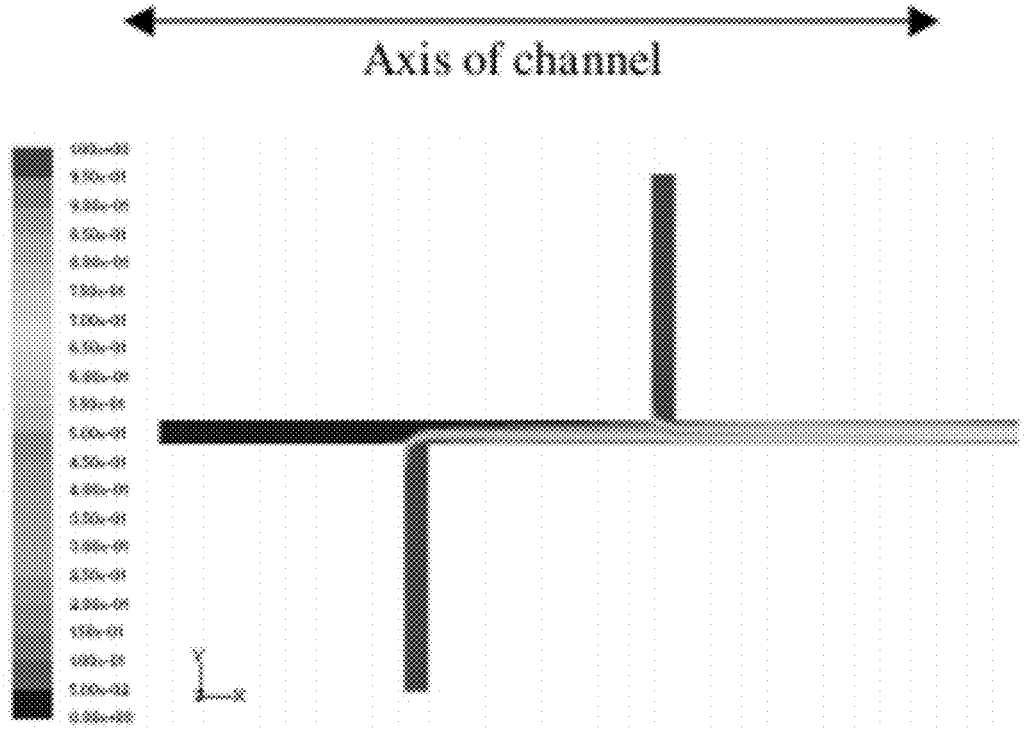
FIG. 6: Mass fraction contours of fluid "B" when the flow is pulsed (a) along the center plane for the two-way split flow design, and (b) at the outlet of the two-way split flow design. Fluid "A" is shown in blue and Fluid "B" is shown in red. Green color indicates a uniformly mixed region of fluids A and B.
Figure 6B:
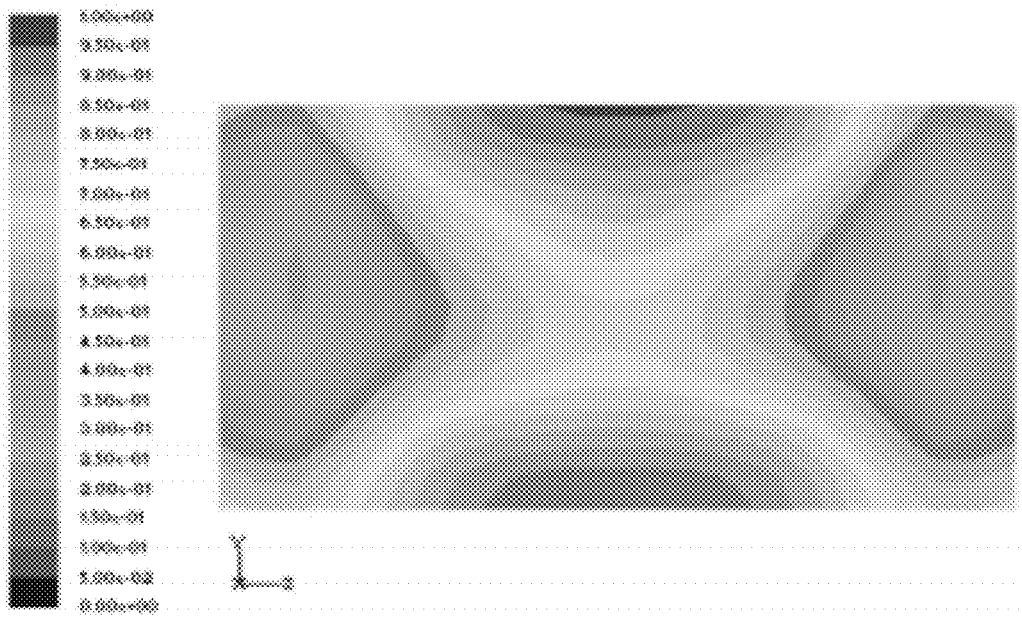

In this Example, we analyzed the effect of using pulsing on mixing in the three microchannel designs disclosed herein. The profile for pulsing the flow from the inlets was A+B sin ($2\pi ft$) which is similar to the profile used by Goullet et al. (Goullet et al., Mechanics Research Communication 33 (2006), pp. 739-746), where A is the mean velocity at the inlet, B is the amplitude of the pulsing, f is the frequency and t is the time. The mean velocity at each inlet was 1 mm/s with pulse amplitude of 7.5 mm/s and a frequency of 5 Hz. The flow velocity and mass fraction of each liquid were each recorded in each computational cell for defined time steps. There were 40 time steps per pulse cycle (Goullet et al. (2006)). It was the inventor's consideration that time pulsing enhances the mixing due to chaotic advection induced due to stretching and folding of the fluid layers (Glasgow et al. (2004); Glasgow et al., IMECE 2003-41586 (2003); Goullet et al. (2006), Goullet et al. (2005), Dasgupta et al., Analytical Chemistry (2002) 74(7): 208 A-213 A). FIGS. 5(*a* & *b*) show mass fraction contours for the baseline case after 3 pulses along the center plane and at the outlet respectively. FIGS. 6(*a* & *b*) show mass fraction contours for the two-way split flow design after 3 pulses along the center plane and at the outlet respectively. FIGS. 7(*a* & *b*) show mass fraction contours for the two-way split flow design with well shaped cavities after 3 pulses along the center plane and at the outlet respectively. Clearly mass fraction contours show enhanced mixing for both two-way split flow design with and without wells as compared with the baseline case. The results are summarized in Table 3.

TABLE 3

Comparison of degree of mixing for three exemplary configurations

| Design | Degree of Mixing |
|---|---|
| "T" microchannel | 0.47 |
| Two-way split flow design | 0.61 |
| Two-way split flow design with well shaped cavities | 0.67 |

Pulsing the flow enhances mixing by 47% for the "T" microchannel, by 22% for the two-way split flow microchannel and by 12% for the two-way split flow microchannel with well shaped cavities. Pulsating flow does not enhances mixing that significantly for the two-way split flow designs with and without wells because already the enhancement in mixing due to geometric modification was so significant. In the pulsating flow, two-way split flow design shows an increase in mixing of 30% over the baseline case, and two-way split flow design with well shaped cavities shows an increase in mixing of 43% over the baseline case. Adding wells enhances mixing of two-way split flow design by 10%.

The above data in Examples 1-4, using computational modeling methods for obtaining mixing enhancement in a "T" shaped microchannel show that geometric modifications to the baseline by splitting the flow in one of the inlets result in significant increase in mixing using the exemplary two-way split flow design. Adding well-shaped cavities to the split inlets further shows significant increased mixing over the baseline case and considerable increased mixing over the two-way split flow design.

Figure 8:
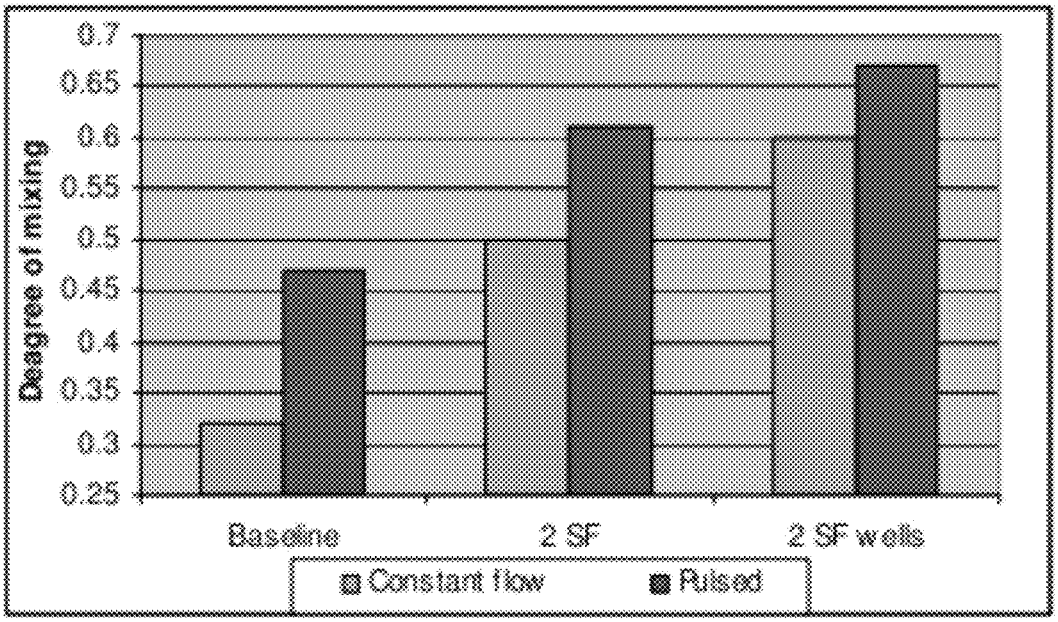
FIG. 8: Comparison of degree of mixing for the three designs considered, for both constant and pulsed flow.

FIG. 8 shows a comparison between the three methodologies discussed in Examples 1-4. Pulsing the flow enhances mixing by 47% for the "T" microchannel, by 22% for the two-way split flow microchannel and by 12% for the two-way split flow microchannel with well-shaped cavities. For the pulsating flow, the two-way split flow design shows an increase in mixing of 30% over the baseline case and the two-way split flow design with well-shaped cavities shows an increase in mixing of 43% over the baseline case. Adding wells enhances mixing of the two-way split flow design by 10%.

For the constant flow rate case, a 56% increase in mixing over the baseline case was obtained by employing the two-way split flow design. Adding wells to the split inlets shows an increase in mixing of 87.5% over the baseline case and 20% over the two-way split flow design.

Example 5

Two-Way Split Flow Technique

The above Examples (see also, Bhopte et al., IMECE2007-43387, Proceedings of IMECE 2007, Nov. 11-15 2007) demonstrate that mixing in "T" shaped microchannel can be significantly increased by splitting the perpendicular inlet in such a way that its flow rate was halved. Other half of the flow rate was introduced into the channel through another inlet of dimension same as that of the split inlet. Both the split inlets impinge the lateral flow from two opposite directions and enhance mixing.

Figure 9A:
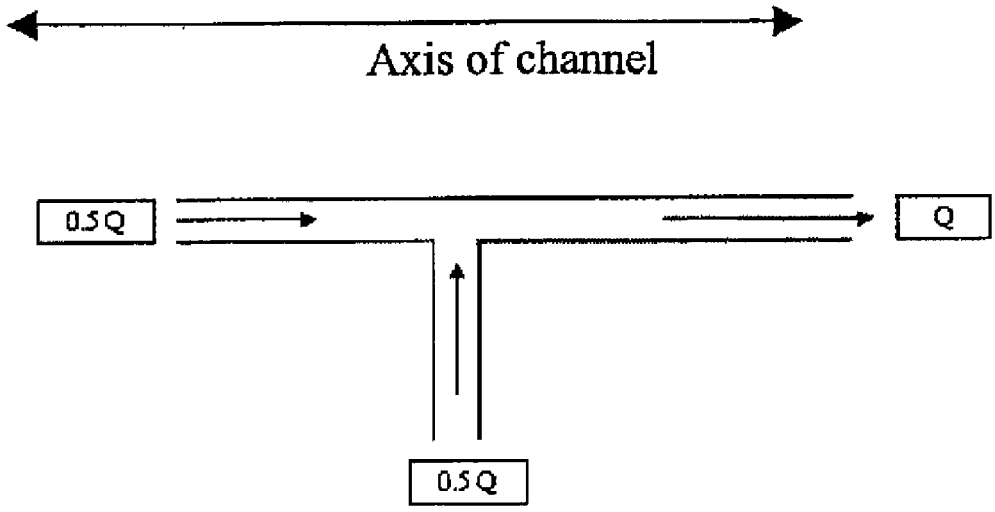
FIG. 9: (a) Baseline case with no splitting inlet channels having 2 inlet channels and 1 outlet.
Figure 9B:
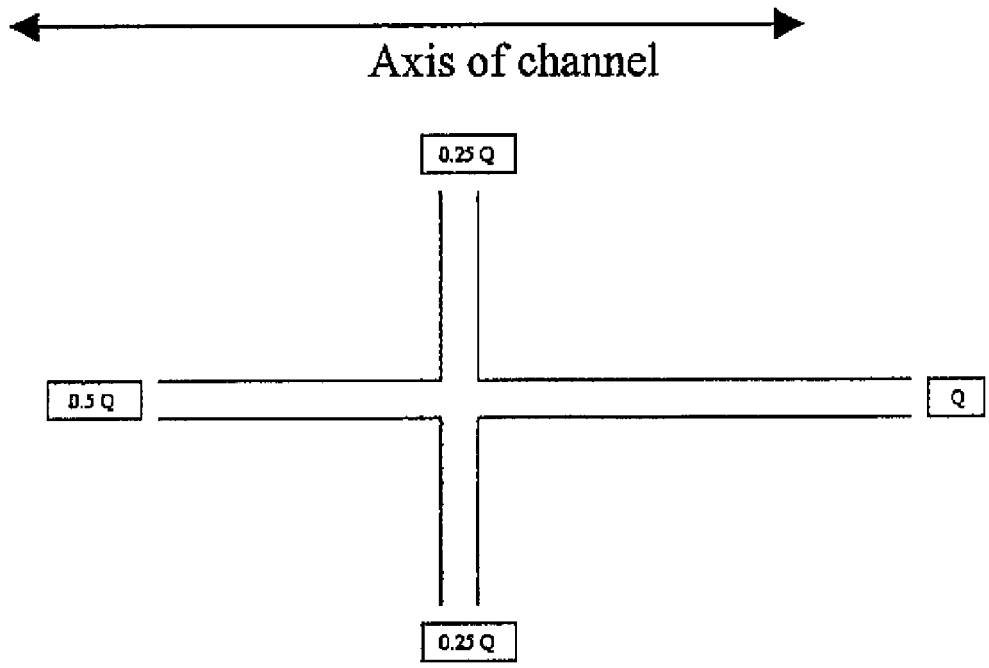

The above data show that splitting one of the branches of the "T" shaped microchannel into half such that the net flow rate at the outlet remains the same as the baseline case, significantly enhances mixing. While understanding the mechanism is not necessary, it was the inventors' consideration that mixing enhancement was due to generation of transverse velocity at two locations instead of one. FIG. 9(*a*) shows the baseline case with net flow rate at the outlet equal to "Q". FIG. 9(*b*) shows the two-way split flow model with split inlets impinging the lateral flow from two opposite directions. The net flow rate the outlet was still "Q."

Two approaches to splitting the flow rate are discussed below. In the first approach, one of the dimensions of the cross-section can be halved. For presenting the computational study, 200 μm×120 μm inlet was split into two inlets of 100 μm×120 μm cross-section. The velocity from all the inlets remains 1 mm/s. In the second approach, the dimension of the split inlet remains the same (200 μm×120 μm) but the fluid velocities in them were halved. So the velocity in the lateral branch remains 1 mm/s but the velocity in the perpendicular split inlets was 0.5 mm/s.

FIGS. 10(*a*) and 10(*b*) show the mass fraction contours for the two-way split flow designs. FIG. 11 shows a comparison of the two designs with the baseline case. Two-way split flow designs with "split dimension" and "split velocity" both respectively show 70% and 74% increase in degree of mixing when compared with the baseline case. Bhopte et al (Bhopte et al., IMECE2007-43387, Proceedings of IMECE 2007, Nov. 11-15 (2007)) have discussed that unlike the baseline case, two-way split flow design enhances mixing by impinging the primary stream from two opposite directions. Due the generation of transverse velocity at two locations mixing was enhanced. However the magnitude of transverse velocity (which governs the penetration depth) was reduced due to reduced flow rate from the split dimension. But this reduction in transverse velocity was accounted by the formation of additional fluid "A-B" interfaces.

FIG. 12 (*a* & *b*) is a plot for mass fraction along the channel width (0-200 μm) at the center of the channel (60 μm), plotted at a cross-section 500 μm behind the outlet. Mass fraction profile clearly shows that additional interface was formed between the two fluids, resulting in reduced diffusion distance and considerable increase in mixing.

FIG. 13 (*a* & *b*) are plots for transverse velocity plotted near center line (10 μm below center line towards confluence) of the channel for the baseline case and two-way split flow design with split dimension respectively. As clearly seen in the FIG. 13(*b*), unlike for the baseline, transverse velocity for the two-way split flow design was generated at two locations in two different directions. Also the magnitude of the transverse velocity was reduced due to the reduced flow rate coming from split inlets.

Both the split flow designs, i.e., the split dimension design and split velocity design, significantly enhanced the mixing when compared with the baseline case. Both designs yielded similar results. However, the split-velocity design performed slightly better in this embodiment.

Example 6

Impact of Number of Geometric Splits on Mixing

As discussed previously, two-way split flow designs enhances mixing by generating transverse velocities at two locations. So another design employing four-way dimensional split was considered to investigate if generating the transverse velocity at four locations further enhances mixing or not. FIG. 14 is a mass fraction contours for a four-way split flow design. Surprisingly, mass fraction contours clearly shows that mixing actually was affected adversely when compared to the two-way split flow design with split dimension.

FIG. 15 shows a comparison of two-way and four-way split flow designs with the baseline case. Four-way split flow designs shows 52% increase in mixing when compared with the baseline case. In one embodiment, this increase in mixing was a result of transverse velocity being generated at four locations instead of one and creation of additional fluid A-B interface.

However when compared with two-way split flow design, surprisingly the degree of mixing actually drops by 10%. Even though the transverse velocity was generated at four locations, still the degree of mixing shows a reduction. While understanding of a mechanism in not necessary, it was the inventors; consideration that this reduction was due to the magnitude of transverse velocity being reduced due to further reduction in inlet dimension. This is seen clearly in FIG. 16, which is a plot of transverse velocity near center line locations.

Hence four-way split flow design may not be an optimal solution from mixing point of view. Also reducing the dimension of the inlets further may eventually lead to unreasonable pressure drops to drive the flow. Hence two-way split flow design with a geometric modification can improve mixing in a "T" microchannel significantly.

Example 7

Impact of Distance Between Split Inlets on Mixing

In this Example, distance between the split inlets of a two-way split flow design was modified to investigate its impact on mixing. For the two-way split flow design described above, the split inlets were opposing each other. Two more designs were considered with distance between inlets equal to 1250 μm and 2500 μm. FIG. 17 (a, b & c) show the three two-way split flow designs considered to present the study. FIG. 18 shows mass fraction contours at the plane near the outlets of all the three designs. This plane was highlighted in all the previous cases and degree of mixing was calculated at this location for the design scenarios discussed herein.

As seen in the FIG. 18, there was a considerable difference in the mass fraction contours for all the three designs considered. To quantify the difference, degree of mixing was computed for these designs at this plane. FIG. 19, shows comparison between these designs.

Two-way split flow design with 1250 μm distance between the inlets performs the best, with respect to the degree of mixing, amongst the three designs. As discussed previously, mixing in a microchannel enhances due to generation of transverse velocity. Transverse velocity enables the fluid to penetrate the lateral flow. Penetration depth was a function of magnitude of transverse velocity. Two-way split flow design with opposing inlets negates some of the impact of transverse velocity. As seen in FIG. 13(*b*) magnitude of transverse velocity monitored near center line(s) was 0.175 mm/s. For the design with 1250 μm between the split inlets, magnitude of this velocity increases up to 0.6 mm/s (refer to FIG. 20*a*). This increase in velocity magnitude enables the fluid to penetrate the lateral flow more deeply thereby enhancing mixing.

For the two-way split flow design with 2500 μm between the split inlets the magnitude of transverse velocity was exactly the same as for the design with 1250 μm between the split inlets, as seen in FIG. 20(*b*). However the second inlet for this design in closer to the outlet and the fluid gets very little opportunity to diffuse when compared to design with 1250 μm between the inlets. On the other hand, for the design with opposing inlets, even though the impact of transverse velocity was less, still the fluids get more time to diffuse when compared with the other two designs.

Based on this study, a fourth design was considered which will have minimum separation between the inlets so as to have maximum impact of transverse velocity and diffusion. However, in one embodiment, the designs were considered to have maximum impact at the confluence, because diffusivity of such reagents was so low that it would take a very long microchannel to get them completely mixed.

FIG. 21 clearly shows more diffuse mass fraction contours, when compared with the three other two-way split flow designs discussed and the baseline case. Degree of mixing monitored at the same plane shown above was 0.43. FIG. 22 is a plot at the center of the cross-section shown in FIG. 21. Unlike for the baseline case (refer to FIG. 12*a*), the plot clearly shows that there was no completely unmixed fluid corresponding to mass fractions of 0 or 1.

Hence this design shows 87% increase in mixing when compared with the baseline case and an additional 10% increase in mixing when compared with the two-way split flow design with opposing inlets. Hence as a design guideline, the split inlets in a two-way split flow design are more preferably located close to each other, rather than opposing each other.

Example 8

Impact of Adding Well Shaped Cavities to Two-Way Split Flow Design

Further to the above discussed data in Example 2 in which well shaped cavities were used at the split inlets, the same approach was used in this Example to see if adding two well shaped cavities at the split inlets further enhances mixing in our two-way split flow design. A two-way split flow design was considered with inlets just 300 μm apart. Also 100 μm deep well shaped cavities were added at the split inlets. FIG. 23 shows a two-way split flow design with well shaped cavities.

Mass fraction contours clearly show that mixing was best for this design amongst all the designs considered to present the study. To quantify mixing, degree of mixing was calculated at the plane shown above and was equal to 0.48. Hence ~12% increase in mixing was achieved by adding two well shaped cavities at the split inlets. This result was consistent with the results discussed supra in Examples 1-4. Split inlets induce significant transverse velocities at two locations in the lateral flow. Adding small well cavities further adds very small yet considerable transverse velocities. The lateral flow sinks in the well prior to getting pushed back into the channel. Hence in a two-way split flow design with well shaped cavities transverse velocity was generated at four locations, instead of two. However, since the magnitude of velocities generated due to the wells was very small, so increase in mixing was of the order of 10%. FIG. 24 is a plot for mass fraction of fluid B at the center of the cross-section shown in FIG. 23. Clearly the profile shows significant increase in mixing over the baseline case (FIG. 12*a*) and a considerable increase in mixing over the two-way split flow design with 300 μm distance between split inlets design (refer to FIG. 22).

FIG. 25 shows comparison in the degree of mixing for various designs considered in herein. As discussed previously, of the configurations described in Examples 1-8, the best two-way split flow design (2 SFD) was the one where the split inlets were a small distance apart (such as the exemplary 300 μm used herein). This design shows an increase in mixing by 87% when compared with the baseline case. Two-way split flow design with well shaped cavities shows an increase in mixing by 108% when compared with the baseline case and an additional 12% increase in mixing when compared to two-way split flow design where the split inlets are a small distance apart.

Example 9

Application of Split Flow Design to Microchannel Geometries

Using the methods disclosed supra, FIG. 26 shows the mass fraction contours in a "T" shaped microchannel, and FIGS. 27 and 21 show a two-way split flow design applied to "T" shaped microchannel. In this Example, the split flow design technique was applied to microchannel geometries. All the geometries initially have two inlets and one outlet. Both the inlets were split (resulting in 4 inlets) and the halved flow rates were imposed over the lateral flow from two opposite directions. Mass fraction contours clearly show enhanced mixing (green contours) for all the corresponding split flow designs (FIGS. 28, 29, & 30).

In one embodiment, the degree of mixing in a ⊢ microchannel as shown in FIG. 28(*a*) was 0.18 (i.e., 18%) mixed with a pressure drop of 32 Pascal.

For all the three configurations, i.e., "⊢", "←" and "Y" shaped microchannels, application of the invention's split flow design technique was shown to improve the mixing significantly. In one embodiment, this increase in mixing was due to creation of multiple fluid A-fluid B interfaces over the same cross-section and generation of transverse velocities in lateral flow at 4 locations. FIG. 31 shows a comparison of all the three designs considered with the corresponding split flow design modifications. For all the cases approximately a 300% increase in fluid mixing was observed when each of two fluids was split into two inlets (i.e., a total of 4 inlets and one outlet) compared to in the absence of splitting of both fluids (i.e., a total of 2 inlets and one outlet) in each of the three configurations (FIGS. 28-31) (Compare Designs A and B in Table 1).

Example 10

Baseline Split and Mix (SAM) Mixer

This Example illustrates the baseline SAM mixer. The split inlets were 75 μm wide and 300 μm deep. The lateral channel was 150 μm wide and 300 μm deep. The average velocity in the lateral channel was 5 mm/s corresponding to Reynolds number of 1. To facilitate comparison, all the SAM mixer designs proposed herein (Examples 10-14) had a stream-wise length of 8000 μm for similar residence times. FIG. 32 shows mass fraction contours along the center plane and outlet of a baseline SAM mixer. Red and blue contours represent inlet flow regions corresponding to mass fractions of 1 and 0 respectively. Green contours represent mixed regions corresponding to mass fraction of 0.5.

Mass fraction at the outlet of the baseline mixer shows enhanced mixing. The mixing was achieved due to complex flow pattern inside the mixer. These flow patterns can be summarized as: (a) Flow entered from multiple inlets forming multiple flow interfaces, thereby inducing initial mixing. (b) The flow split again into two smaller channels in which fluid traveled in square wave pattern. Since flow entered a smaller inlet, the diffusion distance was reduced. The flow while traveling in square wave pattern underwent rapid changes in direction, which introduced higher shear in flow velocities. The flow merged in a bigger channel in transverse direction while incorporating a nozzle like effect and inducing transverse velocity in lateral flow. All these effects enhanced the mixing further.

For the baseline SAM mixer, the degree of mixing was 0.78 (i.e., 78%) mixed with a pressure drop of 39.5 Pascal. This represents a 433% increase in fluid mixing when compared to a ⊢ microchannel as shown in FIG. 28(*a*), in which the degree of mixing was 0.18 (i.e., 18%) mixed with a pressure drop of 32 Pascal.

Example 11

Multistage SAM Mixer

Like the baseline SAM mixer, another mixer having a series of split and merge (SAM) links is also provided herein. The lengths of split channels were adjusted to preserve the stream-wise fluid length of 8000 μm. FIG. 33 shows mass fraction contours at the center plane and outlet of a multistage SAM mixer with 3 mixer links.

Each SAM mixer link enhanced mixing due to the above-discussed reasons in Example 10. However due to the increase in the number of mixer links, the pressure drop across the mixer increased. For the exemplary multistage SAM mixer that had 3 SAM mixer links, the degree of mixing was 0.86 (i.e., 86%) mixed with a pressure drop of 47.7 Pascal. This represents a 477% increase in fluid mixing when compared to a ⊢ microchannel as shown in FIG. 28(*a*), in which the degree of mixing was 0.18 (i.e., 18%) mixed with a pressure drop of 32 Pascal.

Example 12

SAM Mixer with Opposing Streams

Design A

Numerical analysis of the SAM mixer showed that fluid exited out of the SAM mixer link and approached towards the outlet with unmixed portions near the channel walls. Hence, the following SAM mixer design is provided in order to bring the unmixed portions together. This was achieved by making the split streams opposing each other and then merging them in a way that the unmixed portions formed an interface. FIG. 34 shows mass fraction contours at the center plane and outlet of a SAM mixer with opposing streams (Design A). Mass fraction contours clearly showed that the unmixed portions formed an interface towards the center of the outlet channel. Mass fraction clearly showed enhanced mixing as compared to the baseline and multistage SAM mixers. The lengths of split channels were adjusted to preserve the stream wise fluid length of 8000 μm.

For the SAM mixer with opposing streams (Design A), the degree of mixing was 0.89 (i.e., 89%) mixed with a pressure drop of 44.4 Pascal. This represents a 494% increase in fluid mixing when compared to a ⊢ microchannel as shown in FIG. 28(*a*), in which the degree of mixing was 0.18 (i.e., 18%) mixed with a pressure drop of 32 Pascal.

Note that due to the use of only one SAM mixer link, the pressure drop was lower (i.e., a desirable feature for certain applications) than for the multistage SAM mixer of Example 11. Also, because of the presence of additional fluid interface, the degree of mixing increased compared to the multistage SAM mixer of Example 11.

Example 13

SAM Mixer With Opposing Streams

Design B

SAM mixer opposing streams (Design A) had the outlet channel inside the SAM mixer link. To facilitate fabrication, another mixer design is provided herein, in which the opposing inlets merged in transverse direction, and the outlet channel again became lateral after traversing an exemplary square wave path. The lengths of split channels were adjusted to preserve the stream wise fluid length of 8000 μm. FIG. 35 shows mass fraction contours at the center plane and outlet of a SAM mixer with opposing streams (Design B).

For the SAM mixer with opposing streams (Design B), the degree of mixing was 0.89 (i.e., 89%) mixed with a pressure drop of 43.6 Pascal. This represents a 494% increase in fluid mixing when compared to a ⊢ microchannel as shown in FIG. 28(*a*), in which the degree of mixing was 0.18 (i.e., 18%) mixed with a pressure drop of 32 Pascal.

Note that due to only 1 SAM mixer link pressure drop was lower that the multistage SAM mixer. However to opposing streams mixing was better than multistage SAM mixer.

Example 14

SAM Mixer with Opposing Streams

With Grooves

Since SAM mixer with opposing streams (Design B) achieved very high mixing with low pressure drop, we tested whether we could enhance mixing by introducing localized turbulence, by incorporating grooves in the microchannel. In this example, the grooves or steps retarded and then accelerated the flow prior to entering the outlet channel. Rapid changes in flow direction induced mixing due to very high shear in fluid flow velocities. FIG. 36 shows mass fraction contours at the center plane and outlet of a SAM mixer with opposing streams with two grooves. The lengths of split channels were adjusted to preserve the stream wise fluid length of 8000 μm.

For the SAM mixer with opposing streams with grooves, the degree of mixing was 0.92 (i.e., 92%) mixed with a pressure drop of 47 Pascal. This represents a 511% increase in fluid mixing when compared to a ⊢ microchannel as shown in FIG. 28(*a*), in which the degree of mixing was 0.18 (i.e., 18%) mixed with a pressure drop of 32 Pascal.

Note that due to introduction of grooves (FIG. 36), the pressure drop through the mixer increased compared to in the absence of grooves (FIG. 35).

All publications and patents mentioned in the above specification are herein incorporated by reference. Various modifications and variations of the described methods and system of the invention will be apparent to those skilled in the art without departing from the scope and spirit of the invention. Although the invention has been described in connection with specific preferred embodiment, it should be understood that the invention as claimed should not be unduly limited to such specific embodiment. Indeed, various modifications of the described modes for carrying out the invention which are obvious to those skilled in the art and in fields related thereto are intended to be within the scope of the following claims.

We claim:

1. A device comprising a first mixer of laminar microfluidic streams, wherein the first mixer comprises a) a first mixing channel having a longitudinal axis and an outlet, b) a first inlet channel, for a first fluid, in transverse fluid communication with said first mixing channel at a first confluence along said longitudinal axis, c) a second inlet channel, for said first fluid, in transverse fluid communication with said first mixing channel at a second confluence along said longitudinal axis, d) a third inlet channel, for a second fluid, in transverse fluid communication with said first mixing channel at a third confluence along said longitudinal axis, and e) a fourth inlet channel, for said second fluid, in transverse fluid communication with said first mixing channel at a fourth confluence along said longitudinal axis, wherein i) said first confluence, said second confluence, said third confluence, and said fourth confluence are not opposite each other, and ii) said first confluence and said second confluence alternate with said third confluence and with said fourth confluence.

2. The device of claim 1, further comprising a second mixer of laminar microfluidic streams, wherein said second mixer comprises f) a merge channel having a first inlet and a second inlet, g) a second mixing channel having an inlet and an outlet, wherein said second mixing channel inlet is in transverse fluid communication with said merge channel at a mixing channel confluence, h) a first splitting channel having an inlet and an outlet, wherein said first splitting channel inlet is in transverse fluid communication with said first mixing channel outlet, and wherein said first splitting channel outlet is in transverse fluid communication with said merge channel first inlet at a fifth confluence, and i) a second splitting channel having an inlet and an outlet, wherein said second splitting channel inlet is in transverse fluid communication with said first mixing channel outlet, wherein said second splitting channel outlet is in transverse fluid communication with said merge channel second inlet at a sixth confluence, and wherein said fifth confluence and said sixth confluence are not opposite each other, and are not on the same side of said mixing channel confluence.

3. The device of claim 2, wherein each of said first splitting channel and said second splitting channel comprises 2 turns.

4. The device of claim 3, wherein said second mixing channel comprises 3 turns.

5. The device of claim 4, wherein said merge channel comprises (i) a groove between said first inlet of said merge channel and said inlet of said second mixing channel, and (ii) a groove between said second inlet of said merge channel and said inlet of said second mixing channel.

6. The device of claim 1, further comprising a second mixer of laminar microfluidic streams, wherein said second mixer comprises f) a merge channel having an inlet and outlet, g) a first splitting channel having an inlet and an outlet, wherein said first splitting channel inlet is in transverse fluid communication with said first mixing channel outlet, and wherein said first splitting channel outlet is in transverse fluid communication with said merge channel inlet at a fifth confluence, and h) a second splitting channel having an inlet and an outlet, wherein said second splitting channel inlet is in transverse fluid communication with said first mixing channel outlet, and wherein said second splitting channel outlet is in transverse fluid communication with said merge channel at a sixth confluence, and wherein said fifth confluence and said sixth confluence are not opposite each other.

7. The device of claim 6, wherein each of said first splitting channel and said second splitting channel comprises 2 turns.

8. A system comprising the device of claim 2, and a means for controlling fluid flow.

9. The system of claim 8, wherein said means for controlling fluid flow comprises a valve.

10. The system of claim 9, wherein said means for controlling fluid flow comprises a pump.

* * * * *